US010494909B2

(12) United States Patent
Grounds, III et al.

(10) Patent No.: US 10,494,909 B2
(45) **Date of Patent: *Dec. 3, 2019**

(54) SYSTEM AND METHOD FOR ELECTRICALLY SELECTABLE DRY FRACTURE SHALE ENERGY EXTRACTION

(71) Applicant: Highland Light Management Corp, Montgomery Village, MD (US)

(72) Inventors: Preston W Grounds, III, Davidsonville, MD (US); Daniel Moos, Palo Alto, CA (US)

(73) Assignee: Highland Light management Corp, Montgomery Village, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/977,802

(22) Filed: May 11, 2018

(65) Prior Publication Data

US 2018/0363433 A1 Dec. 20, 2018

Related U.S. Application Data

(63) Continuation-in-part of application No. 14/825,145, filed on Aug. 12, 2015, now Pat. No. 9,970,276.

(60) Provisional application No. 62/037,145, filed on Aug. 14, 2014, provisional application No. 62/037,147, filed on Aug. 14, 2014, provisional application No. 62/037,148, filed on Aug. 14, 2014, provisional application No. 62/037,151, filed on Aug. 14, 2014, provisional application No. 62/037,154, filed on Aug. 14, 2014, provisional application No. 62/037,156, filed on Aug. 14, 2014, provisional application No. 62/037,159, filed on Aug. 14, 2014.

(51) Int. Cl.

| | |
|---|---|
| ***E21B 43/24*** | (2006.01) |
| ***E21B 47/12*** | (2012.01) |
| ***H05B 6/72*** | (2006.01) |
| ***E21B 17/00*** | (2006.01) |

(52) U.S. Cl.

CPC ..... *E21B 43/2401* (2013.01); *E21B 17/003* (2013.01); *E21B 43/2408* (2013.01); *E21B 47/122* (2013.01); *H05B 6/72* (2013.01); *H05B 2214/03* (2013.01)

(58) Field of Classification Search

None

See application file for complete search history.

(56) References Cited

U.S. PATENT DOCUMENTS

2013/0192825 A1 8/2013 Parsche
2014/0231416 A1* 8/2014 Wright ..... E21B 43/2401 219/679
2016/0097268 A1* 4/2016 Okoniewski ..... E21B 43/2401 166/248

* cited by examiner

*Primary Examiner* — Anuradha Ahuja

(57) ABSTRACT

A system and method are provided that use RF energy to enhance the extraction of oil and gas from hydrocarbon bearing strata. A three-dimensional underground electromagnetic array of coupled well pipe segments is used to guide RF energy to where that energy is converted to heat in the hydrocarbon bearing strata. The three dimensional underground electromagnetic array of coupled well pipe segments includes a switch to selectively activate coupled well pipe segments and is a guided wave structure, as opposed to an antenna structure, to minimize the unwanted effects of the near fields associated with antennas. In one embodiment, the leas of the three-dimensional underground electromagnetic array are composed of production well pipe.

18 Claims, 35 Drawing Sheets

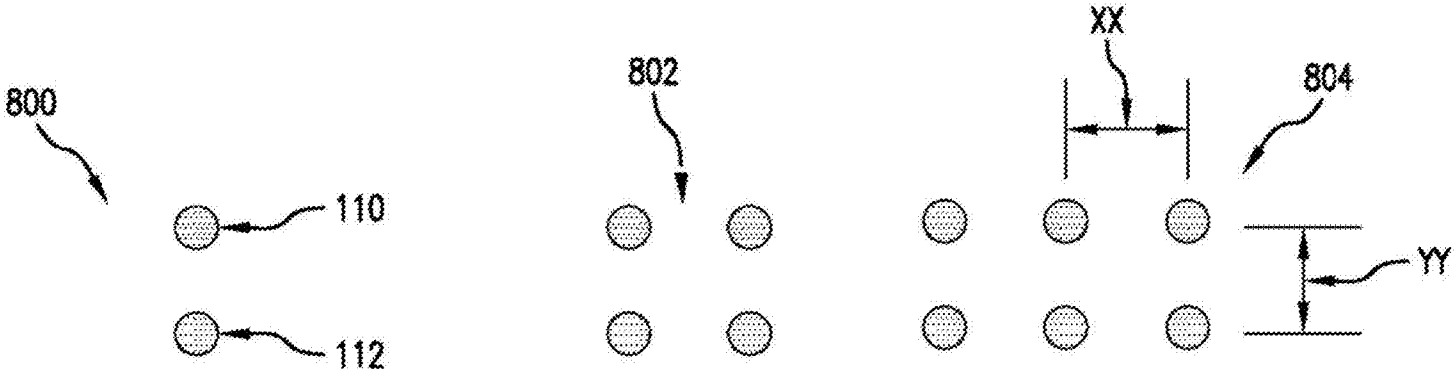
FIG.8A
FIG.8B
FIG.8C
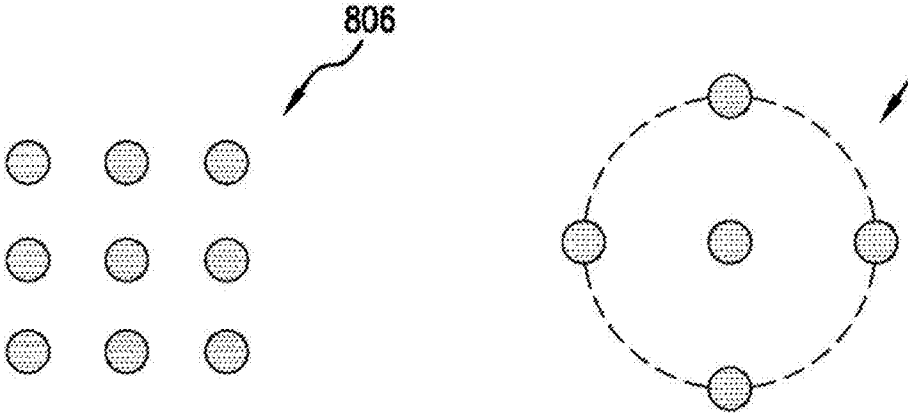
FIG.8D
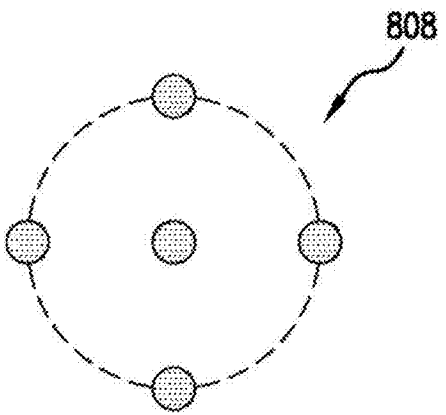
FIG.8E

SYSTEM AND METHOD FOR ELECTRICALLY SELECTABLE DRY FRACTURE SHALE ENERGY EXTRACTION

The present application claims priority from: U.S. Provisional Application No. 62/037,145, filed Aug. 14, 2014; U.S. Provisional Application No. 62/037,147, filed Aug. 14, 2014; U.S. Provisional Application No. 62/037,148, filed Aug. 14, 2014: U.S. Provisional Application No. 62/037,151, filed Aug. 14, 2014; U.S. Provisional Application No. 62/037,154, filed Aug. 14, 2014; U.S. Provisional Application No. 62/037,156, filed Aug. 14, 2014; and U.S. Provisional Application No. 62/037,159, filed Aug. 14, 2014, the entire disclosures of which are incorporated herein by reference. The present application is a continuation-in-part of U.S. application Ser. No. 14/825,145 filed Aug. 12, 2015, the entire disclosure of which is incorporated herein by reference.

BACKGROUND

The present invention generally deals with systems and methods for the enhanced extraction of oil and gas from hydrocarbon bearing strata using RF heating to cause increased permeability and in situ pyrolysis.

Extraction of oil from oil shale, or more generally, hydrocarbon bearing strata, is an industrial process for oil production. This process converts kerogen in hydrocarbon bearing strata into oil by pyrolysis, hydrogenation, or thermal dissolution. The resultant oil is used as fuel oil or upgraded to meet refinery feedstock specifications by adding hydrogen and removing sulfur and nitrogen impurities. Kerogen is considered to have been formed by the deposition of plant and animal remains in marine and non-marine environments. Each kerogen deposit is unique. Alteration of this deposited material during subsequent geological periods produced a wide variety of kerogen maturities. Source material and conditions of deposition are the major factors influencing the type of kerogen and hence the amount and quality of oil and/or gas formed.

Extraction of oil from hydrocarbon bearing strata in the past has been performed above ground (ex situ processing) by mining the hydrocarbon bearing strata and then treating it in processing facilities. Newer modern technologies are being used to attempt the processing underground (in situ processing) by applying heat and extracting the oil via oil wells. The quality of the oils from shale are highly dependent on the temperature at which the kerogen is "cooked" either in situ or above ground and generally consists of variable molecular weight organic liquids, gasses and condensates.

In situ technologies heat hydrocarbon bearing strata underground by injecting hot fluids into the rock formation, or by using linear or planar heating sources followed by thermal conduction and convection to distribute heat through the target area. The oil is then recovered through vertical wells drilled into the formation. These technologies are potentially able to extract more oil from a given area of land than conventional ex situ processing technologies, as the wells can reach greater depths than surface mines. Unlike for underground mining, there is no requirement to leave pillars in place to prevent roof collapse, which also equates to more oil and gas from the same volume. They also present an opportunity to recover oil from low-grade deposits where traditional mining techniques would be uneconomical.

An in situ shale retort can be formed by many methods, such as the methods disclosed in U.S. Pat. No. 4,043,598 to Gordon B. French et al. The process can also be practiced on shale oil produced by other methods of retorting. Many of these methods for shale oil production are described, in Synthetic Fuels Data Handbook, compiled by Dr. Thomas A. Henrickson, and published by Cameron Engineers, Inc., Denver, Colo. For example, other processes for retorting hydrocarbon bearing strata include those known as the TOSCO, Paraho Direct, Paraho Indirect, N-T-U, and Bureau of Mines, Rock Springs, processes.

The Illinois Institute of Technology developed the concept of hydrocarbon bearing strata volumetric heating using radio waves (radio frequency processing) during the late 1970s. This technology was further developed by Lawrence Livermore National Laboratory. Hydrocarbon bearing strata is heated by vertical electrode arrays. Deeper volumes could be processed at slower heating rates by installations spaced at tens of meters. The concept presumes a radio frequency at which the skin depth is many tens of meters, thereby overcoming the thermal diffusion times needed for conductive heating. Its drawbacks include intensive electrical demand and the possibility that groundwater or char would absorb undue amounts of the energy.

Microwave heating technologies are based on the same principles as radio wave heating, although it is believed that radio wave heating is an improvement over microwave heating because its energy can penetrate farther into the hydrocarbon bearing strata. The microwave heating process was tested by Global Resource Corporation. Electro-Petroleum proposes electrically enhanced oil recovery by the passage of direct current between cathodes in producing wells and anodes located either at the surface or at depth in other wells. The passage of the current through the hydrocarbon bearing strata results in resistive Joule heating.

In many cases, before an in situ retorting process can function, it is necessary to develop techniques to increase the permeability of the hydrocarbon bearing strata. Induced fracturing, the best method of increasing the effective permeability of oil-shale deposits, may be accomplished by hydraulic pressure, high explosives, high-voltage electricity, or heating of the formation, or combinations of two or more of these.

Hydraulic fracturing, or fracking, has played an important role in the development of America's oil and natural gas resources for nearly 60 years. In the U.S., an estimated 35,000 wells are processed with the hydraulic fracturing method; it's estimated that over one million wells have been hydraulically fractured since the first well in the late 1940s. Each well is a little different, and each one offers lessons learned. The oil and natural gas production industry uses these lessons to develop best practices to minimize the environmental and societal impacts associated with development. Studies estimate that up to 80 percent of natural gas wells drilled in the next decade will require hydraulic fracturing to properly complete well setup. Horizontal drilling is a key component in the hydraulic fracturing process.

In a hydraulic fracturing job, "fracturing fluids" or "pumping fluids" consisting primarily of water and sand are injected under high pressure into the producing formation, creating fissures that allow resources to move freely from rock pores where it is trapped. Typically, steel pipe known as surface casing is cemented into place at the uppermost portion of a well for the explicit purpose of protecting the groundwater. The depth of the surface casing is generally determined based on groundwater protection, among other factors. As the well is drilled deeper, additional casing is installed to isolate the formation(s) from which oil or natural gas is to be produced, which further protects groundwater from the producing formations, in the well. Casing and cementing are critical parts of the well construction that not only protect any water zones, but are also important to successful oil or natural gas production from hydrocarbon bearing zones. Industry well design practices protect sources of drinking water from the other geologic zone of an oil and natural gas well with multiple layers of impervious rock. While 99.5 percent of the fluids used consist of water and sand, some chemicals are added to improve the flow. The composition of the Chemical mixes varies from well to well.

Hydraulic fracturing has been successful at increasing the flow of gas from low permeability shales. Low permeability shales are those in which the permeability is than 1 microdarcy and oil and gas cannot be recovered economically without well stimulation. This wet fracturing has been shown to increase the amount of flow from a well many times over by causing cracks in the shale to expose large areas of gas to harvesting. One issue with hydraulic fracturing is that it requires the use of large amounts water at high pressure to cause fractures in the underground hydrocarbon bearing shale. This water is mixed with various chemicals, an individual proprietary mixture for each fracking company, to help with the fracturing process. The amount of water used per well varies by location but can be as much as 4 to 5 million gallons. Getting this much water to the well head can cause wear problems for local roads due to the 400 to 500 heavy tanker trucks required. Pumping this water can cause significant level reduction in local aquifers, which can cause local water wells to run dry. In addition, 10% to 40% of this water comes back to the surface contaminated with subsurface chemicals and needs to be cleaned up before release into the environment, or disposed of in some other environmentally responsible manner. The amount of water required to open up hydrocarbon seal shales has been called the single biggest problem in the shale gas industry What is needed is a system and method, which can recover the oil and gas in place from subsurface low permeability hydrocarbon bearing strata with minimal water usage. Further, the system and method should also be capable of converting the kerogen within the hydrocarbon bearing strata into additional oil and gas, which can also be recovered.

SUMMARY

The present invention is drawn to a system and method for recovering the oil and gas in place from subsurface low permeability hydrocarbon bearing strata with minimal water usage. Further, the system and method is capable of converting the kerogen within the hydrocarbon bearing strata into additional oil and gas, which can also be recovered.

An aspect of the present invention is drawn to a system comprising a first primary-phase well pipe segment, a primary-phase dielectric spacer, a second primary-phase well pipe segment, a primary-phase RF transmission line segment, a primary-phase well pipe segment switch, a first secondary-phase well pipe segment, a secondary-phase dielectric spacer, a second secondary-phase well pipe segment, a secondary-phase RF transmission line segment, and a secondary-phase well pipe segment switch. The primary-phase dielectric spacer is connected to the first primary-phase well pipe segment. The second primary-phase well pipe segment is connected to the primary-phase dielectric spacer such that the primary-phase dielectric spacer is disposed between the first primary-phase well pipe segment and the second primary-phase well pipe segment. The primary-phase RF transmission line segment is operable to transmit a first RF signal. The primary-phase well pipe segment switch has a first input port, a first output port, a second output port and a third output port. The primary-phase well pipe segment switch is operable to be in a first primary-phase well pipe segment state so as to electrically connect the first input port with the first output port and the second output port and is operable to be in a second primary-phase well pipe segment state so as to electrically connect the first input port with the third output port. The secondary-phase dielectric spacer is connected to the first secondary-phase well pipe segment. The second secondary-phase well pipe segment is connected to the secondary-phase dielectric spacer such that the secondary-phase dielectric spacer is disposed between the first secondary-phase well pipe segment and the second secondary-phase well pipe segment. The secondary-phase RF transmission line segment is operable to transmit a second. RF signal. The secondary-phase well pipe segment switch has a second input port, a fourth output port, a fifth output port and a sixth output port. The secondary-phase well pipe segment switch is operable to be in a first secondary-phase well pipe segment state so as to electrically connect the second input port with the fourth output port and the fifth output port and is operable to be in a second secondary-phase well pipe segment state so as to electrically connect the second input port with the sixth output port. The first primary-phase well pipe segment and the first secondary-phase well pipe segment form a first two-wire transmission line when the primary-phase well pipe segment switch is in the first primary-phase well pipe segment state and when the secondary-phase well pipe segment switch is in the first secondary-phase well pipe segment state. The second primary-phase well pipe segment and the second secondary-phase well pipe segment form a second two-wire transmission line when the primary-phase well pipe segment switch is in the second primary-phase well pipe segment state and when the secondary-phase well pipe segment switch is in the second secondary-phase well pipe segment state.

BRIEF SUMMARY OF THE DRAWINGS

The accompanying drawings, which are incorporated in and form a part of the specification, illustrate an exemplary embodiment of the present invention and, together with the description, serve to explain the principles of the invention. In the drawings:

FIG. 8*a* illustrates a two-wire transmission line having a primary-phase well pipe and a secondary-phase well pipe, in accordance with aspects of the present invention;

FIG. 8*b* illustrates a four-wire transmission line formed from well pipes, in accordance with aspects of the present invention;

FIG. 8*c* illustrates a rectangular, six-wire transmission line formed from well pipes, in accordance with aspects of the present invention;

FIG. 8*d* illustrates a square, nine-wire transmission line formed from well pipes, in accordance with aspects of the present invention;

FIG. 8*e* illustrates a five-wire transmission line formed from well pipes, in accordance with aspects of the present invention;

DETAILED DESCRIPTION

Figure 1:
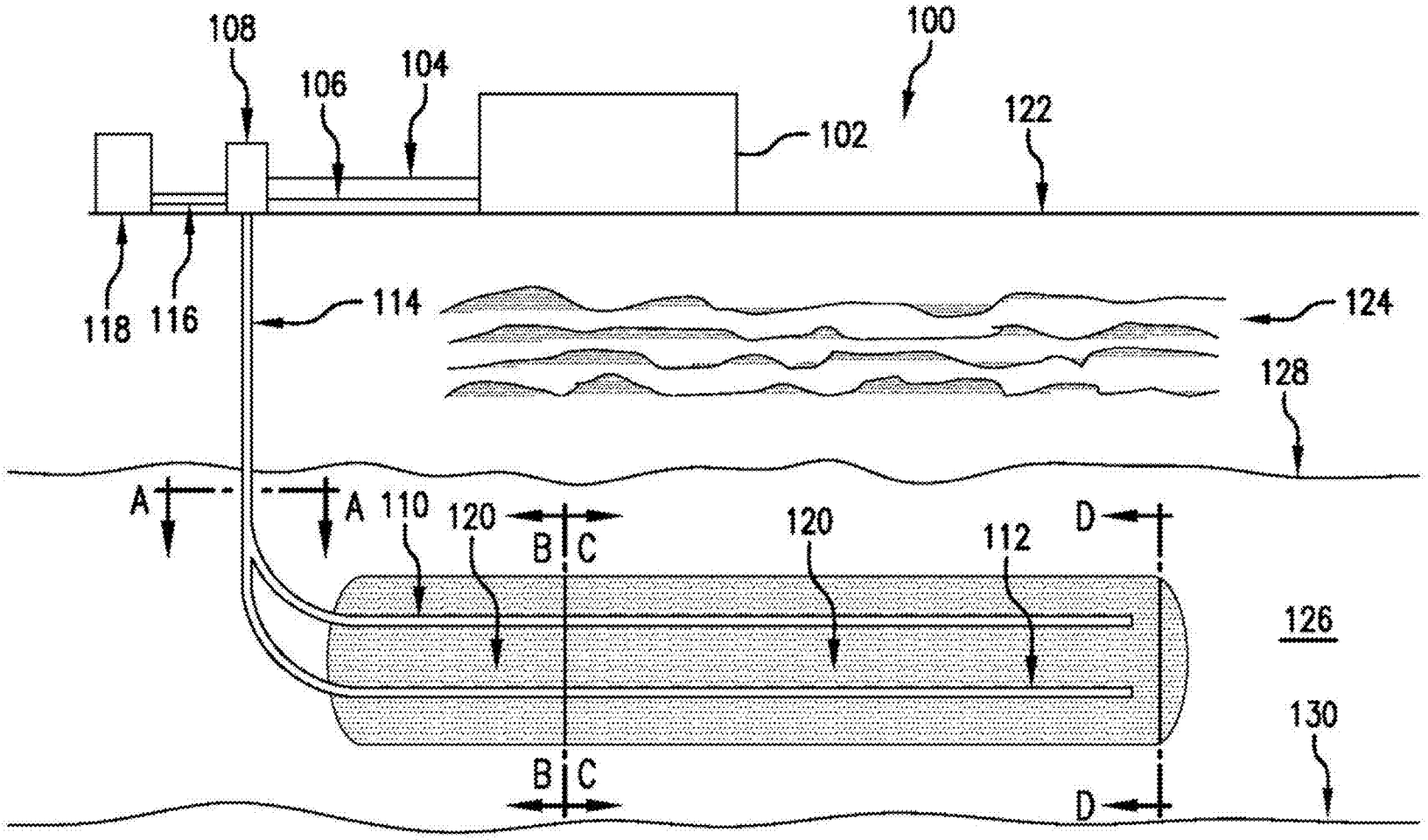
FIG. 1 illustrates an example dry fracture shale energy extraction system in accordance with aspects of the present invention.

The system and method described herein concerns the use of RF energy to enhance the extraction of oil and gas from hydrocarbon bearing strata. It uses a three-dimensional underground electromagnetic array to guide RF energy to where that energy is converted to heat in the hydrocarbon bearing strata. The three dimensional underground electromagnetic array is a guided wave structure, as opposed to an antenna structure, to minimize the unwanted effects of the near fields associated with antennas. In one realization, the legs of the three-dimensional underground electromagnetic array are composed of production well pipe.

The system and method are designed to work along, the entire extent of a horizontally drilled well bore such as are used to efficiently extract oil and gas from hydrocarbon bearing strata with large horizontal extend and smaller vertical extent. There are multiple three dimensional underground electromagnetic arrays along the length of the well bore allowing the heating of individual volumes of rock (e.g. 100,000 tons, 50,000 cubic yards).

The heat deposited in the hydrocarbon bearing strata has two effects. First it causes stresses in the hydrocarbon strata that will cause cracking and hence will increase the permeability of the strata. These stresses are caused by thermal gradients and by differential thermal expansion. The stress required to cause cracking may also be reduced by chemical changes in the hydrocarbon strata, which reduce the strength of the rock. Second the heating will cause in situ pyrolysis of the kerogen in the strata releasing additional oil and gas to be recovered.

The release of the additional oil and gas combined with additional well pipes required to form the three dimensional underground electromagnetic arrays means that more oil and gas per volume will be recovered than through any other method of enhanced oil and gas production. Further the system and method herein will not require the large amount of water that is currently used in hydraulic fracturing.

The present invention is drawn to a system and method for recovering the oil and gas in place from subsurface low permeability hydrocarbon bearing strata with minimal water usage. Further the system and method will be capable of converting the kerogen within the hydrocarbon bearing strata into additional oil and gas, which can also recovered Aspects of the present invention will now be described with reference to FIGS. 1-16.

The main aspects of the present invention are described with reference to FIGS. 1 and 2 and are applicable to all embodiments of the invention. The first embodiment of the present invention is described with reference to FIGS. 3 and 4. The second embodiment of the invention is described with references to FIGS. 5-7 and FIGS. 9-13. Additional aspects of the system, which apply to both embodiments, are described with reference to FIG. 8 and FIGS. 14-16.

The main aspects of the present invention are now described with reference to FIGS. 1 and 2.

FIG. 1 illustrates an example dry fracture shale energy extraction system 100 in accordance with aspects of the present invention.

As shown in the figure, dry fracture shale energy extraction system 100 includes a Radio Frequency (RF) generator 102, a primary-phase center conductor RF transmission line 104, a secondary-phase center conductor RF transmission line 106, a hydrocarbon lock 108, a primary-phase well pipe 110, and a secondary-phase well pipe 112. Additionally shown in the figure are a vertical well pipe 114, an oil recovery pipe 116, an oil storage tank 118, an RF heating zone 120 around first and secondary-phase well pipes 110 and 112, a surface of the earth 122, a rock overburden 124, hydrocarbon bearing strata 126, an upper boundary 128 to hydrocarbon bearing strata 126, and a lower boundary 130 to hydrocarbon bearing strata 126.

RF generator 102 is located above ground and is electrically connected to first and secondary-phase center conductor RF transmission lines 104 and 106. Primary-phase center conductor RF transmission line 104 and secondary-phase center conductor RF transmission line 106 are directed into vertical well pipe section 114 through hydrocarbon lock 108 and they run down the inside of vertical well pipe section 114. Primary-phase center conductor RF transmission line 104 continues inside of primary-phase well pipe 110. Secondary-phase center conductor RF transmission line 106 continues inside of secondary-phase well pipe 112. Primary-phase well pipe 110 is electrically coupled to secondary-phase well pipe 112. Primary-phase well pipe 110 parallel or nearly parallel to secondary-phase well pipe 112 in RF heating zone 120. Oil, produced in RF heating zone 120, flows through primary-phase well pipe 110 and secondary-phase well pipe 112 then up vertical well pipe 114. Hydrocarbon lock 108 is connected to vertical well pipe 114 and to oil recovery pipe 116. Oil recovery pipe 116 is connected to oil storage tank 118. RF generator 102, hydrocarbon lock 108, oil recovery pipe 116, oil storage tank 118, part of primary-phase center conductor RF transmission line 104, and part of secondary-phase center conductor RF transmission line 106 are located above surface of the earth 122. Hydrocarbon bearing strata 126 is located under overburden 124 and contains kerogen. Heating zone 120, located within hydrocarbon bearing strata 126 also contains oil and gas from the heating process.

RF generator 102 may be any device or system, which produces the RF signals sufficiently high in power to convert the kerogen in hydrocarbon bearing strata 126 to oil and gas within a predetermined time frame, e.g. a year. The frequency of an RF signal provided by RF generator 102 is set to optimize heating hydrocarbon bearing strata 126 and to minimize loss in primary-phase center conductor RF transmission line 104 and secondary-phase center conductor RF transmission line 106. Non-limiting examples of a frequency of an RF signal provided by RF generator 102 include those between 100 KHZ and 30 MHz. A duty cycle of the waveform of an RF signal provided by RF generator 102 may be between 10% and 100% depending on system optimization. Non-limiting examples of RF generator 102 include large vacuum tube systems or solid state systems.

Primary-phase center conductor RF transmission line 104 may be any device or system, which is a conduit for carrying the primary-phase high power RF signal. Secondary-phase center conductor RF transmission line 106 may be any device or system, which is a conduit for carrying the secondary-phase RF signal. Primary-phase center conductor RF transmission line 104 and secondary-phase center conductor RF transmission line 106 are small enough to fit within a standard 4.7 inch inner diameter well pipe and still allow sufficient space for the flow of oil and gas back up primary-phase well pipe 110 and secondary-phase well pipe 112. Primary-phase center conductor RF transmission line 104 and secondary-phase center conductor RF transmission line 106 are strong enough to withstand the vertical pipe runs and able to function in the underground temperature and pressure environment. Signal loss may be held, for example, to lower than 3 db per 5000 ft. Non-limiting examples of transmission lines include coaxial, twin lead, and shielded twin lead. For purposes of clarity 104 and 106 will be called first and secondary-phase center conductor RF transmission lines, respectively, in this disclosure.

Hydrocarbon lock 108 may be any device or system, which forms a seal through which center conductor RF transmission lines 104 and 106 are inserted into or retracted from vertical well pipe 114 without letting oil or gas escape. Hydrocarbon lock 108 also guides the oil into oil recovery pipe 116. Hydrocarbon lock 108 withstands and functions properly in the presence of oil and gas that have been heated to high temperature in RF heating zone 120. Hydrocarbon lock 108 will be described in more detail below.

In conventional oil well construction, a metal well pipe may be used in the oil producing section depending on the ability of the rock to withstand collapse. Primary-phase well pipe 110 may be any device or system, which provides structure to keep a well hole from collapsing during heating. Primary-phase well pipe 110 can be either RF transparent or segmented with alternating conductive pipes and dielectric spacers. Secondary-phase well pipe 112 may be any device or system, which provides structure to keep the well hole from collapsing during heating. Secondary-phase well pipe 112 can be either RF transparent or segmented with alternating conductive pipes and dielectric spacers. Vertical well pipe 114 may be any device or system, which forms the vertical section of the well. Vertical well pipe 114, primary-phase well pipe 110 and secondary-phase well pipe 112 are all conduits for center conductor RF transmission lines 104 and 106, and oil.

Oil recovery pipe 116 may be any device or system, which guides oil. Oil storage tank 118 may be any device or system, which stores oil. RF heating zone 120 heats hydrocarbon bearing strata 126 and coverts kerogen to oil and gas.

In operation, dry fracture shale energy extraction system 100 enhances oil and gas recovery from hydrocarbon bearing strata 126, utilizing an architecture of electromagnetic field heating, sensors and controls to heat large blocks of hydrocarbon bearing strata 126 to over 300° C., causing cracking of hydrocarbon bearing strata 126 and in situ retorting of the kerogen.

Electromagnetic energy is used to deposit heat into hydrocarbon bearing strata 126. The interaction is between the electric field and the imaginary part of the permittivity, which is the dielectric analogue to joule resistance heating (ohmic loss) in a non-perfect conductor. The relationship between power deposited and the electric field is given by.

$$P=2\pi f\varepsilon''E^2,$$

which is discussed in *Engineers' Handbook of Industrial Microwave Heating*, by Roger J. Meredith, and wherein P is the power per unit volume, f is the frequency, ε" is the complex permittivity of the material, and E is the electric field strength. The applied E field deposits energy into hydrocarbon bearing strata 126, which causes a temperature increase leading to stress, cracking, and pyrolysis of the kerogen in hydrocarbon bearing strata 126. The stress/cracking is caused both by the expansion of hydrocarbon bearing strata 126 and the expansion of the water trapped within hydrocarbon bearing strata 126. The value "ε" comes from a combination of water, rock, and kerogen within hydrocarbon bearing strata 126 with water being the biggest contributor. As the water superheats and boils off the overall permittivity will change.

Dry fracture shale energy extraction system 100 includes sets of three-dimensional underground electromagnetic arrays. FIG. 1 shows one example of a three-dimensional underground electromagnetic array formed from primary-phase well pipe 110 and secondary-phase well pipe 112. This forms a 2 row by 1 column three-dimensional underground electromagnetic array. The three-dimensional underground electromagnetic arrays are not limited to be 2 rows 1 by column. They can be n by m, where n is the number of rows and m is the number of columns. More example variations of the three-dimensional underground electromagnetic array are shown later in the disclosure.

These three-dimensional underground electromagnetic arrays are used to guide the electromagnetic fields and control their intensity over large blocks (e.g. 100,000 tons, 50,000 yds$^3$) of hydrocarbon bearing strata 126. The underground three-dimensional electromagnetic arrays include groups of multi-wire transmission lines. For example, a three-dimensional underground electromagnetic array may be constructed as a single two-wire transmission lines as shown in FIG. 1. Or these three-dimensional underground electromagnetic arrays may be constructed of a number of two-wire transmission lines. This would be a 2 by m three-dimensional underground electromagnetic array. More generally they can be an n row by m column structure as noted in the paragraph above. These three-dimensional underground electromagnetic arrays can be either static or mobile. Static three-dimensional underground electromagnetic arrays are constructed from well pipe lengths and are inserted into the well borehole in the same method as normal well pipe. Mobile three-dimensional underground electromagnetic arrays are simple large diameter wires inserted into specially designed RF transparent well pipe. The outer diameter is set by the condition that there should be sufficient space for oil and gas to flow around the wire. Both embodiments will be described in more detail later.

The RF energy, produced above ground in RF generators 102, is guided to one of the three-dimensional underground electromagnetic arrays where the energy is deposited into hydrocarbon bearing strata 126 via specially designed center conductor RF transmission lines 104, 106. RF generators 102 are within current industry standard manufacturing capability. RF generators 102 are used to convert local power into RF power. This process can be fed from green sources such as wind and solar to reduce the system carbon footprint. Each individual horizontal well pipe has its own center conductor RF transmission line 104, 106 and RF coupler, as will be described in greater detail later. Each is phase controlled to apply RF energy in the proper fashion so that guiding occurs and that heating occurs in the proper locations in hydrocarbon bearing strata 126.

The energy from RF generators 102 is fed into specialized RF center conductor transmission lines 104, 106. The specially designed center conductor RF transmission lines 104, 106 are beyond current industry practice because they are intended to be used in high temperature dirty environments, should have significant tensile strength, should carry large amounts of power, and should mate with hydrocarbon lock 108 to prevent the inadvertent escape of hydrocarbon gases and liquids. Since the wavelength of the RF energy far exceeds the diameter of the well pipe, the likely solution for guiding energy to an RF coupler is center conductor RF transmission line 104, 106, though other solutions are possible. This center conductor RF transmission line 104, 106 will be unique for multiple reasons as follows.

Center conductor RF transmission lines 104, 106 should be capable of carrying high power, 50 KW to 500 KW, at very low loss so that RF energy can be transported over long distances.

Center conductor RF transmission lines 104, 106 should be capable of functioning in a high temperature environment, approaching 600° Celsius. Special high temperature, low loss dielectrics should be used such as the Hotblox series 700 high dielectric from ATC materials.

Center conductor RF transmission lines 104, 106 should be able to function in dirty environments so several new features are needed. First a foreign material battier is required at each end of sections of center conductor RF transmission lines 104, 106. This barrier should be composed of high temp, low loss dielectric and should prevent any foreign objects or fluids from getting into center conductor RF transmission lines 104, 106. Further there will be a recessed port in the steel pipe that allows access to the volume at the connection point between center conductor RF transmission lines 104, 106 sections. This will allow sensing of the volume to ensure no foreign objects are present, and the ability to both evacuate the section and refill the section full of dry air/nitrogen.

Center conductor RF transmission lines 104, 106 should be capable of supporting their own weight over large vertical drops while supported solely from the highest vertical point. External strengthening members should not be used since the outer surface of the conductor should be smooth to prevent snagging or catching while in use. Center conductor RF transmission lines 104, 106 transmission may include steel casing, inner copper liner, and center conductor also composed of copper. The size of the outer steel cylinder would be set to allow center conductor RF transmission lines 104, 106 to support their own weight over a 5000 ft. vertical drop. The copper pipe would be attached to the inner walls of the steel pipe to ensure they both stretch equally under load. The outer diameter of the steel pipe used to strengthen the center conductor RF transmission lines 104, 106 is sized to ensure that sufficient area flu product flow up the well bore exists.

Center conductor RF transmission lines 104, 106 should minimize the blockage in the well pipe to allow product to flow freely. This means a specialized connection system with minimal flange dimensions. The outer surface is a smooth cylinder to prevent snagging or catching while inserting or withdrawing center conductor RF transmission lines 104, 106. This same cylindrical cross section allows mating with hydrocarbon lock 108 for inserting or retracting additional pieces of center conductor RF transmission lines 104, 106. One way to accomplish this is by using threaded pipe fittings instead of flange connections on center conductor RF transmission lines 104, 106. The procedures for inserting or retracting additional lengths of center conductor RF transmission lines 104, 106 should be very similar to the procedure for inserting normal well pipe production casing so it will be familiar to the well crew. The main difference will be the joint integrity check that is performed after each joint is made.

The RF energy couples into hydrocarbon bearing strata 126 by dielectrically heating any molecule that has a dipole moment. The three-dimensional underground electromagnetic array and center conductor RF transmission lines 104, 106 are coupled to each other using specially designed RF couplers, which are described in more detail in FIG. 2.

Figure 2:
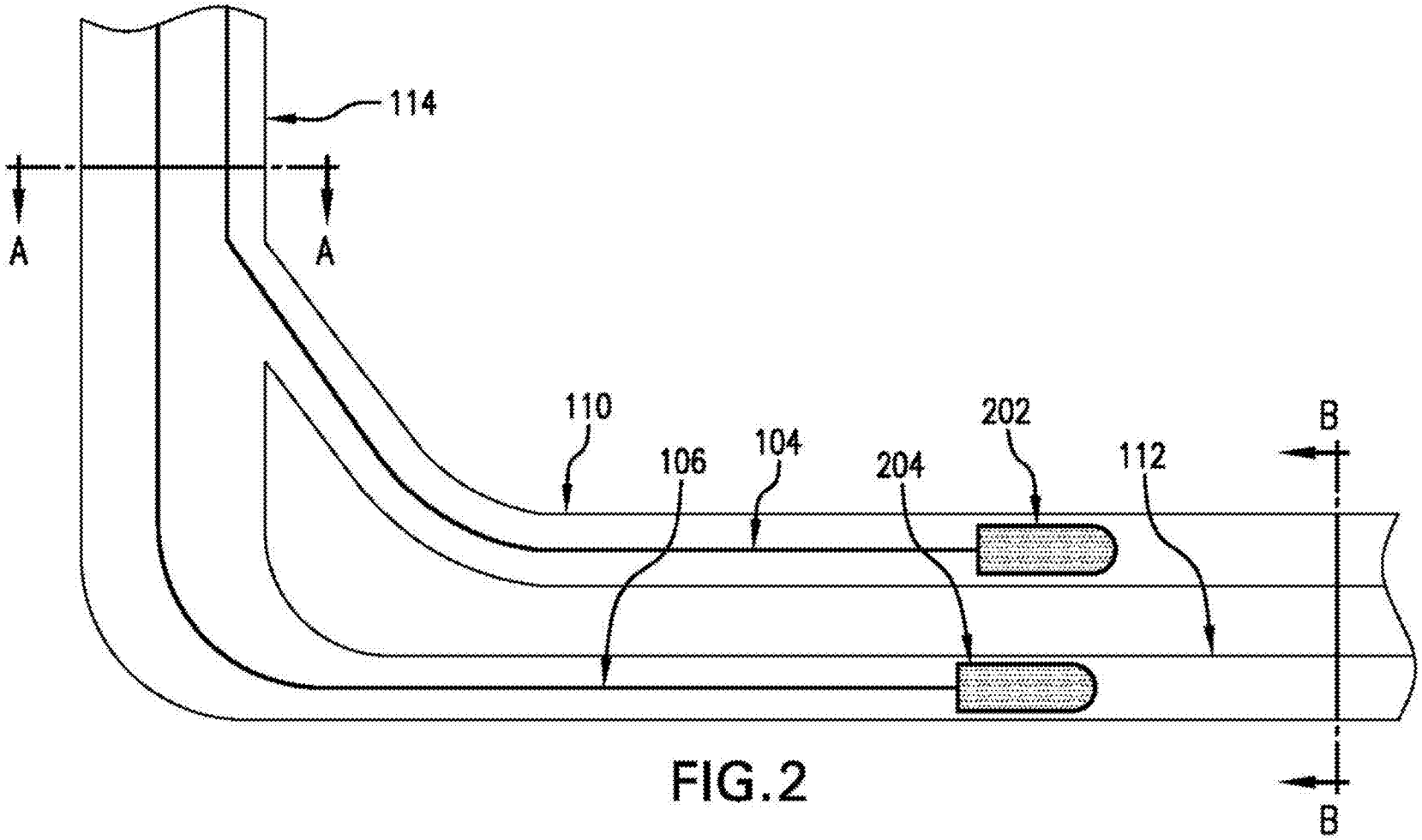
FIG. 2 illustrates a portion of the vertical well pipe and well pipes of FIG. 1 between double arrows AA and BB.

FIG. 2 illustrates a portion of vertical well pipe 114 and well pipes 110 and 112 of FIG. 1 between double arrows AA and BB.

As shown in FIG. 2, dry fracture shale energy extraction system additionally includes a primary-phase RF coupler 202 and a secondary-phase RF coupler 204.

Primary-phase RF coupler 202 is electrically connected to primary-phase center conductor RF transmission line 104. Primary-phase RF coupler 202 is disposed within primary-phase well pipe 110. Secondary-phase RF coupler 204 is electrically connected to secondary-phase center conductor RF transmission line 106. Secondary-phase RF coupler 204 is disposed within secondary-phase well pipe 112.

Primary-phase RF coupler 202 may be any device or system, which couples RF energy from primary-phase center conductor RF transmission line 104 to either primary-phase well pipe 110 or to secondary-phase coupler 204. Secondary-phase RF coupler 204 may be any device or system, which couples RF energy from secondary-phase center conductor RF transmission line 106 to secondary-phase well pipe 112 or to primary-phase coupler 202.

In operation, primary-phase RF coupler 202 and secondary-phase RF coupler 204 connect center conductor RF transmission lines 104, 106 to the three-dimensional underground electromagnetic array. RF couplers 202, 204 guide the energy from RF center conductor transmission lines 104, 106 to the three-dimensional underground electromagnetic array with low loss. All the energy going into the three-dimensional underground electromagnetic array flows through RF couplers 202, 204. There is one coupler for each line in the three-dimensional underground electromagnetic array since each line is fed by its own RF center conductor transmission line. It is critical that the couplers have low loss and low reflection coefficients so that the majority of the energy goes into the three-dimensional underground electromagnetic array and is guided to hydrocarbon bearing strata 126.

RF couplers 202, 204 contain a means to position themselves within the well bore to optimize coupling, both radially and longitudinally.

It should be noted that all embodiments of RF couplers 202, 204 will have a disconnect mechanism to allow RF coupler 202, 204 to remain in the well while center conductor RF transmission line is withdrawn to minimize damage to center conductor RF transmission line in the event RF couplers 202, 204 become stuck in the well bore.

Also when any of the embodiments of RF coupler 202, 204 are in use, there may exist conditions where oil and gas produced by the three-dimensional underground electromagnetic array may have to flow past RF coupler 202, 204 to be recovered above ground. All realizations of RF coupler 202, 204 include slots or other means to allow movement of oil and gas past the coupler and through the well bore.

RF couplers 202, 204 include one of many possible realizations, four of which are described herein. The described embodiments are the inductive, capacitive, direct, and three-dimensional underground electromagnetic array leg depending on dry fracture shale energy extraction system 100 embodiment and down-hole conditions. When RF couplers are being described in general, then the number designators 202, 204 will be used. Specific embodiments of the couplers will have their own number designators. These realizations will be discussed later in the disclosure.

Returning to FIG. 1, the temperature induced effects on bearing strata 126 are described in more detail.

As the temperature in hydrocarbon bearing strata 126 rises, three very important effects occur. First stresses are produced within hydrocarbon bearing strata 126. These stresses are caused by thermal gradients within hydrocarbon bearing strata 126, and by the differential relative thermal expansion. As hydrocarbon bearing strata 126 heats, the amount of stress increases. The expansion of hot hydrocarbon bearing strata 126 is being resisted by the colder surrounding strata putting large volumes of hydrocarbon bearing strata 126 into tension and large volumes into compression. In regions of tension, when the stresses exceed the combined fracture strength of the material and the surrounding hydrostatic pressure cracks will form. In regions of compression, cracks form based on the criteria in the well-known Griffith theory for brittle fracture. This criteria is exceeded in the compression region. Entrapped water is also expanding due to the heating process and will enhance the cracking process.

Three-dimensional finite element computer analysis has shown that dry fracture shale energy extraction system 100 will create fracture stress distributed throughout the volume in region near the wave guiding system, both nisi e and outside of the guiding structure. Due to the amount of and distribution of stress predicted, dry fracture shale energy extraction system 100 is predicted to create a dense crack field within hydrocarbon bearing strata 126.

The result of this cracking is an increase in the liquid and gas permeability of hydrocarbon bearing strata 126 allowing the flow of oil and gas to the well pipe. Dry fracture shale energy extraction system 100 will provide precise control of stress conditions to maximize cracking and will allow the release of oil & gas from large pay zones over long periods of time with low life-cycle operating costs and a low greenhouse-gas footprint.

Second, hydrocarbon bearing strata 126 goes through an irreversible phase change, which results in a loss of material strength. This adds to the amount of cracking and further increases the liquid and gas permeability of hydrocarbon bearing strata 126.

Third, the kerogen contained within hydrocarbon bearing strata 126 goes through in situ pyrolysis and produces high quality oil and gas. The amount of oil and gas produced is a function of the type and amount of kerogen present in hydrocarbon bearing strata 126. Because of the permeability increase discussed above, the oil and gas produced is able to flow to well pipes 110, 112 and be retrieved at surface of the earth 122.

The heating occurs over broad volumes of material. Pyrolysis coke build up and subsequent clogging around the three-dimensional underground electromagnetic array will not occur since the pyrolysis occurs uniformly throughout hydrocarbon bearing strata 126 depending on the amount of kerogen at any particular location. A second coke issue is the increased conductivity that occurs if the char is heated to high enough temperature. If the coke becomes more lossy than the other materials in hydrocarbon bearing strata 126, the coke will be preferentially heated by the electric fields. Since the highest temperatures will occur with the highest fields, this means the effect will be greatest close to the well pipes. This can cause the heating profile to appear more like local resistive heating than distributed field heating. To prevent this local heating effect, the process will be monitored and carefully controlled to ensure temperatures never reach the levels where the coke becomes conductive enough to affect the process.

Dry fracture shale energy extraction system 100 can also be used to enhance the production of wells in heavy oil and oil sands with slight modifications to prevent pyrolysis char from clogging; the product access to the well pipe.

Many embodiments of dry fracture energy extraction system 100 are possible. Two are described next.

In the first embodiment of the present invention, specialized well pipes are used, which are RF transparent while still providing the required strength to stabilize the well bore. These are discussed in more detail FIGS. 3 and 4.

Figure 3A:
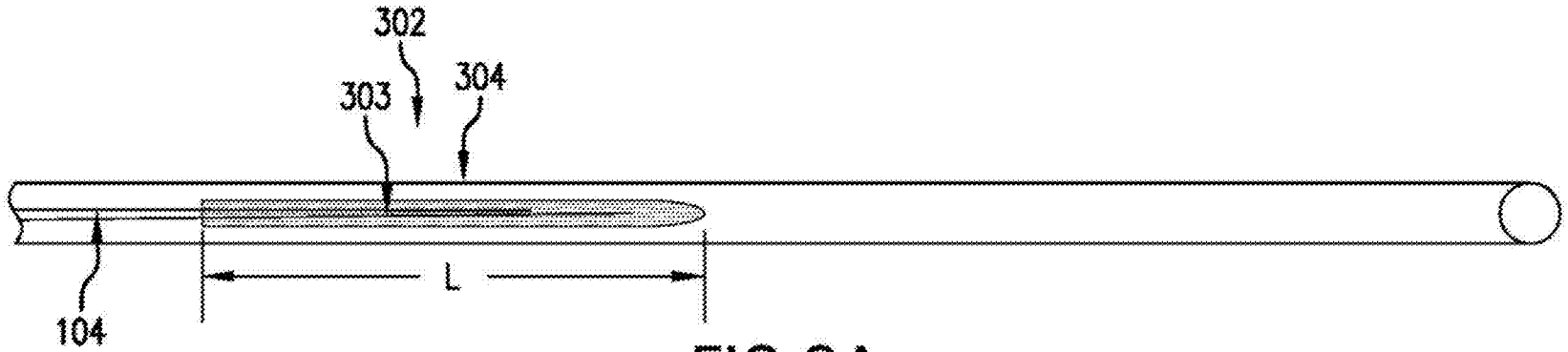
FIG. 3*a* illustrates a position of a primary-phase RF transparent well pipe coupler within a primary-phase RF transparent well pipe at time $t_1$.
Figure 3B:
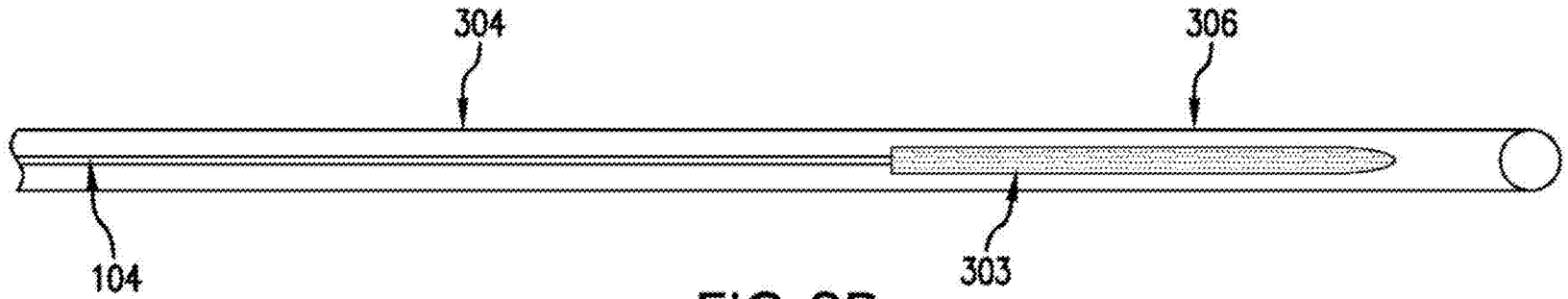
FIG. 3*b* illustrates a position of the primary-phase RF transparent well pipe coupler within the primary-phase RF transparent well pipe at time $t_2$.

FIGS. 3*a-b* illustrate the movement of RF couplers 303, 412 within the RF transparent well pipe.

FIG. 3*a* illustrates position 302 of primary-phase RF transparent well pipe coupler 303 within a primary-phase RF transparent well pipe 304 at time $t_1$. It also shows the length L of primary-phase RF transparent well pipe coupler 303.

Primary-phase RF transparent well pipe coupler 303 is connected to primary-phase center conductor RF transmission line 104. It is also electrically connected to secondary-phase RF transparent well pipe coupler 412 shown in FIG. 4. Primary-phase RF transparent well pipe 304 is connected to vertical well pipe 114.

Primary-phase RF transparent well pipe coupler 303 may be any device or system, which acts as one leg of a two-wire transmission line, wherein center conductor RF transmission line 104 is able to transmit an RF signal having a primary phase as a function of time. Primary-phase RF transparent well pipe 304 may be any device or system, which allows the RF energy to pass unimpeded from primary-phase RF transparent well pipe coupler 303 into hydrocarbon bearing strata 126.

FIG. 3*b* illustrates position 306 of primary-phase RF transparent well pipe coupler 303 within primary-phase RF transparent well pipe 304 at time $t_2$.

In operation the couplers themselves form the legs of the three-dimensional underground electromagnetic array. The three-dimensional underground electromagnetic array is moved from position 302 at time $t_1$ to position 306 at time $t_2$ by simply moving the location of all the couplers from location 302 at time $t_1$ to location 306 at time $t_2$.

The length L of primary-phase RF transparent well pipe coupler 303 will be set based on optimizing the system for a certain amount of oil and gas output as a function of time. The optimization parameters include the electrical properties of hydrocarbon bearing strata 126, the amount of hydrocarbon bearings strata 126 desired to be heated, the desired final temperature, the time period allotted for heating, and the amount of RF power available.

The relative placement of primary-phase RF transparent well pipe coupler 303 and secondary-phase RF coupler 412 within the RF transparent well pipes will be further described with reference to FIG. 4.

Figure 4:
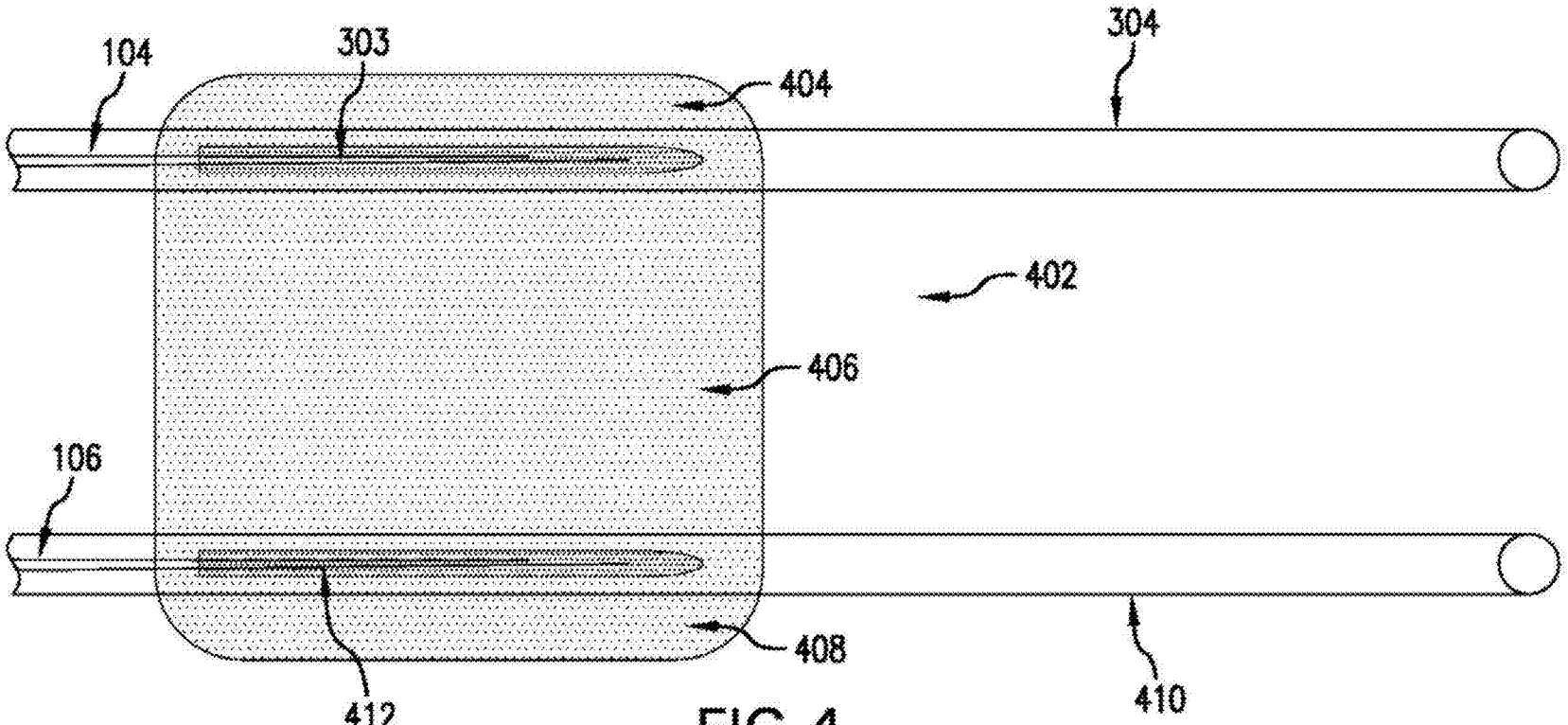
FIG. 4 illustrates a primary-phase RF transparent well pipe, a secondary-phase RF transparent well pipe, and a heating zone around the primary-phase RF transparent well pipe coupler and a secondary-phase RF transparent well pipe coupler at time $t_1$.

FIG. 4 illustrate's primary-phase RF transparent well pipe 304, a secondary-phase RF transparent well pipe 410, and a heating zone 402 around primary-phase RF transparent well pipe coupler 303 and secondary-phase RF transparent well pipe coupler 412 at time $t_1$.

As shown in the figure, overall heating zone 402 includes an upper heating zone 404, a middle heating zone 406 and a lower heating zone 408. Additionally shown is a secondary-phase RF transparent well pipe 410 secondary-phase RF transparent well pipe coupler 412.

RF heating zones 404, 406 and 408, form contiguous heating: zone 402 surrounding RF transparent well pipes 410 and 304. Primary-phase RF transparent well pipe coupler 303 is disposed within primary-phase RF transparent well pipe 304. Secondary-phase RF transparent well pipe coupler 412 is disposed within secondary-phase RF transparent well pipe 410. RF couplers 303 and 412 are electrically connected via the electromagnetic fields.

Primary-phase RF transparent well pipe coupler 303 and secondary-phase RF coupler 412 are acting as the two-wires of a twin wire transmission line in a lossy media, hydrocarbon bearing strata 126. RF heating zone 402 is being heated by the fields generated around primary-phase RF transparent well pipe coupler 303 and secondary-phase RF transparent well pipe coupler 412. RF transparent well pipe 410 may be any device or system, which allows unimpeded flow of RF energy from secondary-phase RF transparent well pipe coupler 412 into hydrocarbon bearing strata 126, wherein center conductor RF transmission line 106 is able to transmit an RF signal having a secondary phase as a function of time, and wherein the primary-phase is 180° out of phase with respect to the secondary-phase.

In operation, RF transparent well pipe couplers themselves 303, 412 form the legs of a twin wire transmission line and hence two of the lees of the three-dimensional underground electromagnetic array. They can be placed anywhere along the underground set of RI transparent well pipes to heat hydrocarbon bearing strata 126. The position, of the three-dimensional underground electromagnetic array is changed by either adding or removing sections of center conductor RI transmission lines 104, 106. This allows precise placement of the three-dimensional underground electromagnetic array within hydrocarbon bearing strata 126 and hence precise control of the heating process. RF transparent well pipe couplers 303, 412 have small enough diameters to allow oil and gas from previously heated sections of hydrocarbon bearing strata 126 to pass by RF transparent well pipe couplers 303, 412 and rise to surface of the earth 122 for recovery. While not specifically required for this design, it is likely that all RF transparent well pipe couplers 303, 412 will have the same length L.

The three-dimensional underground electromagnetic array is built around a set of parallel well holes. This means RF transparent well pipe couplers 303, 412 will be parallel to each other. The most likely configuration will be that RF transparent well pipe couplers 303, 412 are both located at the same horizontal section of the well pipe. However the exact offset, if any will be based on optimization during the heating process.

Figure 5A:
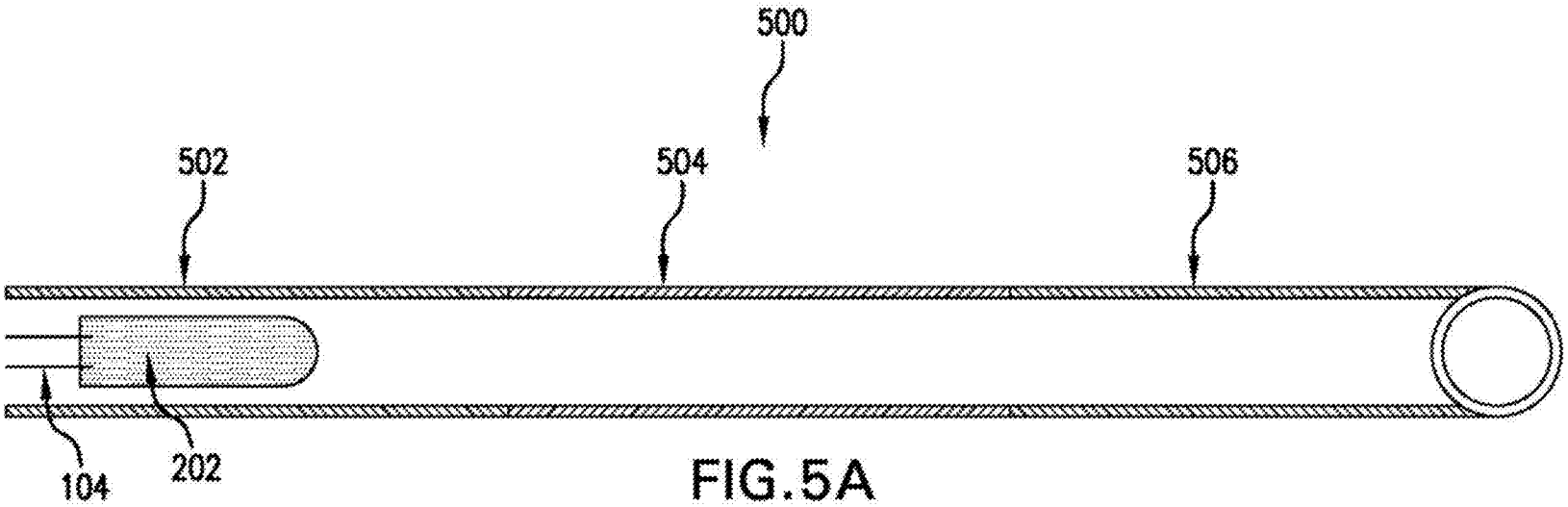
FIG. 5*a* illustrates a primary-phase RF coupler placement within a primary-phase segmented well pipe at time $t_3$, in accordance with aspects of the present invention.
Figure 5B:
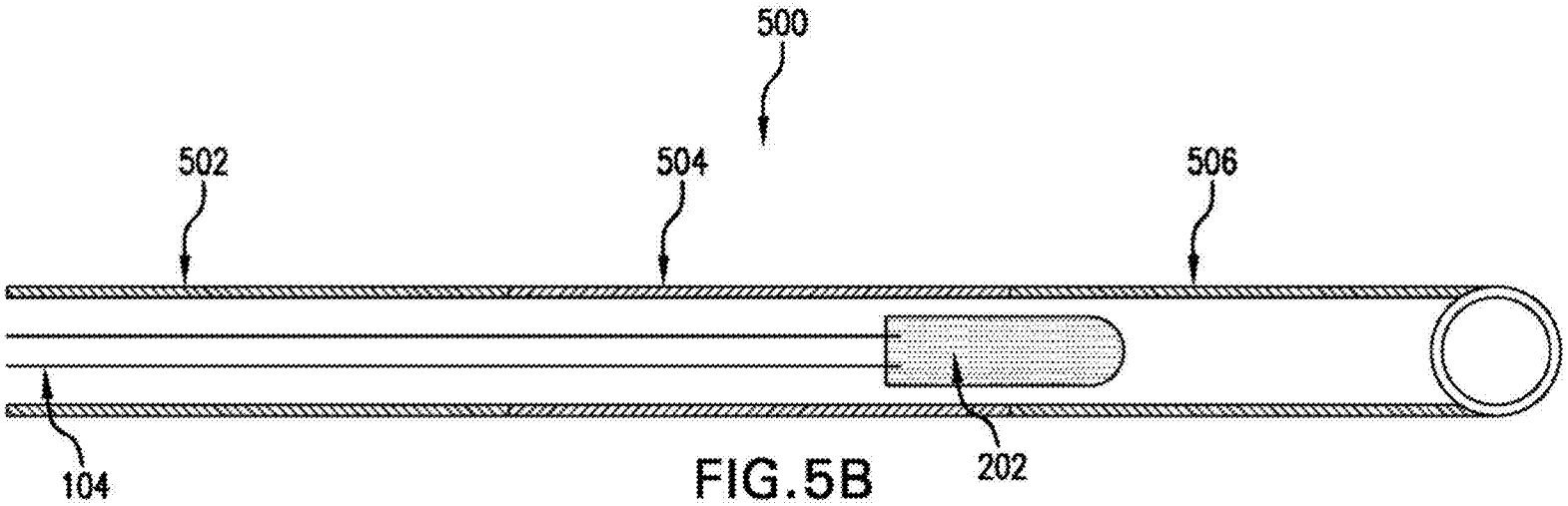
FIG. 5*b* illustrates another location for the primary-phase RF coupler placement within primary-phase segmented well pipe at time $t_4$, in accordance with aspects of the present invention.
Figure 6:
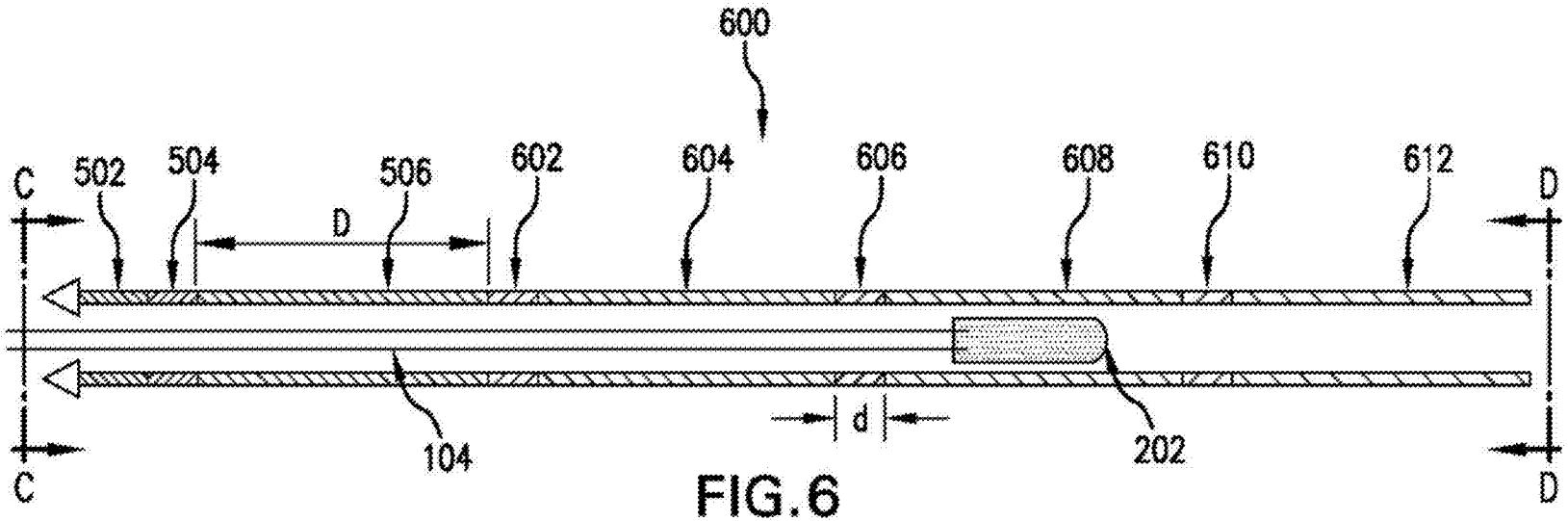
FIG. 6 illustrates a primary-phase segmented well pipe section between double arrows CC and DD of FIG. 1, in accordance with aspects of the present invention.
Figure 7:
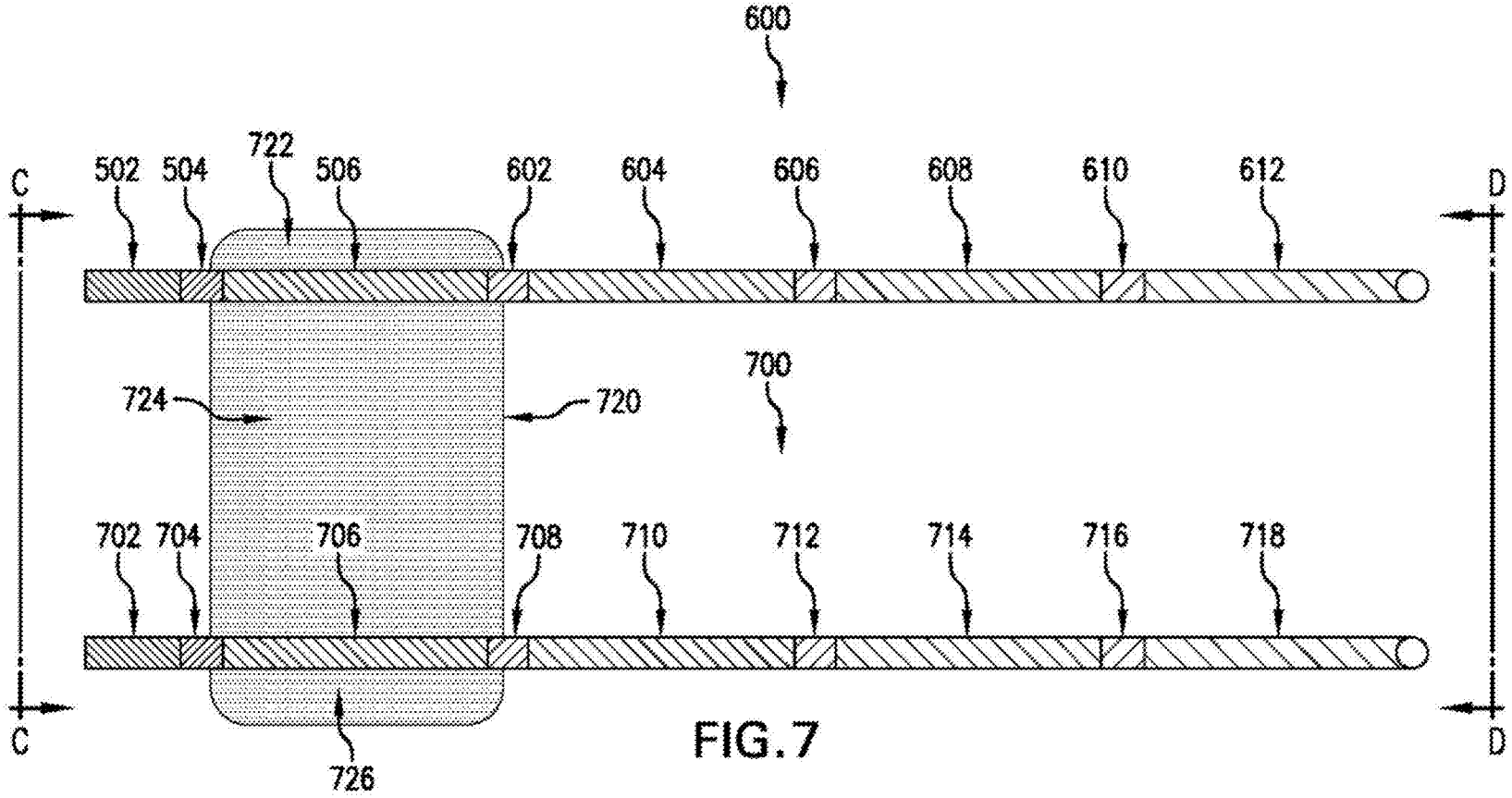
FIG. 7 illustrates both primary-phase segmented well pipe section 600 and secondary-phase segmented well pipe section 700 between double arrows CC and DD of FIG. 1, in accordance with aspects of the present invention.

The second embodiment of the invention is now described with references to FIGS. 5-7. In this embodiment the well pipe itself is used as the wires of a two-wire transmission line. Multiple two-wire transmission lines form a three-dimensional underground electromagnetic array. For clarity, the disclosure primarily discusses groups of two-wire transmission lines as the basic building block of the three-dimensional underground electromagnetic arrays. However other multiwire transmission lines, for example the five wire transmission, will work also.

The well pipe is divided into longitudinal sections by non-conducting spacers hence forming a set of three-dimensional underground electromagnetic arrays along the horizontal length of the well bore. Unlike the previous embodiment this set of three-dimensional underground electromagnetic arrays are located at fixed positions along the horizontal length of the well pipes.

FIGS. 5*a* and 5*b* illustrate the movement of RF couplers 202, 204 within the segmented well pipe.

FIG. 5*a* illustrates primary-phase RF coupler 202 placement within a primary-phase segmented well pipe 500 at time $t_3$, in accordance with aspects of the present invention.

As shown in the figure, primary-phase segmented well pipe 500 includes a conductive segment 502, a dielectric spacer 504 and a conductive segment 506.

Conductive segment 502 is connected to one end of dielectric spacer 504. The other end of dielectric spacer 504 is connected to conductive segment 506. Primary-phase RF coupler 202 is electrically connected to conductive segment 502. Non limiting examples of such a connection are inductive, capacitive, and direct connections.

Primary-phase RF coupler 202 conducts RF energy into conductive segment 502. Conductive segment 502 may be any device or system, which acts as the primary-phase wire for a two-wire transmission line. Dielectric spacer 504 may be any device or system, which electrically disconnects conductive segment 502 from conductive segment 506. Conductive segment 506 may be any device or system, which will be activated as the primary-phase wire for a two-wire transmission line at a different time in the heating process.

FIG. 5*b* illustrates another location for primary-phase RF coupler 202 placement within primary-phase segmented well pipe 500 at time $t_4$, in accordance with aspects of the present invention.

As shown in the figure, RF coupler 202 is now located within conductive segment 506.

In operation, RF energy is transmitted down primary-phase center conductor RF transmission line 104. Primary-phase RF coupler 202 receives the energy and forms a match between primary-phase center conductor RF transmission line 104 and the outside of conductive segment 502 at time $t_1$ and the outside of conductive segment 506 at time $t_2$. This allows the RF energy to be coupled to different conductive segments along the horizontal section of the well at different times. Matching is required to maximize the power delivered to hydrocarbon strata 126 and minimize the reflected signal. The matching will also serve to minimize evanescent fields and ensure that heating occurs at the desired portion of hydrocarbon bearing strata 126.

Typically one three-dimensional underground electromagnetic array is energized at a time. The three-dimensional underground electromagnetic array is energized by locating RF couplers 202, 204 at the location where dielectric spacers (e.g. 504) connect to conductive segments (e.g. 506) for all legs of the three-dimensional underground electromagnetic array that are at the same horizontal position along the well bore.

A segmented well pipe of the second embodiment of the present invention may be composed of alternating sections of conductive well pipe and dielectric spacers. This will be further described with reference to FIG. 6.

FIG. 6 illustrates a primary-phase segmented well pipe section 600 between double arrows CC and DD FIG. 1 in accordance with aspects of the present invention.

As shown in FIG. 6, segmented well pipe section 600 includes conductive segment 502, conductive segment 506, a conductive segment 604, a conductive segment 608, a conductive segment 612, dielectric spacer 504, a dielectric spacer 602, a dielectric spacer 606, and a dielectric spacer 610. Also shown in the figure are conductive well pipe segment length D, and dielectric spacer length d.

Conductive segment 502 is connected to dielectric spacer 504. Dielectric spacer 504 is connected between conductive segment 502 and conductive segment 506. Conductive segment 506 is connected between dielectric spacer 504 and dielectric spacer 602. Dielectric spacer 602 is connected between conductive segment 506 and conductive segment 604. Conductive segment 604 is connected, between dielectric spacer 602 and dielectric spacer 606. Dielectric spacer 606 is connected between conductive segment 604 and conductive segment 608. Conductive segment 608 is connected between dielectric spacer 606 and dielectric spacer 610. Dielectric spacer 610 is connected between conductive segment 608 and conductive segment 612. Conductive segment 612 is connected to dielectric spacer 610. Primary-phase RF coupler 202 is electrically connected to conductive segment 608.

Conductive segment 604 may be any device or system, which acts as the primary-phase wire for a two-wire transmission line but is not activated in the figure Conductive segment 608 may be any device or system, which acts as the primary-phase wire for a two-wire transmission line. It is activated by an electrical connection with primary-phase RF coupler 202. Conductive segment 612 may be any device or system, which acts as the primary-phase wire for a two-wire transmission line but is not activated in the figure. Dielectric spacer 602 may be any device or system, which electrically disconnects conductive segment 506 from conductive segment 604. Dielectric spacer 606 may be any device or system, which electrically disconnects conductive segment 604 from conductive segment 608. Dielectric spacer 610 may be any device or system, which electrically disconnects conductive segment 608 from conductive segment 612.

In operation, conductive segments as disclosed herein are energized at particular times in the heating process. They may be energized sequentially along the horizontal well bore or not depending on how the heating is managed and optimized along the well bore.

The length D of conductive segments, as disclosed herein, will be set based on optimizing the system for a certain amount of oil and gas output as a function of time. The optimization parameters include the electrical properties of hydrocarbon bearing strata 126, the amount of hydrocarbon bearing strata 126 desired to be heated, the desired final temperature, the time period allotted for heating, and the amount of RF power available. Length D can also be variable along the length of the well bore although all segments at a given horizontal position will likely have the same length.

Dielectric spacers, as described herein, will be used to electrically separate conductive segments, as described herein, from each other.

Dielectric spacers, as described herein, can also provide windows for RF penetration through the steel well pipe production casing.

Dielectric spacers, as described herein, are short, high temperature, high strength pipes with controllable electrical properties that will vary as a function of radial and longitudinal location in the dielectric spacers. Dielectric spacers will thread directly onto conductive segments, as described herein, so that the process for inserting production casing into the wells is not changed.

Dielectric spacers, as described herein, can also provide the RF coupling technology depending on the type of coupling used. In the direct coupling, capacitive coupling, and inductive coupling realizations of RF couplers 202, 204 there will need to be mating surfaces in the dielectric spacer. In all coupling cases there may be conductive structures inside dielectric spacer to facilitate the coupling of the RF energy to the outside of well pipe segments (e.g. 502, 506).

Dielectric spacers, as described herein, need to have sufficient tensile strength to support steel well pipe of a length equal to the entire vertical section of the well. Dielectric spacers will only be needed in the horizontal section of the well for operation of the system so after insertion the spacers will no longer be subject to large tensile loads. After the well pipe is in place, dielectric spacers will be subject to high temperatures (up to 600° Celsius) and should maintain a large portion of their strength to prevent well collapse.

The length d of the dielectric spacers, as described herein, is based an achieving the desired electrical separation between adjacent three-dimensional underground electromagnetic arrays.

The relative placement of primary-phase RF coupler 202 and secondary-phase RF coupler 204 within primary-phase and secondary-phase segmented well pipes will now be described with reference to FIG. 7.

FIG. 7 illustrates both primary-phase segmented well pipe section 600 and secondary-phase segmented well pipe section 700 between double arrows CC and DD in FIG. 1, in accordance with aspects of the present invention.

As shown in FIG. 7, secondary-phase segmented well pipe section 700 includes a conductive segment 702, a conductive segment 706, a conductive segment 710, a conductive segment 714, a conductive segment 718, a dielectric spacer 704, a dielectric spacer 708, a dielectric spacer 712, and a dielectric spacer 716. Also shown are segmented well pipe section 600 and heating zone 720.

Conductive segment 702 is connected to dielectric spacer 704. Dielectric spacer 704 is connected between conductive segment 702 and conductive segment 706. Conductive segment 706 is connected between dielectric spacer 704 and dielectric spacer 708. Dielectric spacer 708 is connected between conductive segment 706 and conductive segment 710. Conductive segment 710 is connected between dielectric spacer 708 and dielectric spacer 712. Dielectric spacer 712 is connected between conductive segment 710 and conductive segment 714. Conductive segment 714 is connected between dielectric spacer 712 and dielectric spacer 716. Dielectric spacer 716 is connected between conductive segment 714 and conductive segment 718. Conductive segment 718 is connected to dielectric spacer 716. Primary-phase conductive segment 506 is electrically connected to secondary-phase conductive segment 706.

Segmented well pipe section 600 is parallel or nearly parallel with segmented well pipe section 700 throughout the heated volume in hydrocarbon bearing, strata 126.

RF heating zones 722, 724 and 726, form contiguous heating zone 720 surrounding conductive segment 506 in primary-phase segmented well pipe 600 and conductive segment 706 in secondary-phase segmented well pipe 700.

Conductive segment 702 may be any device or system, which acts as the secondary-phase wire for a two-wire transmission line but is not activated in the figure. Conductive segment 706 may be any device or system, which acts as the secondary-phase wire for a two-wire transmission line. It is activated by an electrical connection with secondary-Phase RF coupler 204. Conductive segment 710 may be any device or system, which acts as the secondary-phase wire for a two-wire transmission line but is not activated in the figure. Conductive segment 714 may be any device or system, which acts as the secondary-phase wire for a two-wire transmission line but is not activated in the figure. Conductive segment 718 may be any device or system, which acts as the secondary-phase wire for a two-wire transmission line but is not activated in the figure.

Dielectric spacer 704 may be any device or system, which electrically disconnects conductive segment 702 from conductive segment 706. Dielectric spacer 708 may be any device or system, which electrically disconnects conductive segment 706 from conductive segment 710. Dielectric spacer 712 may be any device or system, which electrically disconnects conductive segment 710 from conductive segment 714. Dielectric spacer 716 may be any device or system, which electrically disconnects conductive segment 714 from conductive segment 718.

Heating zone 720 converts kerogen in hydrocarbon bearing strata 126 to oil and gas.

In operation, groups of horizontal production casings at a particular horizontal location make up the three-dimensional underground electromagnetic arrays. These three dimensional underground electromagnetic arrays are separated from each other along the horizontal extent of hydrocarbon bearing strata 126 by dielectric spacers (e.g. 504) placed in each individual well bore. The three-dimensional underground electromagnetic arrays are used to guide RF energy to the desired locations in hydrocarbon bearing strata 126. RF couplers 202, 204 are movable along the well bore and will be used to energize different three-dimensional underground electromagnetic arrays (groups of lateral well segments) at different times. Both RF couplers 202, 204 and dielectric spacers (e.g. 504) are new and designed specifically for dry fracture shale energy extraction system 100.

Returning to FIG. 1, production casing is inserted after well drilling is complete. As the casing is being inserted, dielectric spacers (e.g. 504) are attached between casings every XX casings. The number XX of casings is determined based on the electromagnetic properties of hydrocarbon bearing strata 126 being heated, the amount of hydrocarbon bearing strata 126 to be heated, the desired final temperature, the time period allotted for heating, the frequency of operation, and the RF power available, and can be anywhere from between every 20 casings to every casing. As an example, for a 5000 ft horizontal run with the production casings separated by dielectric spacers every 300 ft, there will be approximately 16 three-dimensional underground electromagnetic arrays.

This process can also work with preexisting well casing by cutting out segments of the well casing to get electrical isolation. These cuts are made at specific points along the horizontal extent of the well field based on the on the electromagnetic properties of hydrocarbon bearing strata 126 being heated, the frequency of operation, and the RF power available.

The actual three-dimensional underground electromagnetic array configuration can take many forms depending on the electromagnetic properties of hydrocarbon bearing strata 126 being heated, the amount of hydrocarbon bearing strata 126 to be heated, the desired final temperature, the time period allotted for heating, the frequency of operation, and the RF power available. Possible three-dimensional underground electromagnetic array configurations are discussed in more detail for FIG. 8.

FIGS. 8*a-e* illustrate several examples of the many possible well pipe geometric configurations in accordance with aspects of the present invention. They show end on views of the three-dimensional underground electromagnetic array; the well pipes are oriented perpendicular to the page.

As shown in FIG. 8*a* a two-wire transmission line 800 includes primary-phase well pipe 110 and secondary-phase well pipe 112, in accordance with aspects of the present invention.

Primary-phase transmission line conductor associated with primary-phase well pipe 110 is electrically coupled to secondary-phase transmission line conductor associated with secondary-phase well pipe 112. Primary-phase well pipe 110 is parallel or nearly parallel to secondary-phase well pipe 112 throughout the heated volume in hydrocarbon bearing strata 126.

As shown in FIG. 8*b*, a four-wire transmission line 802 is formed from well pipes, in accordance with aspects of the present invention.

All the transmission line conductors associated with well pipes in the figure are electrically coupled to each other. All the well pipes are parallel or nearly parallel throughout the heated volume in hydrocarbon bearing strata 126.

Each of the wires in the figure is either a primary-phase or secondary-phase conductor of the transmission line.

As shown in FIG. 8*c*, a rectangular, six-wire transmission line 804 is formed from well pipes, in accordance with aspects of the present invention.

All the transmission line conductors associated with well pipes in the figure are electrically coupled to each other. All the well pipes are parallel or nearly parallel throughout the heated volume in hydrocarbon bearing strata 126.

Each of the wires in the figure is either a primary-phase or secondary-phase conductor of the transmission line.

As shown in FIG. 8*d*, a square, nine-wire transmission line 806 is formed from well pipes, in accordance with aspects of the present invention.

All the transmission line conductors associated with well pipes in the figure are electrically coupled to each other. All the well pipes are parallel or nearly parallel throughout the heated volume in hydrocarbon bearing strata 126.

Each of the wires in the figure is either a primary-phase or secondary-phase conductor of the transmission line.

As shown in FIG. 8*e*, a five-wire transmission 808 is formed from well pipes, in accordance with aspects of the present invention.

All the transmission line conductors associated with well pipes in the figure are electrically coupled to each other. All the well pipes are parallel or nearly parallel throughout the heated volume in hydrocarbon bearing strata 126.

Each of the wires in the figure is either a primary-phase or secondary-phase conductor of the transmission line.

The number, spacing, and geometry of the wells, is determined in advance to be the most economically favorable geometry based on the desired black size to heat, the dimensions of hydrocarbon bearing strata 126, the electrical, mechanical, and thermal properties of the strata, and the desired output of oil and gas from the system. The wells are drilled at prescribed distances from each other and the floor of hydrocarbon bearing strata 126. The wells will likely be oriented, parallel to the bedding planes in hydrocarbon bearing strata 126 and so can vary from horizontal to many degrees from horizontal.

Returning to FIG. 1, a brief description of the heating process will be provided. A longer version of the description is provided following FIG. 15. The heating process is optimized based on the particular electrical, mechanical and chemical properties of hydrocarbon strata 126 to be heated. No two hydrocarbon strata 126 are identical so a different process will be developed and optimized for the each strata in which the system is to work. An example process is given next.

The example process starts by connecting RF couplers 202, 204 to the three-dimensional underground electromagnetic array closest to vertical well pipe section 114. This particular three-dimensional underground electromagnetic array is energized for a period of 1 to 15 months depending on the volume of hydrocarbon bearing strata 126 associated with the three-dimensional underground electromagnetic array, the amount of RF power available, the frequency of the RF power and the loss tangent of hydrocarbon bearing strata 126. During this rime hydrocarbon bearing strata 126 is retorted, stressed, and cracked. The gas and oil preexisting within hydrocarbon bearing straw 126, plus the additional oil and gas from retorting, flow through the new cracks in hydrocarbon bearing strata 126 and up the well pipes for recovery.

When hydrocarbon bearing strata 126 reaches an average temperature of approximately 350° Celsius, in situ retorting will be complete and RF couplers 202, 204 are moved to the next three-dimensional underground electromagnetic array in the series. While the second volume of hydrocarbon bearing strata 126 is heating up, the first three dimensional underground electromagnetic array volume continues to produce. It may be necessary to re-energize the first three-dimensional underground electromagnetic array to reopen cracks and produce new cracks as hydrocarbon bearing strata 126 cools.

The location of RF couplers 202, 204 within the well pipe is adjusted by adding or removing sections of center conductor RF transmission fines 104, 106. This connection is made above ground level in the same manner as well pipe casings are attached to a well string. Each piece of additional section of center conductor RF transmission lines 104, 106 is attached with threads to the one already partially inserted into the well. The entire center conductor RF transmission line string is then lowered further into the well until it reaches the point where the next piece of center conductor RF transmission line can be attached. Retracting RF couplers 202, 204 is the reverse of this process.

A major difference between dry fracture shale energy extraction system 100 and all the other mechanisms described is that dry fracture shale energy extraction system 100 is designed around a series of three-dimensional underground electromagnetic arrays that are energized in a specific fashion. This method of heating causes cracks in the desired location with the desired orientation, causes efficient in situ conversion of kerogen to high quality oils and gas, and results in the production a consistent flow of product for many years.

A comparison to hydraulic fracturing is given next. Hydraulic fracturing, or fracking, is used to access the oil gas that has already been produced over millions of years by the natural start of the pyrolysis process. The amount of retrieval is typically less than 10%. Dry fracture shale energy extraction system 100 will return a larger amount of product per unit volume of hydrocarbon bearing strata 126 than hydraulic fracturing for two reasons. Firstly, it will return both the gas and oil already present and the produced oil and gas formed from pyrolysis of the kerogen in hydrocarbon bearing strata 126. The produced oil and gas is not present for the fracking process to remove. Secondly, the drainage volume each well pipe accesses is much smaller for dry fracture shale energy extraction system 100 than for fracking. This means better drainage for a smaller volume. Better oil and gas drainage will allow a higher percentage of overall product retrieval, likely greater than 50%.

The well pads for dry fracture shale energy extraction system 100 will be prepared in the same manner as typical well pads with a couple of exceptions. There will be an RF generator hut, which protects RF generators such as RF generator 102 and associated control circuitry. A specialized structure will be required for inserting or retracting center conductor RF transmission lines 104, 106 down the well bore. This structure will closely resemble existing site hardware that is used for inserting or retracting small diameter well pipe.

The oil and gas will be at elevated temperatures, up to 350° Celsius, when they arrive at surface of the earth 122. An air based chiller will be used to cool the product prior to shipping the product to the refinery.

As described above, RF couplers 202, 204 for the segmented conductive well pipe embodiment form the junction between center conductor RF transmission lines 104, 106 and conductive segments of well pipe (e.g. 502, 506), and are described in more detail in FIGS. 9-13.

FIGS. 9-13 illustrate non-limiting example coupling arrangements (direct, inductive, and capacitive) to conduct the RF energy from center conductor RF transmission lines 104, 106 on to the first and secondary-phase segmented well pipe sections 600 and 700 as an example of what could be used in the second embodiment of the present invention.

An example direct connection scheme for guiding the RF energy onto the outside of conductive segments (e.g. 502, 506) of the segmented well pipe sections 600, 700 will now be described with reference to FIG. 9.

Figure 9:
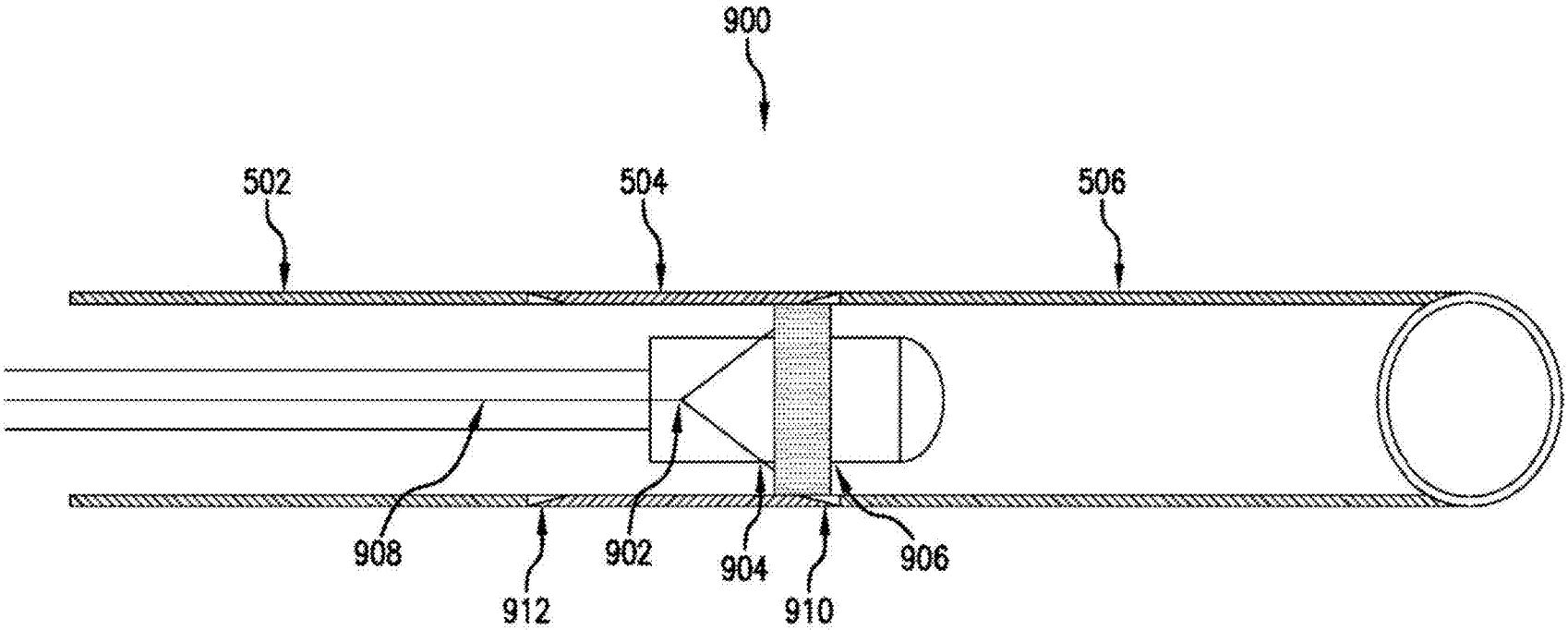
FIG. 9 illustrates an example direct connection RF coupler, in accordance with aspects of the present invention.

FIG. 9 illustrates an example direct connection RF coupler 900, in accordance with aspects of the present invention.

As shown in the figure, direct connection RF coupler 900 includes a connection point 902 to primary-phase center conductor RF transmission line 104, a conductor 904, and a conducting shoe 906. Additionally shown in the figure are center conductor 908 of primary-phase center conductor RF transmission line 104, a conducting ring 910, and a conducting ring 912.

Connection point 902 is electrically connected to center conductor 908 of primary-phase center conductor RF transmission line 104 and Conductor 904. Conductor 904 is electrically connected to conducting shoe 906. Conducting shoe 906 makes direct electrical contact with conducting ring 910. Conducting ring 910 is located within dielectric spacer 504 and is electrically connected to conductive segment 506 of primary-phase segmented well pipe 600. Conducting ring 912 is located within dielectric spacer 504 and is electrically connected to conductive segment 502 of primacy phase segmented well pipe 600. These components are disposed within primary-phase segmented well pipe section 600. A second set of these components is disposed within secondary-phase segmented well pipe section 700.

Connection point 902 may be any device or system, which connects RF energy from center conductor 908 of primary-phase center conductor RF transmission line 104 to Conductor 904. The input impedance of connection point 902 should matches primary-phase center conductor RF transmission line 104 to maximize energy transfer. Matching is maintained over a range of electrical parameters as hydrocarbon bearing strata 126 heats and the material properties change. Conductor 904 may be any device or system that guides RF energy to conducting shoe 906. Conducting shoe 906 may be any device or system, which makes direct physical and electrical contact with conducting ring 910 in dielectric spacer 504. The mechanical and electrical connection is maintained in the oil, gas, and saltwater environment that may exist in the well. Conducting ring 910 in dielectric spacer 504 may be any device or system, which passes RF energy on to conductive segment 506 of primary-phase segmented well pipe 600. Conducting ring 912 may be any device or system, which may be used when connecting to conductive segment 502 and will be discussed later. All Components are capable of withstanding the downhole environment, which includes high pressures, temperatures and possibly chemically corrosive materials.

In operation, direct connection RF coupler 900 is the matching system between center conductor RF transmission lines 104, 106 and the segmented well pipe sections 600, 700. Direct connection RF coupler 900 will guide the RF waves with low loss and minimal reflection onto the outside of a segment of the segmented well pipe 600, 700. As a group the couplers will also launch the wave onto the three-dimensional underground electromagnetic array with minimal loss to unwanted radiative electromagnetic fields.

Figure 10:
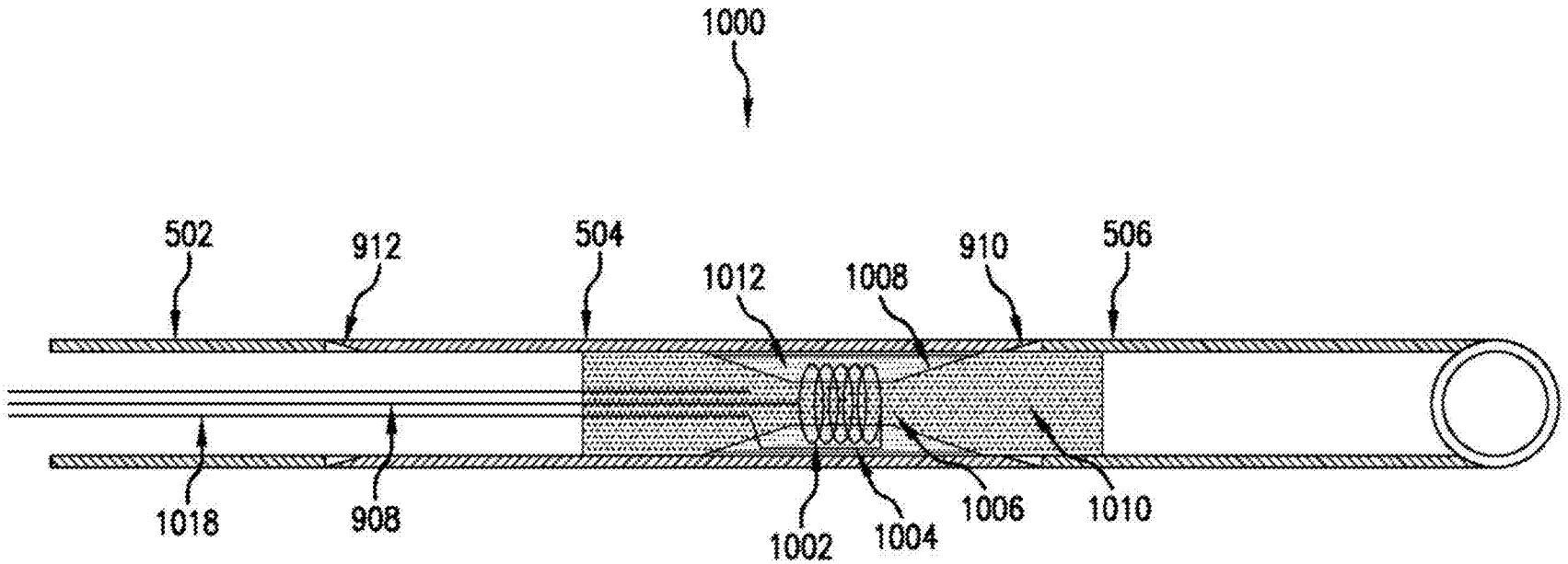
FIG. 10 illustrates an example inductive RF coupler, in accordance with aspects of the present invention.
Figure 11:
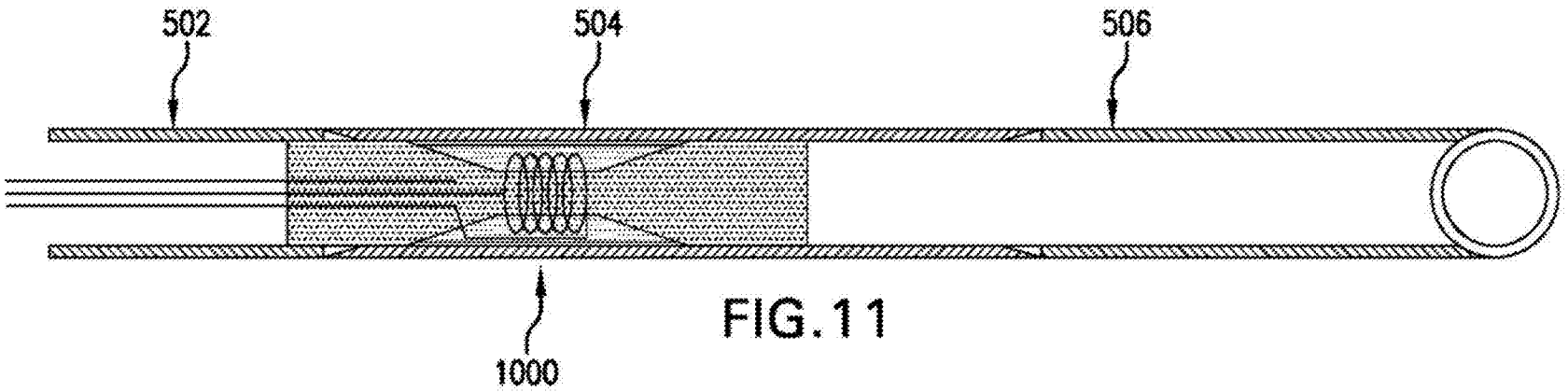
FIG. 11 illustrates an inductive RF coupler connected to a conductive segment of a primary-phase segmented well pipe, in accordance with aspects of the present invention.
Figure 12:
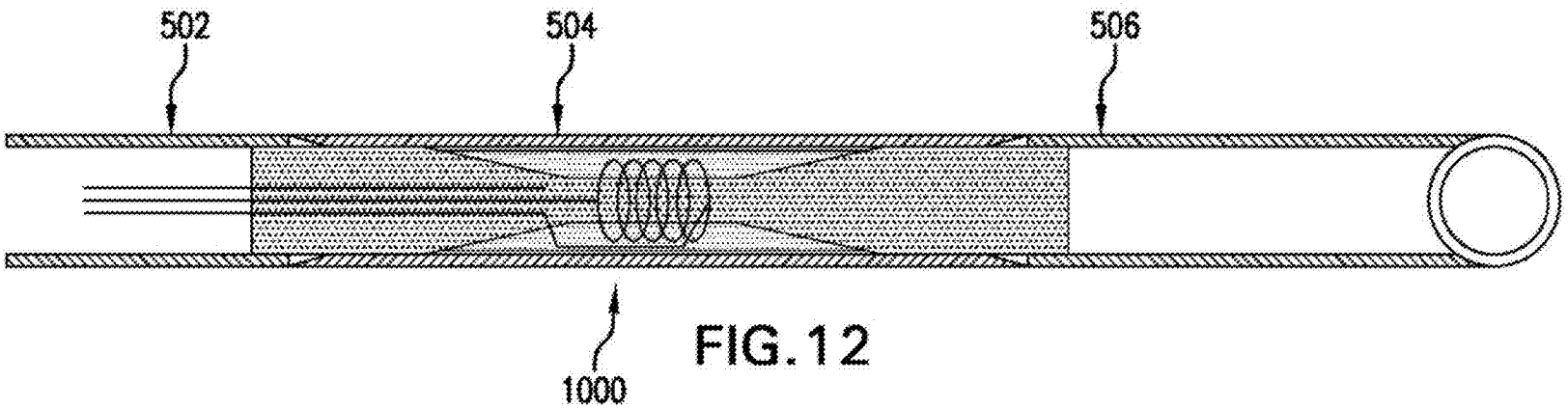
FIG. 12 illustrates an inductive coupler connected to two conductive segments of a primary-phase segmented well pipe, in accordance with aspects of the present invention.

FIGS. 10-12 illustrate the details of an inductive coupler and how it may be positioned with respect to a dielectric spacer in accordance with aspects of the present invention.

FIG. 10 illustrates an example inductive RF coupler 1000, in accordance with aspects of the present invention.

As shown in the figure, inductive RF coupler 1000 includes an inductive coil 1002, a return connection 1004 to outer conductor 1018 of a center conductor 908 of primary-phase center conductor RF transmission line 104, a ferrous core 1006, a conductor 1008, an expandable end piece 1010, and a dielectric cover 1012. Also shown in the figure is an RF transmission line outer conductor 1014.

The left side of inductive coil 1002 is electrically connected to center conductor 908 of primary-phase center conductor RF transmission line 104. The right side of inductive coil 1002 is electrically connected to RF transmission line outer conductor 1014 of primary-phase center conductor RF transmission line 104 by return connection 1004. Inductive coil 1002 is also connected to ferrous core 1006 by magnetic fields. Ferrous core 1006 is connected to conducting ring 910 by conductor 1008. Conducting ring 910 is electrically connected to conductive segment 506 of primary-phase segmented well pipe 600. These components are all disposed within primary-phase segmented well pipe section 600. A second set of these components is disposed within secondary-phase segmented well pipe section 700 not shown).

Inductive coil 1002 may be any device or system, which magnetically couples and matches and RF energy from primary-phase center conductor RF transmission line 104 to ferrous core 1006. The input impedance of inductive RF coupler 1000 matches primary-phase center conductor RF transmission line 104 to maximize energy transfer. Matching is maintained over a range of electrical parameters as hydrocarbon bearing strata 126 heats and the material properties change. Return line 1004 may be any device or system, which completes the electrical circuit between inductive coil 1002 and RF transmission line outer conductor 1014 of primary-phase center conductor RF transmission line 104.

Ferrous core 1006 may be any device or system, which receives RF energy from inductive coil 1002. Conductor section 1008 may be any device or system, which guides RF energy out to conducting ring 910. Expandable end piece 1010 may be any device or system that makes a secure mechanical connection to conductive segment 506 of primary-phase segmented well pipe 600. The mechanical and electrical connection is maintained in the oil, gas, and saltwater environment that may exist in the well. Dielectric cover 1012 may be any device or system, which protects inductive coil 1002 and ferrous core 1006 from the downhole environment, which may include hot oil, gas, water.

Conducting ring 910 may be any device or system that forms a smooth connection for currents flowing out onto conductive segment 506 of primary-phase segmented well pipe 600. Conducting ring 912 may be any device or system, which forms a smooth connection for currents flowing out onto conductive segment 502 of primary-phase segmented well pipe 600 when conductive segment 502 is activated. RF transmission line outer conductor 1014 may be any device or system, which forms the outer shield for primary-phase center conductor RF transmission line 104. All components should be capable of withstanding the downhole environment, which includes high pressures, temperatures and possibly chemically corrosive materials.

FIG. 11 illustrates inductive RF coupler 1000 connected to conductive segment 502 of primary-phase segmented well pipe 600, in accordance with aspects of the present invention.

In operation RF coupler 1000, as shown in FIG. 10 and FIG. 11, may be connected to either end of a leg of the three dimensional underground electromagnetic array and forms the matching system to efficiently conduct the RF energy with minimal loss and reflection. RF energy therefore may be guided into either end of the three dimensional underground electromagnetic array. This flexibility allows the heating along the three dimensional underground electromagnetic array to be more uniform.

FIG. 12 illustrates inductive coupler 1000 connected to both conductive segment 502 and conductive segment 506 of primary-phase segmented well pipe 600, in accordance with aspects of the present invention.

In operation, inductive RF coupler 1000 is the matching system between center conductor RF transmission lines 104, 106 and the segmented well pipe sections 600, 700, Inductive RF coupler 1000 will guide the RF waves with low loss and minimal reflection onto the outside of a segment of the segmented well pipe 600, 700. As a group the couplers will also launch the wave onto the three-dimensional underground electromagnetic array with minimal loss to unwanted radiative electromagnetic fields.

Inductive RF coupler 1000 can be realized in two length regimes based on the desired use. The "short" version is designed so that only one conductive segment (e.g. 502) is energized at one time. The "long" version is designed so that inductive RF coupler 1000 can connect to both sides simultaneous and hence energize the legs of two separate three-dimensional underground electromagnetic arrays at the same time. Conversely, inductive RF coupler 1000 can be made in only one length and the length of dielectric spacer (e.g. 504) can be varied. Note that short and long are relative terms, the exact lengths of all components are governed by the physical properties of hydrocarbon bearing strata 126 and the desired oil and gas output as a function of time.

A non-limiting example capacitive connection scheme for guiding the RF energy onto the outside of one of conductive segments (e.g. 502, 506) of segmented well pipe will now be described with reference to FIG. 13.

Figure 13:
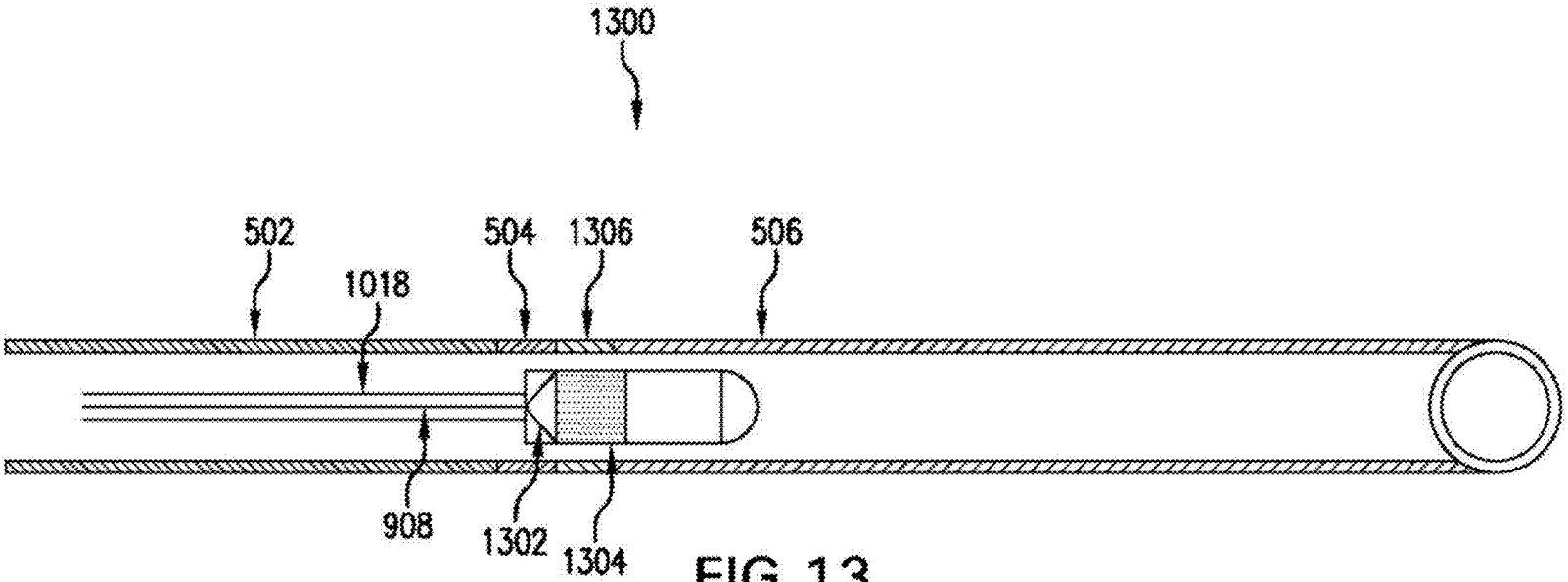
FIG. 13 illustrates an example capacitive RF coupler, in accordance with aspects of the present invention.

FIG. 13 illustrates an example capacitive RF coupler 1300, in accordance with aspects of the present invention.

As shown in the figure, capacitive RF coupler 1300 includes a conductor 1302, and a capacitive plate 1304. Additionally shown in the figure is a dielectric spacer capacitive plate 1306.

Conductor 1302 is electrically connected to center conductor 908 of primary-phase center conductor RF transmission line 104 and to capacitive plate 1304. Capacitive plate 1304 is connected by electric fields to dielectric spacer capacitive plate 1306. Dielectric spacer capacitive plate 1306 is electrically connected to conductive segment 506 of primary-phase segmented well pipe 600. These components are disposed within primary-phase segmented well pipe section 600. A second set of these components is disposed within secondary-phase segmented well pipe section 700.

Conductor 1302 may be any device or system, which smoothly transitions the current from center conductor 908 of primary-phase center conductor RF transmission line 104 to capacitive plate 1304. The input impedance of capacitive RF coupler 1300 should be matched to primary-phase center conductor RF transmission line 104 to maximize energy transfer. Matching should be maintained over a range of electrical parameters as hydrocarbon bearing strata 126 heats and the material properties change.

Capacitive plate 1304 may be any device or system, which forms one half of the electric field connection between capacitive RF coupler 1300 and dielectric spacer capacitive plate 1306. Dielectric spacer capacitive plate 1306 may be any device or system, which forms the other half of the electric field connection and also connects the transferred currents onto conductive segment 506 of primary-phase segmented well pipe 600. Dielectric spacer plate 1306 is only used with the capacitive coupler and is not present in the spacer when inductive or direct connection is used. All components should be capable of withstanding the downhole environment, which includes high pressures, temperatures and possibly chemically corrosive materials.

In operation, capacitive RF coupler 1300 is the matching system between center conductor RF transmission lines 104, 106 and the segmented well pipe sections 600, 700. Capacitive RF coupler 1300 will guide the RF waves with low loss and minimal reflection onto the outside of a segment of the segmented well pipe 600, 700. As a group the couplers will also launch the wave onto the three-dimensional underground electromagnetic array with minimal loss to unwanted radiative electromagnetic fields A tunable inductor (not shown) may be used to adjust the coupling to account for changing electrical parameters during heating.

Returning to FIG. 1, a discussion of the properties of the underground environment is provided.

The properties of hydrocarbon bearing strata 126 will change with heating. The most notable change is that, as the water changes to steam and flows out of the well, the imaginary part of the permittivity will decrease. This will cause less energy to be deposited in spots already heated to the boiling point of water at pressure and more to the cooler nearby areas. The boiling point of water increases with pressure so the temperature at which boiling occurs will be higher the further underground the heating is taking place. As hydrocarbon bearing strata 126 is being heated, if the depth is too great there will be no distinct conversion of liquid to gas; water will be in the supercritical state. This pressure is 3200 psi and occurs at a depth of approximately 2750 ft assuming the average density of the rock is 2.6 times the density of water. The imaginary part of the permittivity will change throughout this range of possible depths and states as the water heats.

Because, of this change in electrical properties of hydrocarbon bearing strata 126, dry fracture shale energy extraction system 100 may employ a matching section (quarter wave or other) between RF coupler 202, 204 and center conductor RF transmission line 104, 106 to facilitate the matching between RF generators 102 and the three-dimensional underground electromagnetic array. This may be necessary if the mismatch between the three-dimensional underground electromagnetic array and center conductor RF transmission line 104, 106 is too large for the tuner associated with RF couplers 202, 204 to compensate for. This will be function of the changing electrical characteristics of hydrocarbon bearing strata 126.

Figure 14:
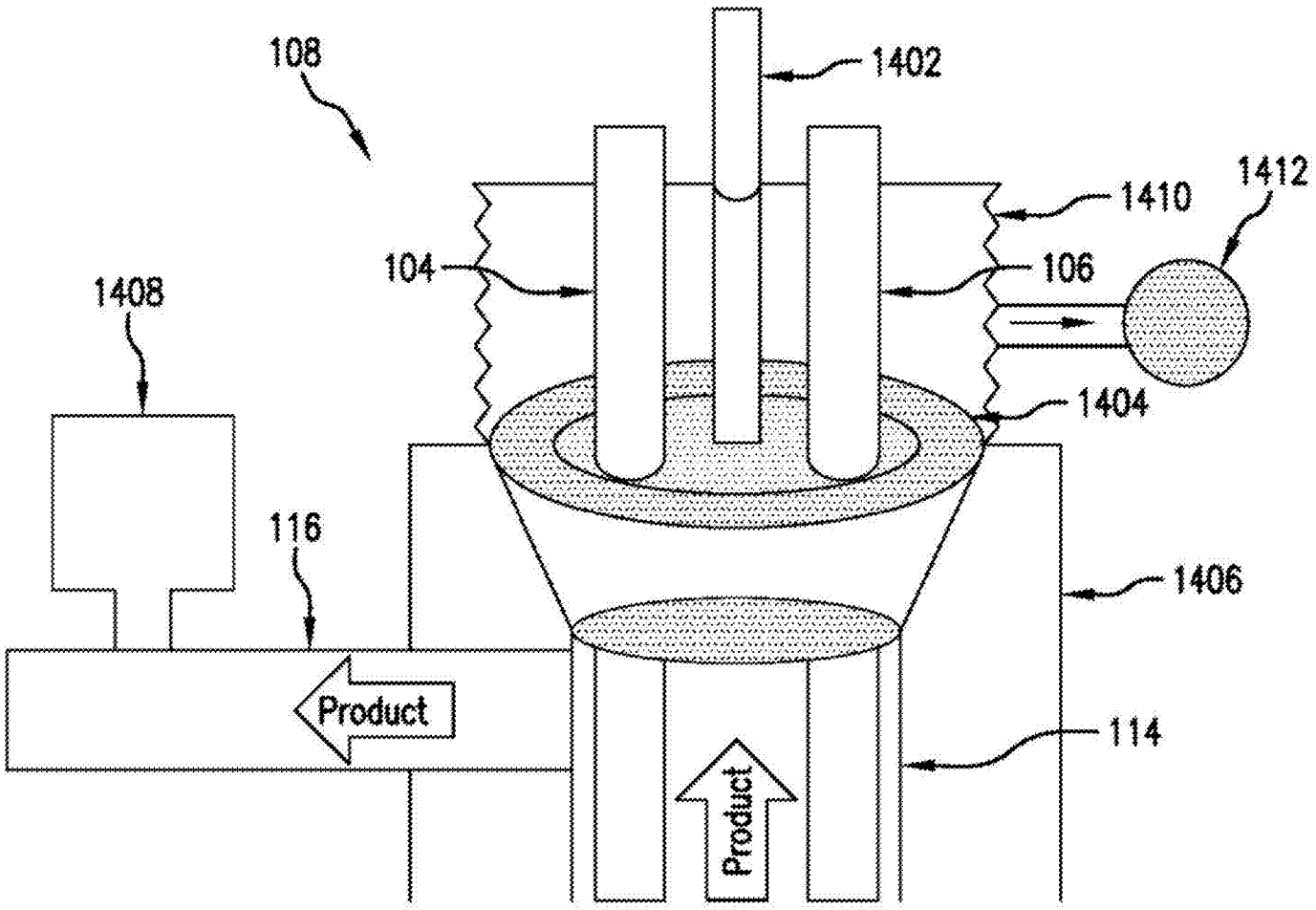
FIG. 14 illustrates an example hydrocarbon lock to feed the RF power down into the well without loss of oil or gas to the environment, in accordance with aspects of the present invention.
Figure 15:
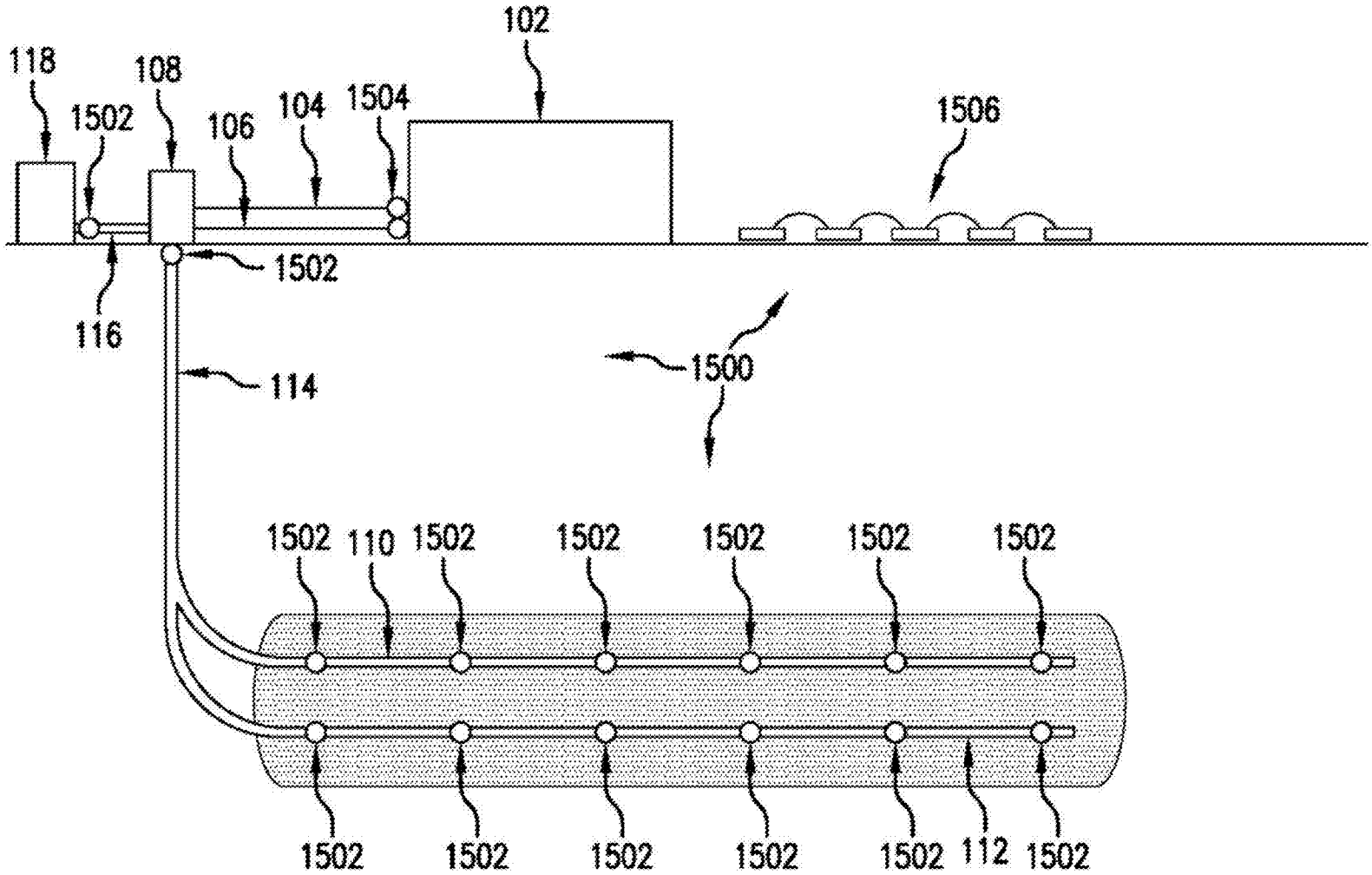
FIG. 15 illustrates an example sensor suite, which will regulate and optimize the functioning of a dry fracture shale energy extraction system, in accordance with aspects of the present invention.

Two additional systems required for dry fracture shale energy extraction system 100 to work are described. FIGS. 14 and 15 detail these ancillary systems that may facilitate and optimize the use of dry fracture shale energy extraction system 100. These systems may be used for both embodiments of dry fracture shale energy extraction system 100.

FIG. 14 illustrates an example hydrocarbon lock 108 to feed the RF power down into the well without loss of oil or gas to the environment, in accordance with aspects of the present invention.

As shown in the figure, hydrocarbon lock 108 includes a compression bar 1402, a compression seal 1404, a hydrocarbon lock body 1406, a pressure reduction pump 1408, a flexible hydrocarbon barrier 1410, and an environmental pump 1412.

Compression bar 1402 is located above and connected to compressible seal 1404. Compressible seal 1404 is configured within a hole in the top of hydrocarbon seal body 1406. Hydrocarbon seal body 1406 surrounds primary-phase center conductor RF transmission line 104, secondary-phase center conductor RF transmission line 106 and is connected to the top of vertical well pipe section 114. Oil recovery pipe 116 passes through hydrocarbon seal body 1406 and is connected to vertical well pipe section 114. Pressure reduction pump 1408 is connected to oil recovery pipe 116. Flexible hydrocarbon barrier 1410 is connected to the top of hydrocarbon lock body 1406 on the outside of compressible seal 1404. The intake to environmental pump 1412 is connected to flexible hydrocarbon seal 1410.

Compression bar 1402 may be any device or system, which compresses compressible seal 1404 to prevent oil and gas leakage during system operation. Compressible seal 1404 may be any device or system, which spreads under compression and seals the ingress point for primary-phase center conductor RF transmission line 104 and secondary-phase center conductor RF transmission line 106.

Hydrocarbon lock body 1406 may be any device or system, which provides support for compression bar 1402 and compressible seal 1404. Hydrocarbon lock body 1406 also provides the flow path for oil and gas from vertical well pipe 114 to oil recovery pipe 116.

Pressure reduction pump 1408 may be any device or system, which reduces pressure inside of hydrocarbon lock 108 so that, during insertion or retrieval of primary-phase center conductor RF transmission line 104 or secondary-phase center conductor RF transmission 106 operation, oil and gas are less likely to escape through compressible seal 1404.

Flexible hydrocarbon barrier 1410 may be any device or system, which prevents any oil or gas that leaks through compression seal 1404 during hydrocarbon lock operation from escaping into the environment. Environmental pump 1412 may be any device or system, which collects any gas or oil within flexible hydrocarbon seal volume and directs it to storage tank 118.

All components of hydrocarbon lock 108 should be able to withstand the temperatures and pressures that will be present from the oil and gas coming up vertical well pipe 114 as the system heats hydrocarbon bearing strata 126.

In operation hydrocarbon lock 108 will allow the insertion or retraction of several center conductor RF transmission lines 104, 106 from the well with no oil or gas leakage. Center conductor RF transmission lines 104, 106 are passed through smooth holes in compressible seal 1404 (e.g. valve stem packing or high temperature rubber-like stopper), which form a tight seal when compressed by compression bar 1402 into a conical seating surface in hydrocarbon lock body 1406 to minimize loss of product and protect the environment. High temperature seating materials are necessary to withstand the high temp hydrocarbon environment from the product flowing up the pipe (~300 Celsius). When it is necessary to move center conductor RF transmission lines 104, 106, the sealing pressure is reduced and center conductor RF transmission lines 104, 106 will slide freely through the holes in the compressible material. Simultaneously pressure reduction pump 1408 is energized to reduce the pressure in hydrocarbon lock body 1406. While the pressure is reduced, oil and gas will be able to leak at a slow rate through the area around center conductor RF transmission lines 104, 106. Flexible hydrocarbon barrier 1410 is applied around hydrocarbon lock 108 to keep any oil or gas from escaping into the environment. When center conductor RF transmission lines 104, 106 reach the final desired position, the seating pressure is reapplied.

Hydrocarbon lock 108 will allow the movement of several center conductor RF transmission lines (e.g. center conductor RF transmission lines 104, 106) with a no hydrocarbon leakage. The number of center conductor RF transmission lines is based on the number of horizontal or vertical legs in the well that are energized from a single vertical top section of a well. The configuration shown here is for two center conductor RF transmission lines 104, 106 though more are possible. The restricting parameter is the inner diameter of vertical well pipe section 114 being able to accommodate multiple center conductor RF transmission lines and still have sufficient cross sectional area to allow product flow.

Center conductor RF transmission lines 104, 106 are passed through smooth holes in compressible seal 1404 (e.g. valve stem packing or high temperature rubber like stopper), which form a tight seal when compressed by compression bar 1402 into a conical seating surface in hydrocarbon lock body 1406 to minimize loss of product and protect the environment. The seal occurs due to the expansion of compressible material 1404 when pressure is applied at the top. This expansion causes compressible material 1404 to tightly seal around center conductor RF transmission lines hence preventing the escape of oil and gas.

The compressible seal 1404 is composed of material able to withstand the high temperature hydrocarbon environment from the product flowing up the pipe (~300 Celsius). Compressible seal 1404 should be chemically inert. Compressible seal 1404 should also readily expand and compress, even while heated to allow center conductor RF transmission lines 104, 106 to move. Compressible seal 1404 material should not have significant hysteresis so that the hole size does not remain small when the sealing pressure is reduced.

When it is necessary to move center conductor RF transmission lines 104, 106 the sealing pressure is reduced and center conductor RF transmission lines 104, 106 will slide freely through the holes in compressible seal 1404. When center conductor RF transmission lines 104, 106 reach the final desired position, the sealing pressure is reapplied. During the time the pressure is reduced flexible hydrocarbon barrier 1410 will prevent any oil or gas from escaping into the environment. Flexible hydrocarbon barrier 1410 is clamped to center conductor RF transmission lines 104, 106 so it expand or contract when the RF transmissions are extracted or inserted respectively. Environmental pump 1412 is connected to flexible hydrocarbon barrier 1410 to capture all oil and gas that passes around center conductor RF transmission lines 104, 106 in the main sealing surface.

Center conductor RF transmission lines 104, 106 can be moved individually or both at once. As center conductor RF transmission lines 104, 106 are first inserted it may be desirable to move them individually so the end points of each, which are attached to one of many forms of RF couplers 202, 204 discussed, can be accurately placed in the production portion of the well for RF application. After the initial insertion, center conductor RF transmission lines 104, 106 may be moved simultaneously to ensure they stay at the same relative position within hydrocarbon bearing strata 126. Moving center conductor RF transmission lines 104, 106 simultaneously also reduces the time to perform the operation.

As designed, no oil or gas will escape during repositioning of center conductor RF transmission lines 104, 106. However, as an extra precaution, a flame extinguishing system will be used to prevent the auto ignition of hydrocarbons that are above the flashpoint temperature in air. This system will be always on and has temperature sensors for auto deployment of flame extinguishing chemicals. The system will also have manual controls so that it can be activated if needed.

The open ends of center conductor RF transmission lines 104, 106 are never exposed to product now. Product flow only occurs around the location of the joint when center conductor RF transmission line 104, 106 joint has been made and sealed. The flow of product is never interrupted. An adapter to connect center conductor RF transmission line 104, 106 to a lift crane is necessary and will be a smaller version of adapters already in use for well pipe. It will differ in that it will allow the lowering and retracting of two pipes at one time.

Returning to FIG. 1, dry fracture shale energy extraction system 100 system will have central control, which will monitor down hole conditions and make adjustments as necessary to optimize the process. The sensors for this system are described in more detail with reference to FIG. 15.

FIG. 15 illustrates example sensor suite 1500, which will regulate and optimize the functioning of dry fracture shale energy extraction system 100 in accordance with aspects of the present invention.

As shown in the figure, sensor suite 1500 includes pressure temperature and flow sensor suites 1502, VSWR meters 1504, and a mini quake seismic array 1506.

Pressure, temperature, and flow sensor suites 1502 are attached to the well pipe at various points along the oil and gas producing portion of the well and at hydrocarbon lock 108. One pressure, temperature, and flow sensor suite 1502 is also attached to the input to oil storage tank 118. VSWR meters 1504 are attached to both primary-phase center conductor RF transmission line 104 and secondary-phase center conductor RF transmission line 106. Mini quake seismic sensor 1506 is attached to the ground above the oil producing parts of the well.

Pressure temperature, and flow sensor suites 1502 may be any device or system, which measure system parameters to allow optimized operation. VSWR meters 1504 may be any device or system, which measure RF energy reflecting back up the RF transmission lines. Mini quake seismic array 1506 may be any device or system, which measures crack activity as hydrocarbon bearing strata 126 heats.

In operation, sensor suite 1500 will optimize the heating process sorting between various priorities such as maximizing cracking, maximizing in situ retorting, and keeping cracks open. This will involve the use of models, which use known system parameters along with sensor inputs to feed algorithms, which decide which of the control parameters to adjust in a given time interval. It will measure pressure, temperature, flow, and cracking to determine when it is necessary to change the energy application point and alert the operator. By assessing the product flow and heating history it will determine when additional heating is necessary to reopen cracks that are starting to seal and/or cause new cracks in a previously heated block of hydrocarbon bearing strata 126. Controllable parameters are: magnitude, phase, and frequency of the RF energy, location of RF couplers 202, 204.

Returning to FIG. 1, the heating process for dry fracture shale energy extraction system will now be discussed in more detail. The heating process consists of energizing the set of underground three-dimensional underground electromagnetic arrays sequentially. The particular heating process described herein is for the case of an n by m three-dimensional underground electromagnetic array of well bores being energized in an n by 2 groups. Other groupings are possible.

Starting at the three-dimensional underground electromagnetic array in the horizontal portion of the well closest to vertical well pipe section 114. RF energy will be applied to the three-dimensional underground electromagnetic array over a period of months (1 to 15). The length of time is determined by power level, frequency, and size of the block of hydrocarbon bearing strata 126 being heated. The process may start at the end of the horizontal section adjacent to vertical well pipe section 114 or at the horizontal end far from vertical well pipe section 114. The procedure is the same for either. It should also be noted that the process works for vertical sets of wells also. After the multi-month period when hydrocarbon bearing strata 126 has been heated to ~350° Celsius, the RF application point will be moved into the horizontal location of the next three-dimensional underground electromagnetic array along the well and the process started over again.

To account for changing conditions down the well hole, a feedback controller will monitor the amount of RF power coming back up center conductor RF transmission lines 104, 106 and will adjust the coupling of center conductor RF transmission lines 104, 106 to RF couplers 202, 204 and hence to the three-dimensional underground electromagnetic array to maximize the flow of energy into the three-dimensional underground electromagnetic array. As the amount of energy reflected back, up through center conductor RF transmission lines 104, 106 increases, the amount of capacitance or inductance in the down-hole matching section will be adjusted. This adjustment will reduce the amount of energy reflected back, up through center conductor RF transmission lines 104, 106. All adjustments required to keep energy backflow to a minimum will be automated with reports of adjustments sent back to the operator. The feedback controller will alert the operator when the adjustments cause the system to approach its maximum range of tune ability.

The timing and location of the application of RF is also controlled by feedback from the temperature and flow sensors. If a particular leg of the three-dimensional underground electromagnetic array is showing excessive heat, then power may be reduced or eliminated from that leg of the three-dimensional underground electromagnetic array. The power allocation between legs of the three-dimensional underground electromagnetic array would then be adjusted to maximize desired heating effects. If flow measurements show that flow is reducing earlier than predicted, then additional heat may be applied to re-stimulate as necessary. Pressure is also monitored to ensure down-hole conditions are conducive to flow into the well bore from hydrocarbon bearing strata 126 and that the product has good support for flowing up the pipe to the well head.

During the multi-month period of heating, the polarities of RF generators 102 may be changed to heat different portions of hydrocarbon bearing strata 126 at different times. This is described in more detail FIG. 16.

Figure 16:
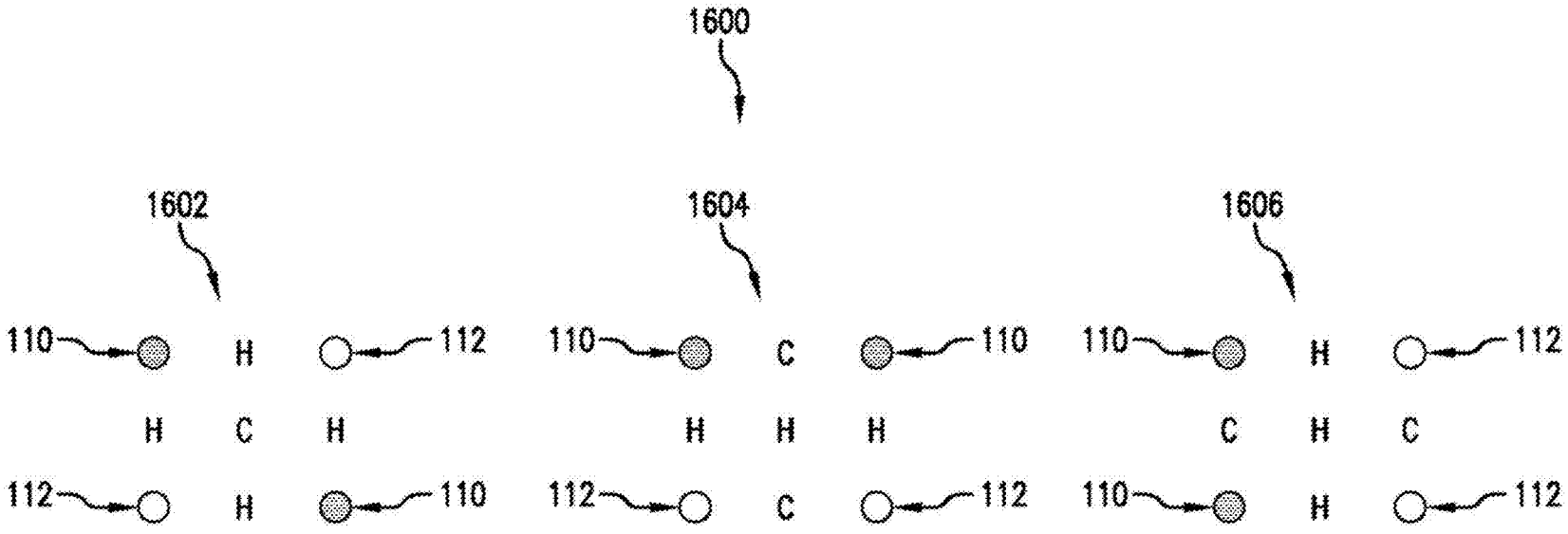
FIG. 16 illustrates heating patterns for a square, three-dimensional underground electromagnetic array realization of a dry fracture shale energy extraction system, for heating specific sections of hydrocarbon bearing strata by controlling which well pipe segments contain primary-phase RF signals and which contain secondary-phase of two RF signals, in accordance with aspects of the present invention.

FIG. 16 illustrates heating patterns 1600, for a square, three-dimensional underground electromagnetic array realization of dry fracture shale energy extraction system 100, for heating specific sections of hydrocarbon bearing strata 126 by controlling which well pipe segments contain primary-phase RF signals and which contain secondary-phase of two RF signals, in accordance with aspects of the present invention.

As shown in the figure, heating patterns 1600 for a square, three-dimensional underground electromagnetic array include a diagonal pattern 1602, a horizontal pattern 1604, and a vertical pattern 1606.

Heating patterns 1602, 1604, and 1606 all preferentially heat different volumes of hydrocarbon bearing strata 126.

By applying heat to precise locations, the stress can be adjusted to cause cracks to form in the desired locations to facilitate the flow of oil and gas to the well. The growth of the crack field is measured by the mini seismic array 1506 at surface of the earth 122 above the well bore. This sensor can locate all new cracks above a certain size in three-dimensional space as they form. If a certain volume is not getting sufficient cracking, then the heat will be adjusted to cause the cracking to occur preferentially in that volume.

The expansion of water and, if shallow enough, the conversion of water to steam, will both cause additional stresses and cracking. Further the conversion process of the solid kerogen to oil, gas and char results in additional stress and subsequent cracking. Cracks from all these cracking mechanisms will be measured and controlled to increase the permeability of hydrocarbon bearing strata 126 and let the oil and gas flow to the horizontal well pipes for extraction.

The process will repeat for each three-dimensional underground electromagnetic array along the well bore. During that time previously heated hydrocarbon bearing strata 126 will be producing oil and gas. To ensure that the maximum amount of oil and gas are harvested, hydrocarbon bearing strata 126 may be reheated to stimulate additional product output. The additional heat will cause additional cracking and reopen old cracks. Exact frequency and timing of reheating is dependent on the properties of hydrocarbon bearing strata 126 and may be different for each formation. The duration of reheating will be determined by measuring the flow rate, pressure and temperature at each three-dimensional underground electromagnetic array so that the amount of product coming out of any one of the three-dimensional underground electromagnetic array volumes can be calculated. As soon as the amount of product coming from that three-dimensional underground electromagnetic array is back to predicted levels, than the RF application point can be moved again.

It is obvious that the heating process is not confined to the volume enclosed by the well bores. In fact the heated zone expands out around the first set of well bores into volumes that are inside other sets of well bores. This is important since large volumes of hydrocarbon bearing strata 126 are exposed to up to four or more heating and cooling cycles. The more heating, and cooling cycles, the more dense the crack structure and the higher the permeability. These cracking cycles are measured via mini seismic sensor array 1506 at ground level.

In a well with a 5000 ft horizontal section, the overall heating process may take up to 20 years. During this time, new producing zones are being stimulated and older zones are producing. The period of time each zone produces will be determined by the initial heating, the refresh heating rate and the rate of plastic deformation, which will be acting to close the cracks. One measurement of crack closure is reduction of product flow. This will be closely monitored and additional RF stimulation applied as necessary.

In the above-discussed embodiments, an RF coupler is moved along well pipe segments to heat areas along a length of well pipes. However, it may be problematic to precisely move an RF coupler along lengths of segmented well pipes, particularly when hot oil and gas are being extracted under high pressure.

In other embodiments of the present invention, there is no moving RF coupler. Specifically, in other embodiments a system of switches selectively actuate well pipe segments so as to heat areas along a length of well pipes. Example embodiments of such switch-selective systems will now be described in greater detail with reference to FIGS. 17*a*-19.

A segmented well pipe of a third embodiment of the present invention may include a plurality of segment switches that selectively actuate adjacent pairs of conductive well pipe segments. This will be further described with reference to FIG. 17*a*-18*c*.

Figure 17A:
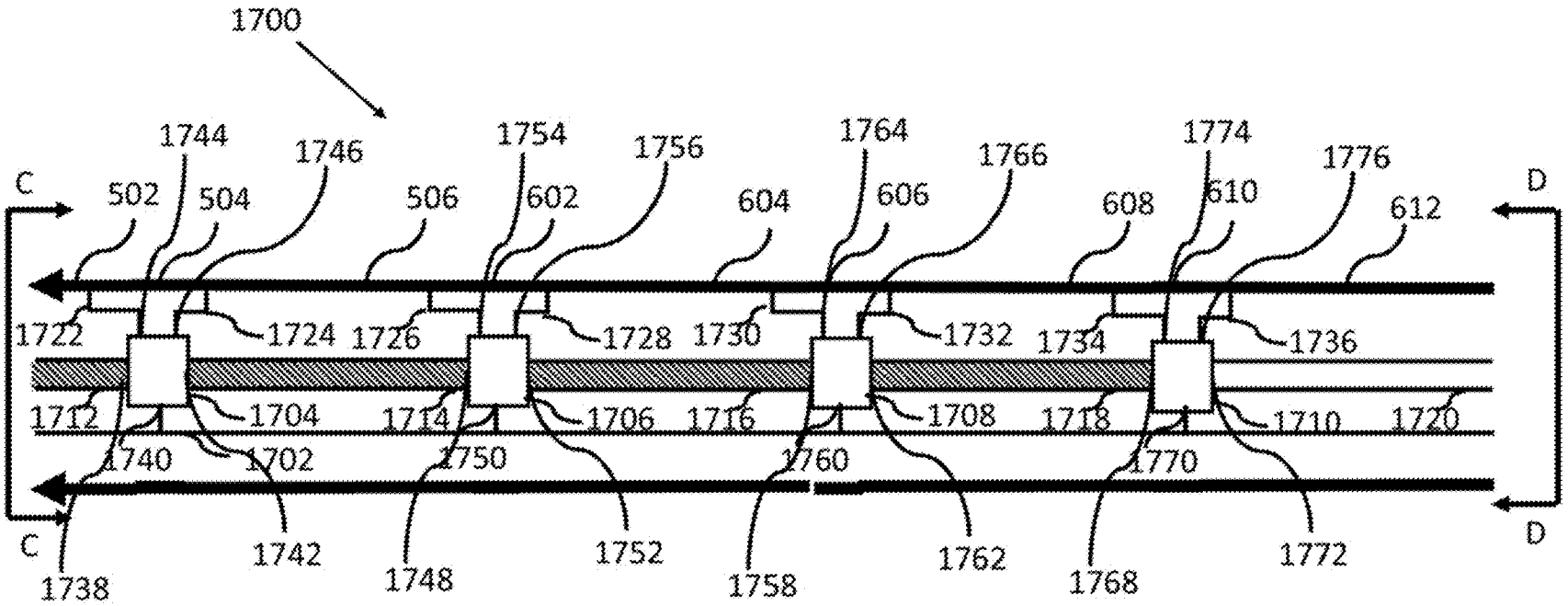
FIG. 17*a* illustrates a section of a primary-phase segmented well pipe at a time $t_5$, in accordance with aspects of the present invention.
Figure 17B:
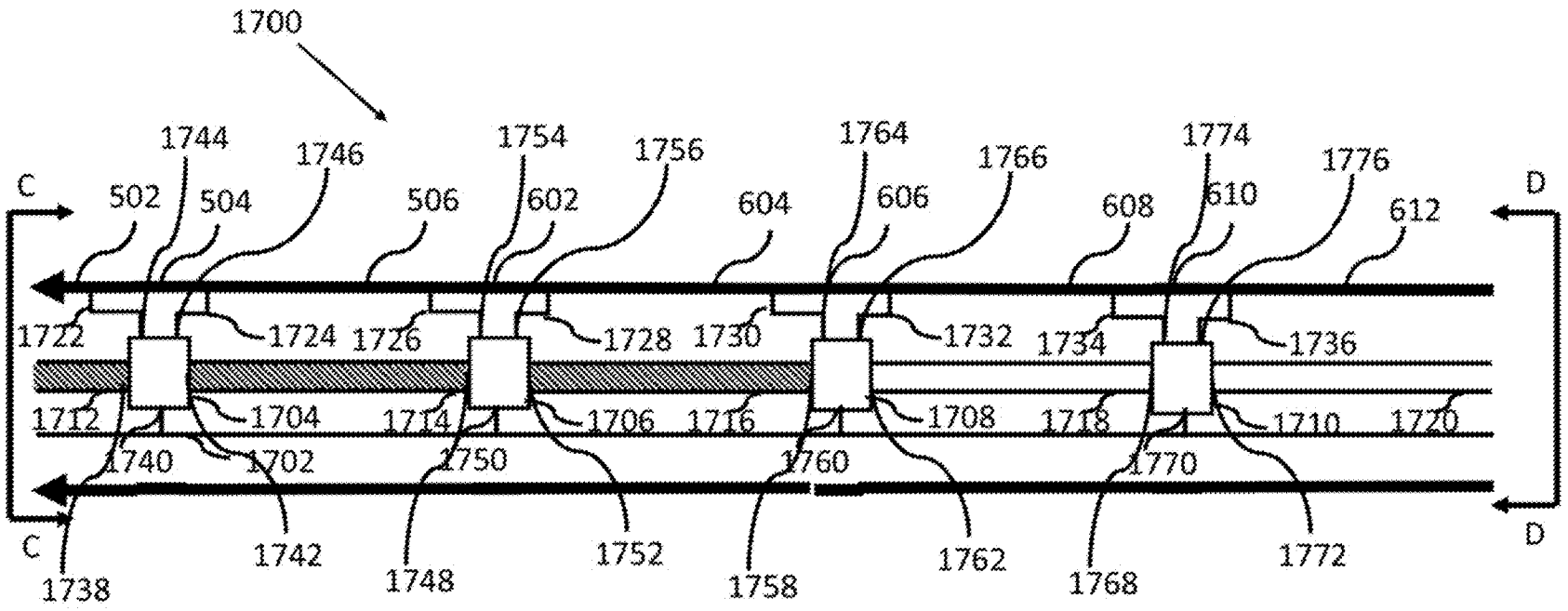
FIG. 17*b* illustrates the section of the primary-phase segment pipe of FIG. 17*a* at a time $t_6$.
Figure 17C:
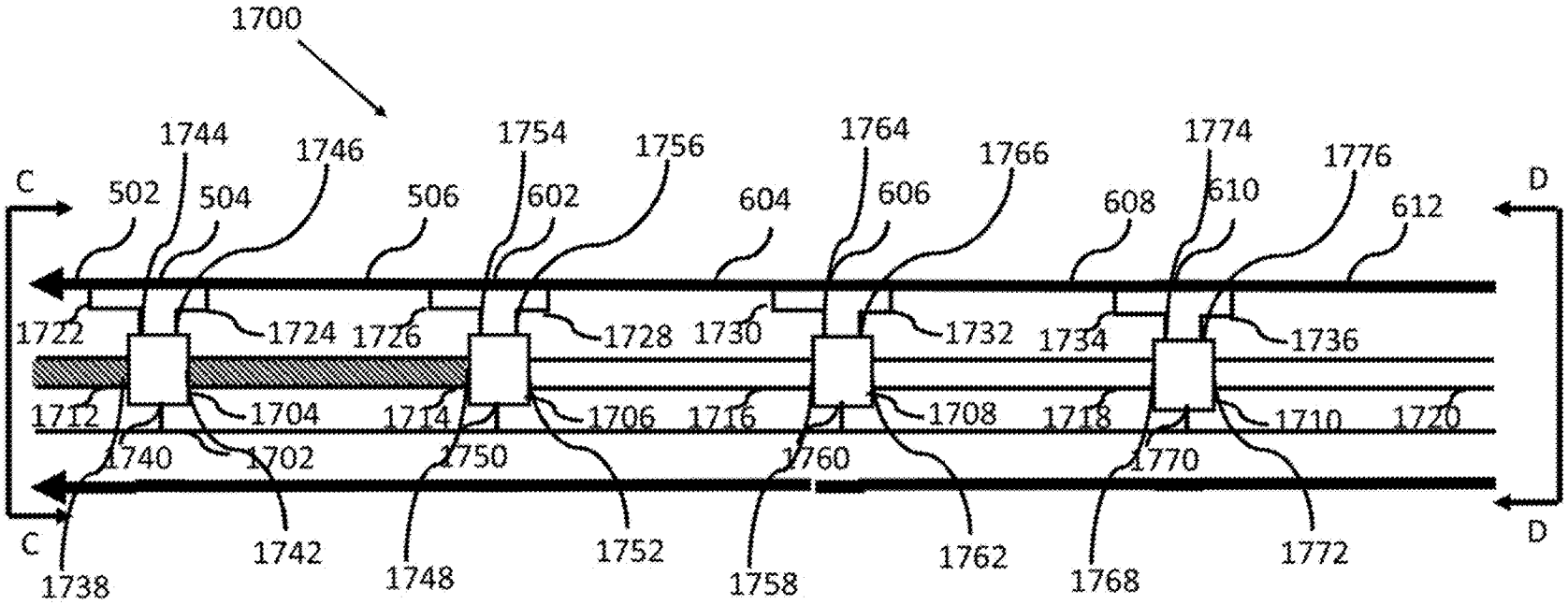
FIG. 17*c* illustrates the section of the primary-phase segmented well pipe of FIG. 17*a* at a time $t_7$.

FIGS. 17*a-c* illustrate a section of a primary-phase segmented well pipe 1700, similar in length so as to fit between double arrows CC and DD in FIG. 1, and having a plurality of segment switches accordance with aspects of the present invention.

FIG. 17*a* illustrates a section of a primary-phase segmented well pipe section 1700 at a time $t_5$ in accordance with aspects of the present invention. It should be noted that time $t_5$ is used to differentiate a different time from time $t_4$ discussed above with reference to FIG. 5*b*. In particular, time $t_5$ of this example embodiment is unrelated to times $t_1$-$t_4$.

As shown in FIG. 17*a*, the section, of segmented primary-phase segmented well pipe 1700 includes conductive segment 502, conductive segment 506, conductive segment 604, conductive segment 608, conductive segment 612 dielectric spacer 504, dielectric spacer 602, dielectric spacer 606, and dielectric spacer 610, arranged in a manner similar to the embodiment discussed above with reference to FIG. 6.

However, in this embodiment, primary-phase segmented well pipe 1700 does not include RF coupler 202 similar to segmented well pipe section 600 discussed above with reference to FIG. 6. On the contrary in the embodiment of FIG. 17*a*, primary-phase segmented well pipe 1700 further includes a selector line 1702, a segment switch 1704, a segment switch 1706, a segment switch 1708, a segment switch 1710, an RF transmission line segment 1712, an RF transmission line segment 1714, an RF transmission line segment 1716, an RF transmission line segment 1718, an RF transmission line segment 1720, a conducting line 1722, a conducting line 1724, a conducting line 1726, a conducting line 1728, a conducting line 1730, a conducting line 1732, a conducting line 1734 and a conducting line 1736.

Segment switch 1704 includes an RF signal input port 1738, a selector line input port 1740, an RF signal transmission port 1742, an RF signal output port 1744 and an RF signal output port 1746.

Segment switch 1706 includes an RF signal input port 1748, a selector line input port 1750, an RF signal transmission port 1762, an RF signal output port 1754 and an RF signal output port 1756.

Segment switch 1708 includes an RF signal input port 1758, a selector line input port 1760, an RF signal transmission port 1762, an RF signal output port 1764 and an RF signal output port 1766.

Segment switch 1710 includes an RF signal input port 1768, a selector line input port 1770, an RF signal transmission port 1772, an RF signal output port 1774 and an RF signal output port 1776.

For segment switch 1704, RF signal input port 1738 is arranged to electrically connect to RF transmission line segment 1712, selector line input port 1740 is arranged to electrically connect to selector line 1702, RF signal transmission port 1742 is arranged to electrically connect to RF transmission line segment 1714, RF signal output port 1744 is arranged to electrically connect to conducting line 1722 and RF signal output port 1746 is arranged to electrically connect to conducting line 1724. RF transmission line segment 1714 is additionally arranged to electrically connect to RF signal input port 1748 of segment switch 1706. Conducting line 1722 is additionally arranged to electrically connect to conductive segment 502. Conducting line 1722 is additionally arranged to electrically connect to conductive segment 506.

In operation, RF energy is transmitted down RF transmission line segment 1712 to RF signal input port 1738. A selector signal is provided to selector line input port 1740 by way of selector line 1702. The selector signal controls the state of segment switch 1704. Segment switch 1704 may be in conducting state or a by-pass state. Selector line 1702 may originate at RF generator 102, wherein RF generator 102 provides the separate selector signal. A selector panel (not shown), independent of RF generator 102, may also be used to control the switches.

In a conducting state, segment switch 1704 electrically connects the RF energy from RF signal input port 1738 to RF signal output port 1744 and to RF signal output port 1746 so as to electrically connect to conducting line 1722 and conducting line 1724, respectively. For example the primary-phase center conductor of RF transmission line segment 1712 may be electrically connected to RF signal output part 1744 whereas the outer conductor of RF transmission line segment 1712 may be electrically connected to RF signal output port 1746. In this manner, conductive segment 502 will receive RF energy from conducting line 1722, whereas conductive segment 506 will receive RF energy from conducting line 1724. In this conducting state, conductive segment 502 and conductive segment 506 will couple with corresponding segments in a parallel well pipe to heat a zone surrounding the well pipes.

In a by-pass state, segment switch 1704 electrically connects the RF energy from RF signal input port 1738 to RF signal output port 1746 so as to electrically connect to RF transmission line segment 1714. In this manner, the RF energy from transmission line segment 1712 is conducted through segment switch 1704, through transmission line segment 1714 and to segment switch 1706.

For segment switch 1706, selector line input port 1750 is arranged to electrically connect to selector line 1702, RF signal transmission port 1752 is arranged to electrically connect to RF transmission line segment 1716, RF signal output port 1754 is arranged to electrically connect to conducting line 1726 and RF signal output port 1756 is arranged to electrically connect to conducting line 1728. RF transmission line segment 1716 is additionally arranged to electrically connect to RF signal input port 1758 of segment switch 1708. Conducting line 1726 is additionally arranged to electrically connect to conductive segment 506. Conducting line 1728 is additionally arranged to electrically connect to conductive segment 604.

In operation, RF energy is transmitted down RF transmission line segment 1714 to RF signal input port 1748. A selector signal is provided to selector line input port 1750 by way of selector line 1702. The selector signal controls the state of segment switch 1706. Segment switch 1706 may be in conducting state or a by-pass state.

In a conducting state, segment switch 1706 electrically connects the RF energy from RF signal input port 1748 to RF signal output port 1754 and to RF signal output port 1756 so as to electrically connect to conducting line 1726 and conducting line 1728, respectively. For example the primary-phase center conductor of RF transmission line segment 1714 may be electrically connected to RF signal output port 1754 whereas the outer conductor of RF transmission line segment 1714 may be electrically connected to RF signal output port 1756. In this manner, conductive segment 506 will receive RF energy from conducting line 1726, whereas conductive segment 604 will receive RF energy from conducting line 1728. In this conducting state, conductive segment 506 and conductive segment 604 will couple with corresponding segments in a parallel well pipe to heat a zone surrounding the well pipes.

In a by-pass state, segment switch 1706 electrically connects the RF energy from RF signal input port 1748 to RF signal output port 1752 so as to electrically connect to RF transmission line segment 1716. In this manner, the RF energy from transmission line segment 1714 is conducted through segment switch 1706, through transmission line segment 1716 and to segment switch 1708.

For segment switch 1708, selector line input port 1760 is arranged to electrically connect to selector line 1702, RF signal transmission part 1762 is arranged to electrically connect to RF transmission line segment 1718, RF signal output port 1764 is arranged to electrically connect to conducting line 1730 and RF signal output port 1766 is arranged to electrically connect to conducting line 1732. RF transmission line segment 1718 is additionally arranged to electrically connect to RF signal input port 1768 of segment switch 1710. Conducting line 1730 is additionally arranged to electrically connect to conductive segment 604. Conducting line 1732 is additionally arranged to electrically connect to conductive segment 608.

In operation, RF energy is transmitted down RF transmission line segment 1716 to RF signal input port 1758. A selector signal is provided to selector line input port 1760 by way of selector line 1702. The selector signal controls the state of segment switch 1708. Segment switch 1708 may be in conducting state or a by-pass state.

In a conducting state, segment switch 1708 electrically connects the RF energy from RF signal input port 1758 to RF signal output port 1764 and to RF signal output port 1766 so as to electrically connect to conducting line 1730 and conducting line 1732, respectively. For example the primary-phase center conductor of RF transmission line segment 1716 may be electrically connected to RF signal output port 1764 whereas the outer conductor of RF transmission line segment 1716 may be electrically connected to RF signal output port 1766. In this manner, conductive segment 604 will receive RF energy from conducting line 1730, whereas conductive segment 608 will receive RF energy from conducting line 1732. In this conducting state, conductive segment 604 and conductive segment 608 will couple with corresponding segments in a parallel well pipe to heat a zone surrounding the well pipes.

In a by-pass state, segment switch 1708 electrically connects the RF energy from RF signal input port 1758 to RF signal output port 1762 so as to electrically connect to RF transmission line segment 1718. In this manner, the RF energy from transmission line segment 1716 is conducted through segment switch 1708, through transmission line segment 1718 and to segment switch 1710.

For segment switch 1710, selector line input port 1770 is arranged to electrically connect to selector line 1702, RF signal transmission port 1772 is arranged to electrically connect to RF transmission line segment 1720, RF signal output port 1774 is arranged to electrically connect to conducting line 1734 and RF signal output port 1776 is arranged to electrically connect to conducting line 1736. Conducting line 1734 is additionally arranged to electrically connect to conductive segment 608. Conducting line 1736 is additionally arranged to electrically connect to conductive segment 612.

In operation, RF energy is transmitted down RF transmission line segment 1718 to RF signal input port 1768. A selector signal is provided to selector line input port 1770 by way of selector line 1702. The selector signal controls the state of segment switch 1710. Segment switch 1710 may be in conducting state or a by-pass state.

In a conducting state, segment switch 1710 electrically connects the RF energy from RF signal input port 1768 to RF signal output port 1774 and to RF signal output port 1776 so as to electrically connect to conducting line 1734 and conducting line 1736, respectively. For example the primary-phase center conductor of RF transmission line segment 1718 may be electrically connected to RF signal output port 1774 whereas the outer conductor of RF transmission line segment 1718 may be electrically connected to RF signal output port 1776. In this manner, conductive segment 608 will receive RF energy from conducting line 1734, whereas conductive segment 612 will receive RF energy from conducting line 1736. In this conducting state, conductive segment 608 and conductive segment 612 will couple with corresponding segments in a parallel well pipe to heat a zone surrounding the well pipes.

In a by-pass state, segment switch 1710 electrically connects the RF energy from RF signal input port 1768 to RF signal output port 1772 so as to electrically connect to RF transmission line segment 1720. In this manner, the RF energy from transmission line segment 1714 is conducted through segment switch 1706, through transmission line segment 1716 and to the next segment switch (not shown).

In the figure, each of segment switches 1704, 1706 and 1708 are in a by-pass state such that transmission line segments 1712, 1714, 1716 and 1718 are shaded to indicate that RF energy is conducting therethrough. Segment switch 1710 is in a conducting state, wherein transmission line segment 1720 is not shaded to indicate that RF energy is not conducting therethrough. Therefore, in the figure, at time $t_5$, conductive segment 612 and conductive segment 608 are energized with RF energy, which is coupled to a secondary well pipe, as will be discussed in more detail below with reference to FIGS. 18*a-c*.

FIG. 17*b* illustrates the section of the primary-phase segmented well pipe of FIG. 17*a* at a time $t_6$.

In the figure, each of segment switches 1704 and 1706 are in a by-pass state such that transmission line segments 1712, 1714 and 1716 are shaded to indicate that RF energy is conducting therethrough. Segment switch 1708 is in a conducting state, wherein transmission line segment 1718 is not shaded to indicate that RF energy is not conducting therethrough. Because transmission line segment 1718 is not conducting RF energy, segment switch 1710 additionally fails to receive RF energy. As such, transmission line segment 1720 is additionally not shaded to indicate that RF energy is not conducting therethrough.

FIG. 17*c* illustrates the section of the primary-phase segmented well pipe of FIG. 17*a* at a time $t_7$.

In the figure, segment six switches 1704 is in a by-pass state such that transmission line segments 1712 and 1714 are shaded to indicate that RF energy is conducting therethrough. Segment switch 1706 is in a conducting state, wherein transmission line segment 1716 is not shaded to indicate that RF energy is not conducting therethrough. Because transmission line segment 1716 is not conducting RF energy, segment switch 1708 additionally fails to receive RF energy. As such, transmission line segments 1708 and 1720 are additionally not shaded to indicate that RF energy is not conducting therethrough.

The selective activation of well pipe segments of primary-phase and secondary-phase segmented well pipes will now be described with reference to FIGS. 18*a-c*.

Figure 18A:
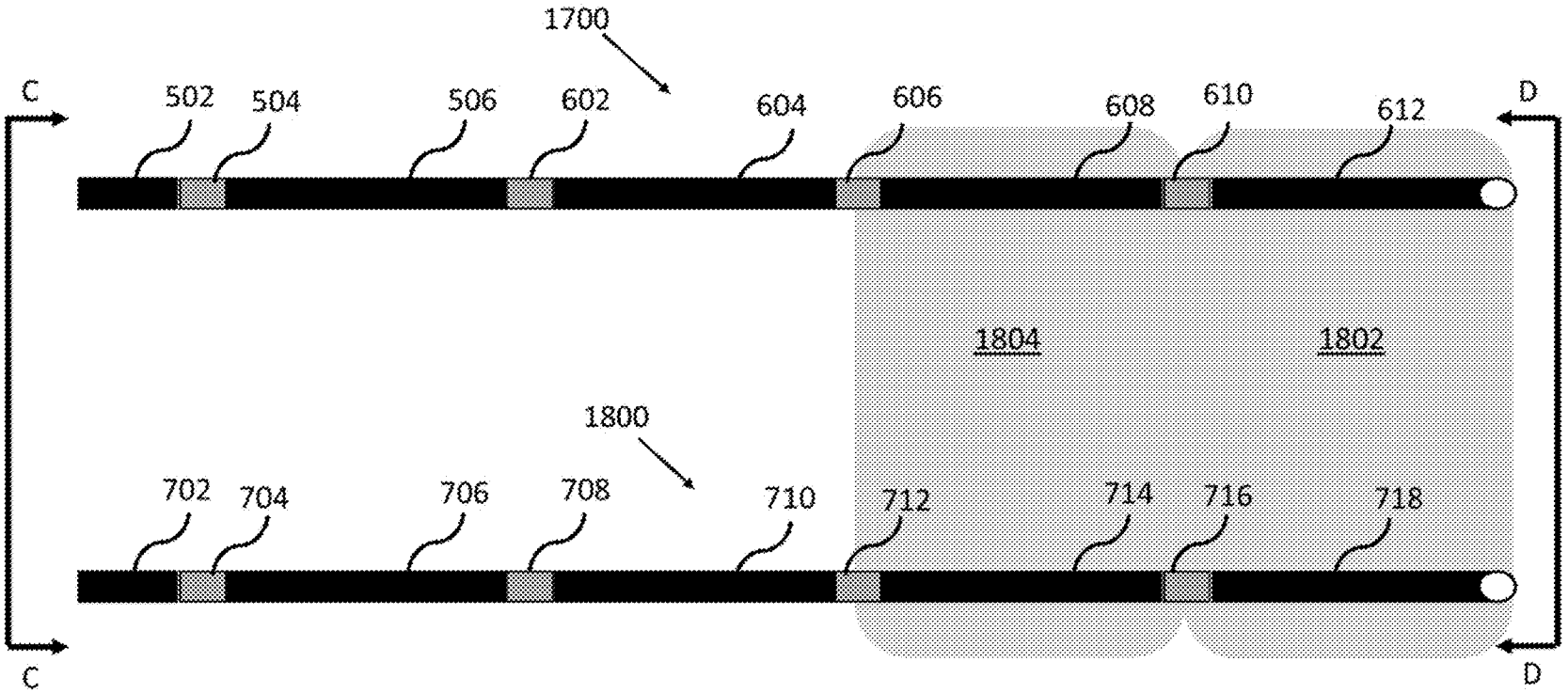
FIG. 18*a* illustrates the section of the primary-phase segmented well pipe of FIG. 17*a* and a section of a secondary-phase segmented well pipe at time $t_5$, in accordance with aspects of the present invention.
Figure 18B:
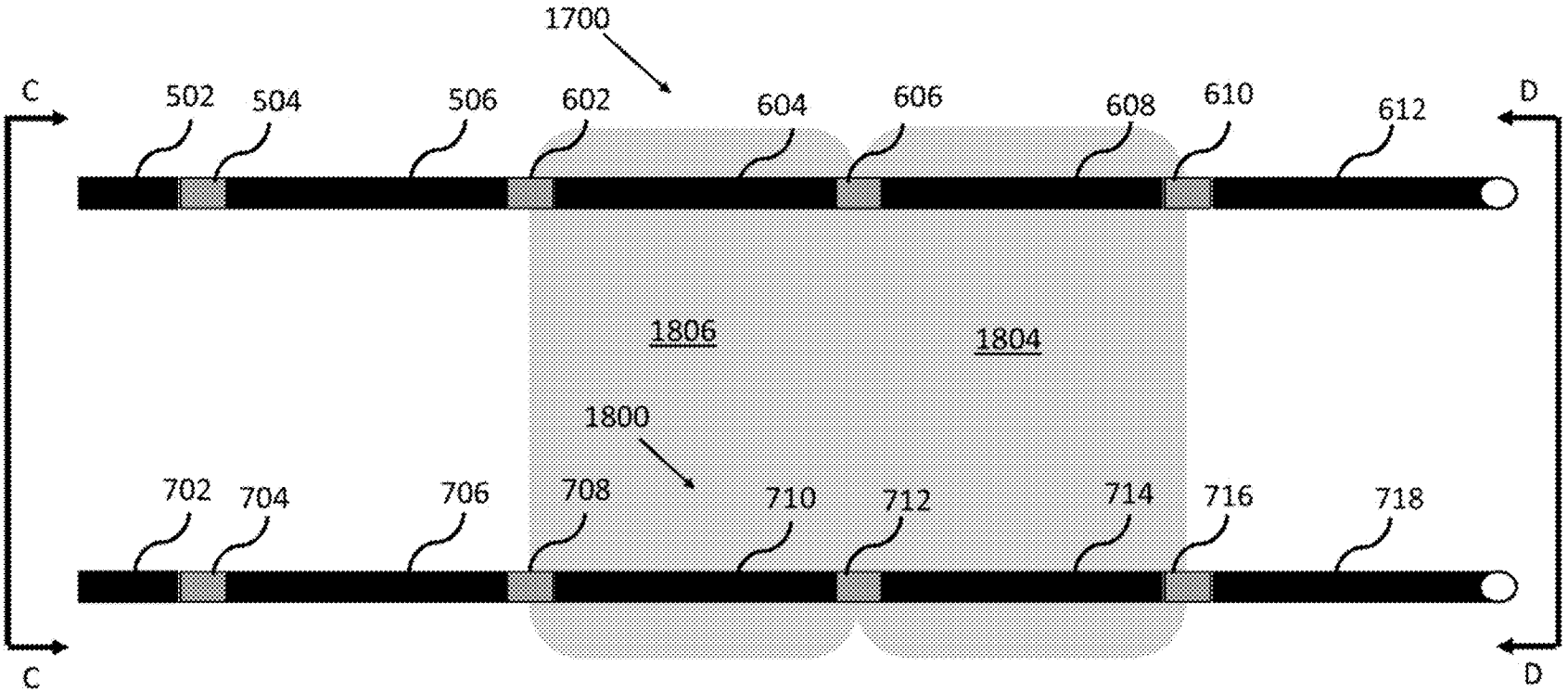
FIG. 18*b* illustrates the section of the primary-phase segmented well pipe of FIG. 17*b* and the section of the secondary-phase segmented well pipe of FIG. 18*a* at time $t_6$.
Figure 18C:
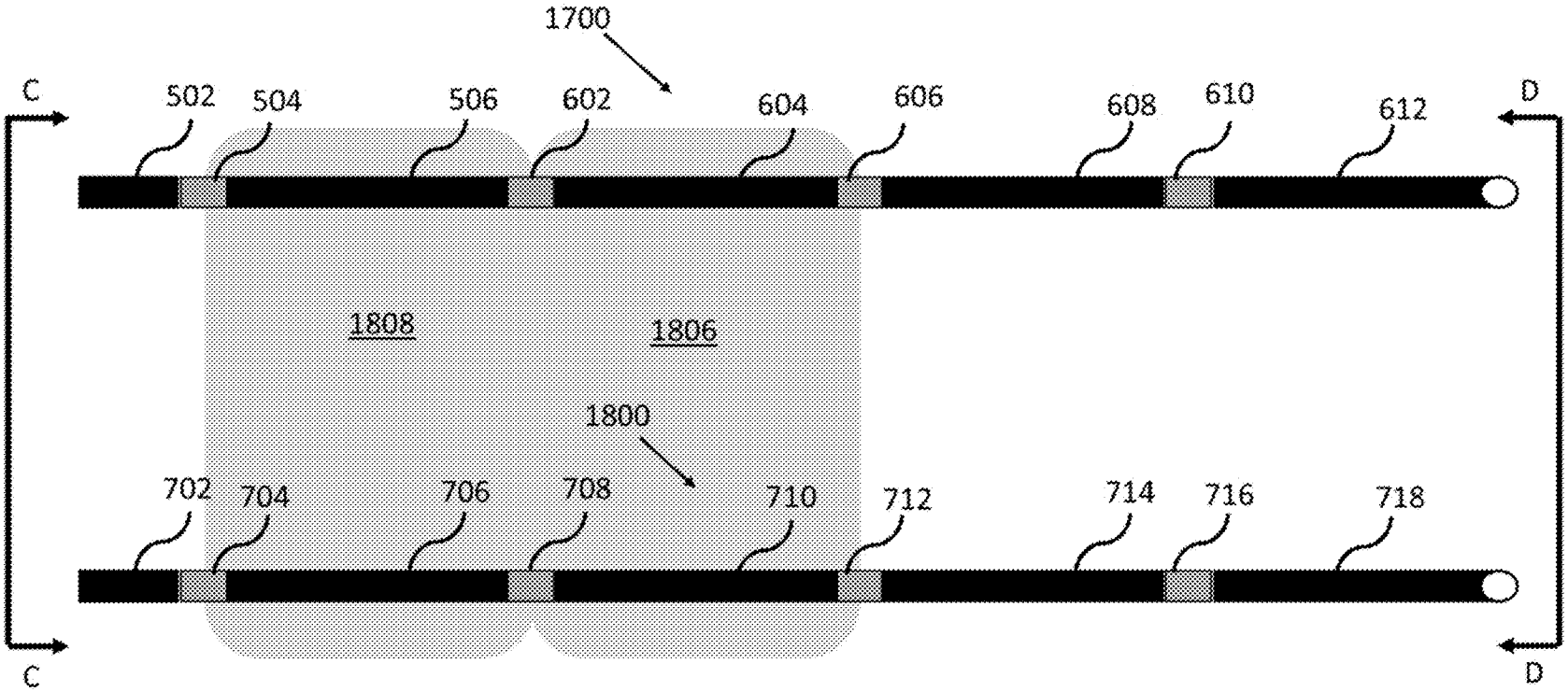
FIG. 18*c* illustrates the section of the primary-phase segmented well pipe of FIG. 17*c* and the section of the secondary-phase segmented well pipe of FIG. 18*a* at time $t_7$.

FIGS. 18*a-c* illustrates both a section of primary-phase segmented well pipe 1700 and a section of a secondary-phase segmented well pipe 1800, as would be disposed between double arrows CC and DD in FIG. 1, in accordance with aspects of the present invention.

FIG. 18*a* illustrates the section of the primary-phase segmented well pipe of FIG. 17*a* and a section of a secondary phase segmented well pipe at time $t_5$, in accordance with aspects of the present invention.

As shown in FIG. 18*a*, the section of secondary-phase segmented well pipe 1800 includes conductive segment 702, conductive segment 706, conductive segment 710, conductive segment 714, conductive segment 718, dielectric spacer 704, dielectric spacer 708, dielectric spacer 712, and dielectric spacer 716. Also shown are primary-phase segmented well pipe 1700, an RF heating zone 1802 and an RF heating zone 1804.

In this example embodiment, primary-phase segmented well pipe 1700 is parallel or nearly parallel with secondary-phase segmented well pipe 1800 throughout the heated volume in hydrocarbon bearing strata 126.

RF heating zone 1802 is a contiguous heating zone surrounding conductive segment 612 in primary-phase segmented well pipe 1700 and conductive segment 718 in secondary phase segmented well pipe 1800. RF heating zone 1804 is a contiguous heating zone surrounding conductive segment 608 in primary-phase segmented well pipe 1700 and conductive segment 714 in secondary-phase segmented well pipe 1800. Heating zones 1802 and 1804 convert kerogen in hydrocarbon bearing strata 126 to oil and gas.

After sufficient oil and gas are removed from RF heating zone 1802, the heating zones may be shifted along the well pipes. In some embodiments, a sufficient amount of oil and gas will have been determined to have been removed from RF heating zone 1802 after a predetermined period of time. In some embodiments, a sufficient amount of oil and gas will have been determined to have been removed from RF heating zone 1802 after a predetermined amount of oil and gas is removed. In some embodiments, a sufficient amount of oil and gas will have been determined to have been removed from RF heating zone 1802 after the rate of oil and gas being removed drops below a predetermined threshold.

In an example embodiment, RF heating zones are heated on a double cycle. In this example embodiment, shown in FIG. 18A, the heating at time $t_5$ is a second cycle for heating RF heating zone 1802. In a previous cycle (not shown) another segment of well pipes will additionally have been heated with RF heating zone 1802. At time $t_5$, the heating zones shift (to the left of the image of FIG. 18*a*) such that conductive segment 612 and conductive segment 718 heat RF heating zone 1802 and such that conductive segment 608 and conductive segment 714 heat RF heating zone 1804. At time $t_6$, the heating zones will again shift to the left of the image of FIG. 18*a*. This will be described in greater detail with reference to FIG. 18*b*.

FIG. 18*b* illustrates the section of the primary-phase segmented well pipe of FIG. 17*b* and the section of the secondary-phase segmented well pipe of FIG. 18*a* at time $t_6$.

As shown in FIG. 18*b*, RF heating zone 1802 is no longer present. However, FIG. 18*b* includes an RF heating zone 1806.

RF heating zone 1806 is a contiguous heating zone surrounding conductive segment 604 in primary-phase segmented well pipe 1700 and conductive segment 710 in secondary-phase segmented well pipe 1800. Heating zones 1804 and 1806 convert kerogen in hydrocarbon bearing strata 126 to oil and gas.

Again, after sufficient oil and gas are removed from RF heating zone 1804, the heating zones may be shifted along the well pipes. At time $t_6$, the heating zones were shifted (to the left of the image of FIG. 18*b*) such that conductive segment 608 and conductive segment 714 heat RF heating zone 1804 and such that conductive segment 604 and conductive segment 710 heat RF heating zone 1806. At time $t_7$, the heating zones will again shift to the left of the image of FIG. 18*b*. This will be described in greater detail with reference to FIG. 18*c*.

FIG. 18*c* illustrates the section of the primary-phase segmented well pipe of FIG. 17*c* and the section of the secondary-phase segmented well pipe of FIG. 18*a* at time $t_7$.

As shown in FIG. 18*c*, RF heating zone 1804 is no longer present. However, FIG. 18*c* includes an RF heating zone 1808.

RF heating zone 1808 is a contiguous heating zone surrounding conductive segment 506 in primary-phase segmented well pipe 1700 and conductive segment 706 in secondary-phase segmented well pipe 1800. Heating zones 1806 and 1808 convert kerogen in hydrocarbon bearing strata 126 to oil and gas.

Again, after sufficient oil and gas are removed from RF heating zone 1806, the heating zones may be shifted along the well pipes. This heating, shifting, heating process continues until the entire volume of hydrocarbon bearing strata 126 surrounding the well pipes have been liberated of oil and gas.

In the embodiments discussed above with reference to FIGS. 17*a*-18*c*, a system having a plurality of segment switches is used to selectively activate coupled well pipe segments. However, in other embodiments a single switch is used to selectively activate coupled well pipe segments. This will be described in greater detail with reference to FIG. 19.

Figure 19:
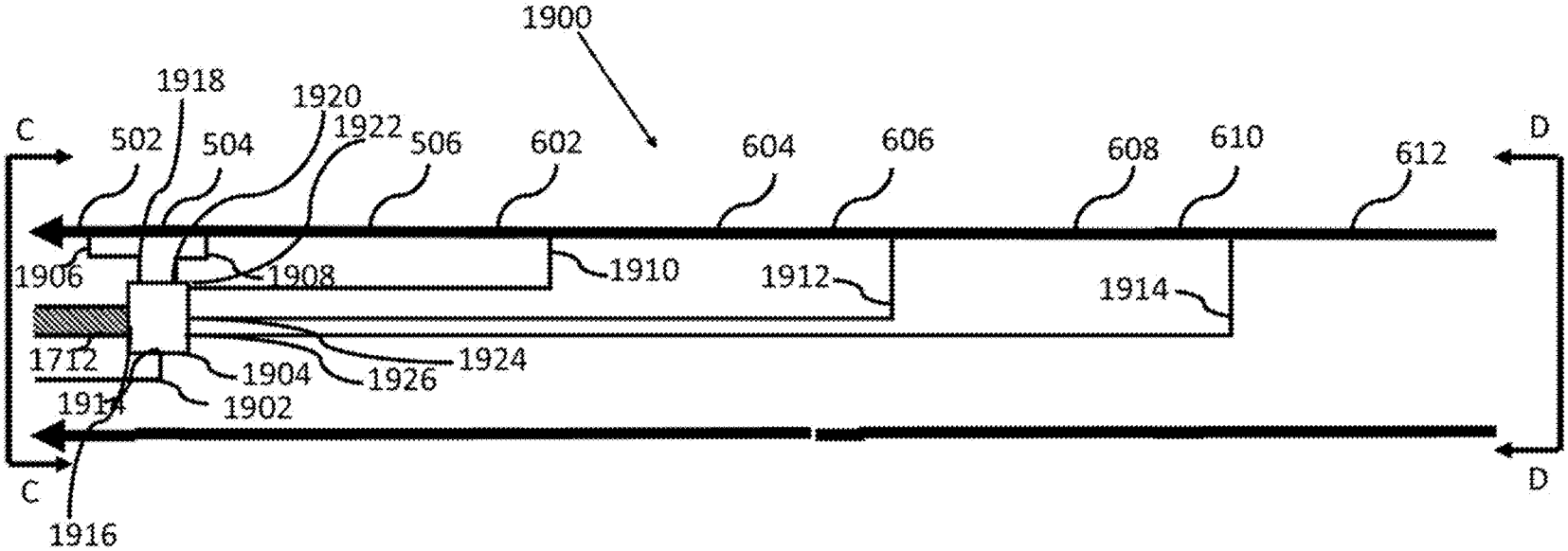
FIG. 19 illustrates a section of another primary-phase segmented well pipe, in accordance with aspects of the present invention.

FIG. 19 illustrates a section of another primary-phase segmented well pipe 1900, in accordance with aspects of the present invention.

As shown in FIG. 19, segmented well pipe section 1900 includes conductive segment 502, conductive segment 506, conductive segment 604, conductive segment 608, conductive segment 612, dielectric spacer 504, dielectric spacer 602, dielectric spacer 606, and dielectric spacer 610, arranged in a manner similar to the embodiment discussed above with reference to FIGS. 17*a*-*c*.

However, in this embodiment, segmented well pipe section 1900 does not have a plurality of segment switches. On the contrary, in the embodiment of FIG. 19, segmented well pipe section 1900 further includes a selector line 1902, a segment switch 1904, RF transmission line segment 1712, a conducting line 1906, a conducting line 1908, a conducting line 1910, a conducting line 1912 and a conducting line 1914.

Segment switch 1904 includes an RF signal input port 1914, a selector line input port 1916, an RF signal output port 1918, an RF signal output port 1920, an RF signal output port 1922, an RF signal output port 1924 and an RF signal output port 1926.

RF signal input port 1914 is arranged to electrically connect to RF transmission line segment 1712, selector line input port 1916 is arranged to electrically connect to selector line 1902, RF signal output port 1918 is arranged to electrically connect to conducting line 1906, RF signal output port 1920 is arranged to electrically connect to conducting line 1908. RF signal output port 1922 is arranged to electrically connect to conducting line 1910, RF signal output port 1924 is arranged to electrically connect to conducting line 1912 and RF signal output port 1926 is arranged to electrically connect to conducting line 1914.

Conducting line 1906 is additionally arranged to electrically connect to conductive segment 502. Conducting line 1908 is additionally arranged to electrically connect to conductive segment 506. Conducting line 1910 is additionally arranged to electrically connect to conductive segment 604. Conducting line 1912 is additionally arranged to electrically connect to conductive segment 608. Conducting line 1914 is additionally arranged to electrically connect to conductive segment 612.

The representation of FIG. 19 is for discussion purposes only, wherein segment switch 1904 may be positioned anywhere within segmented well pipe 1900. Further, segment switch 1904 may include additional ports (not shown) that are arranged to electrically connect to additional conductive segments (not shown), which are then arranged to connect to other conductive segments (not shown) along segmented well pipe 1900. Accordingly, one of skill in the art would recognize that the section of segmented will pipe 1900 in FIG. 19 is used to illustrate the operation of a single segment switch without limiting such operation to five well pipe segments.

In operation, RF energy is transmitted down RF transmission line segment 1712 to RF signal input port 1914. A selector signal is provided to selector line input port 1916 by way of selector line 1902. The selector signal controls the state of segment switch 1904. Segment switch 1904 may be in one of many conducting states.

For example, in one conducting state, segment switch 1904 electrically connects the RF energy from RF signal input port 1916 to RF signal output port 1924 and to RF signal output port 1926 so as to electrically connect to conducting line 1912 and conducting line 1914, respectively. For example the primary-phase center conductor of RF transmission line segment 1712 may be electrically connected to RF signal output port 1924 whereas the outer conductor of RF transmission line segment 1712 may be electrically connected to RF signal output port 1926. In this manner, conductive segment 608 will receive RF energy from conducting line 1912, whereas conductive segment 612 will receive RF energy from conducting line 1914. In this conducting state, conductive segment 608 and conductive segment 612 will couple with corresponding segments in a parallel well pipe to heat a zone surrounding the well pipes.

This conducting state would correspond to the operation of heating a volume of hydrocarbon bearing strata surrounding well pipes in a manner similar to that discussed above with reference to FIG. 18*a*. In this example embodiment, in this conducting state, the heating zones surround conductive segment 612 and conductive segment 608.

After sufficient oil and gas are removed from the RF heating zone while segment switch 1904 is in this conductive state, the heating zones may be shifted along well pipe 1900 by changing the conducting state of segment switch 1904 by way of a selector signal provided by selector line 1902.

For example, in another conducting state, segment switch 1904 electrically connects the RF energy from RF signal input port 1916 to RF signal output port 1922 and to RF signal output port 1924 so as to electrically connect to conducting line 1910 and conducting line 1912, respectively. For example the primary-phase center conductor of RF transmission line segment 1712 may be electrically connected to RF signal output port 1922 whereas the outer conductor of RF transmission line segment 1712 may be electrically connected to RF signal output port 1924. In this manner, conductive segment 604 will receive RF energy from conducting line 1910, whereas conductive segment 608 will receive RF energy from conducting line 1912. In this conducting state, conductive segment 604 and conductive segment 608 will couple with corresponding segments in a parallel well pipe to heat a zone surrounding the well pipes.

This conducting state would correspond to the operation of heating a volume of hydrocarbon bearing strata surrounding well pipes in a manner similar to that discussed above with reference to FIG. 18*b*. In this example embodiment, in this conducting state, the heating zones surround conductive segment 604 and conductive segment 608.

After sufficient oil and gas are removed from the RF heating zone while segment switch 1904 is in this conductive state, the heating zones may again be shifted along well pipe 1900 by again changing the conducting state of segment switch 1904 by way of a selector signal provided by selector line 1902.

In another conducting state, segment switch 1904 electrically connects the RF energy from RF signal input port 1916 to RF signal output port 1920 and to RF signal output port 1922 so as to electrically connect to conducting line 1908 and conducting line 1910, respectively. For example the primary-phase center conductor of RF transmission line segment 1712 may be electrically connected to RF signal output port 1920 whereas the outer conductor of RF transmission line segment 1712 may be electrically connected to RF signal output port 1922. In this manner, conductive segment 506 will receive RF energy from conducting line 1908, whereas conductive segment 604 will receive RF energy from conducting line 1910. In this conducting state, conductive segment 506 and conductive segment 604 will couple with corresponding segments in a parallel well pipe to heat a zone surrounding the well pipes.

This conducting state would correspond to the operation of heating a volume of hydrocarbon bearing strata surrounding well pipes in a manner similar to that discussed above with reference to FIG. 18*c*. In this example embodiment, in this conducting state, the heating zones surround conductive segment 506 and conductive segment 604.

After sufficient oil and gas are removed from the RF heating zone while segment switch 1904 is in this conductive state, the heating zones may again be shifted along well pipe 1900 by again changing the conducting state of segment switch 1904 by way of a selector signal provided by selector line 1902. This heating, shifting, heating process continues until the entire volume of hydrocarbon bearing strata 126 surrounding the well pipes have been liberated of oil and gas.

An aspect of the invention discussed above with reference to FIGS. 17*a*-19 is drawn to selectively actuating well pipe segments in order to heat the length of coupled segmented well pipes. Another aspect of the invention is drawn to modulating the coupling of plural segmented well pipes in order to increase the overall volume of hydrocarbon strata. This will be described with reference to FIGS. 20*a*-21*c*.

Figure 20C:
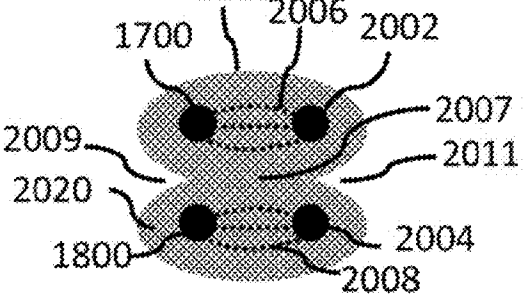
FIG. 20*c* illustrates the four-wire transmission line formed from well pipes of FIG. 20*a* at a time $t_{10}$.
Figure 20B:
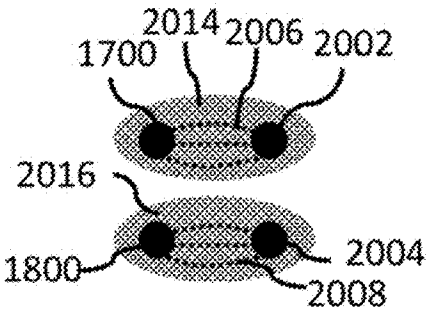
FIG. 20*b* illustrates the four-wire transmission line formed from well pipes of FIG. 20*a* at a time $t_9$.
Figure 20A:
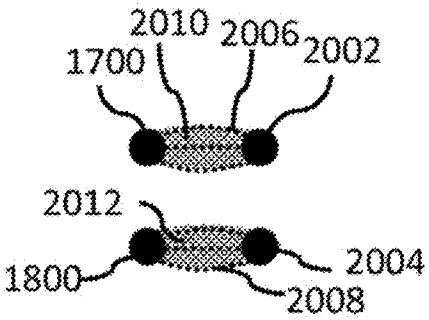
FIG. 20*a* illustrates a four-wire transmission hue formed from well pipes at a time $t_8$, in accordance with aspects of the present invention.

FIG. 20*a* illustrates a four-wire transmission line formed from well pipes at a time $t_8$, in accordance with aspects of the present invention. As used herein, the phrase "primary-phase" with respect to a primary-phase segmented well pipe (or section of well pipe) refers to one of two RF coupled segmented well pipes and the phrase "secondary-phase" with respect to a secondary-phase segmented well pipe (or section of well pipe) refers to the other of the two RF coupled segmented well pipes, wherein the primary-phase segmented well pipe is providing an RF signal that is 180° out of phase with the RF signal provided by the secondary-phase segmented well pipe. One segmented well pipe in a coupled pair of segmented well pipes is arbitrarily assigned the identifier "primary-phase" segmented well pipe, whereas the other segmented well pipe in the coupled pair of segmented well pipes is then assigned the other identifier "secondary-phase" segmented well pipe.

FIG. 20*a* includes segmented well pipe 1700, segmented well pipe 1800, segmented well pipe 2002 and segmented well pipe 2004. Also shown in the figure are RF field lines 2006, RF field lines 2008, heated area 2010 and heated area 2012. It should be noted that the RF field lines extend much farther out than shown in the figure, Only the highest field strength lines are shown for clarity. The further the fields are from the segmented well pipes, the more the field strength is reduced. Similarly, for the heated zones, only the areas of high heating are shown.

In this example, at time $t_8$, segmented well pipe 1700 is coupled to segmented well pipe 2002 such that RF fields couple from segmented well pipe 1700 to segmented well pipe 2002 as shown by field lines 2006. For purposes of discussion, in this example at time $t_8$, segmented well pipe 1700 is a primary-phase segmented will pipe whereas segmented well pipe 2002 is a secondary-phase segmented well pipe.

In this example, at time $t_8$, segmented well pipe 1800 is coupled to segmented well pipe 2004 such that RF fields couple from secondary-phase segmented well pipe 1800 to segmented well pipe 2004 as shown by field lines 2008. For purposes of discussion, in this example at time $t_8$, segmented well pipe 1800 is a primary-phase segmented will pipe whereas segmented well pipe 2004 is a secondary-phase segmented well pipe.

As shown in the figure, portions of volume of hydrocarbon bearing strata that are being heated are highest in heated area 2010 disposed between coupled primary-phase segmented well pipe 1700 and secondary-phase segmented well pipe 2002, and heated area 2012 disposed between coupled segmented primary-phase segmented well pipe 1800 and secondary-phase segmented well pipe 2004. As the RF coupling is maintained the volume of heated hydrocarbon bearing strata will increase from a combination of conduction from the hottest volumes where the RF fields are strongest and continued RF heating by the less intense fields. This will be described in greater detail with reference to FIG. 20*b*.

FIG. 20*b* illustrates the four-wire transmission line formed from well pipes of FIG. 20*a* at a time $t_9$.

In FIG. 20*b*, heated area 2010 and heated area 2012 of FIG. 20*a* have been replaced with larger heated areas 2014 and 2016, respectively.

In this example, at time $t_9$, primary-phase segmented well pipe 1700 is still coupled to secondary-phase segmented well pipe 2002 such that RF fields couple from primary-phase segmented well pipe 1700 to secondary-phase segmented well pipe 2002 as shown by field lines 2006. Similarly, primary-phase segmented well pipe 1800 is still coupled to secondary-phase segmented well pipe 2004 such that RF fields couple from primary-phase segmented well pipe 1800 to secondary-phase segmented well pipe 2004 as shown by field lines 2008.

As shown in the figure, portions of volume of hydrocarbon bearing strata that is being heated has grown to heated area 2014 disposed around coupled primary-phase segmented well pipe 1700 and secondary-phase segmented well pipe 2002, and heated area 2016 disposed around coupled primary-phase segmented well pipe 1800 and secondary-phase segmented well pipe 2004. As the RF coupling is maintained the volume of heated hydrocarbon bearing strata will still further increase from a combination of conduction from the hottest volumes where the RF fields are strongest and continued RF heating by the less intense fields. This will be described in greater detail with reference to FIG. 20*c*.

FIG. 20*c* illustrates the four-wire transmission line formed from well pipes of FIG. 20*a* at a time $t_{10}$.

In FIG. 20*c*, heated area 2014 and heated area 2016 of FIG. 20*b* have been replaced with even larger heated areas 2018 and 2020, respectively.

In this example, at time $t_{10}$, primary-phase segmented well pipe 1700 still remains coupled to secondary-phase segmented well pipe 2002 such that RF fields couple from primary-phase segmented well pipe 1700 to secondary-phase segmented well pipe 2002 as shown by field lines 2006. Similarly, primary-phase segmented well pipe 1800 still remains coupled to secondary-phase segmented well pipe 2004 such that RF fields couple from primary-phase segmented well pipe 1800 to secondary-phase segmented well pipe 2004 as shown by field lines 2008.

As shown in the figure, portions of volume of hydrocarbon bearing strata that is being heated has greatly grown to heated area 2018 disposed around coupled primary-phase segmented well pipe 1700 and secondary-phase segmented well pipe 2002, and heated area 2020 disposed around coupled primary-phase segmented well pipe 1800 and secondary-phase segmented well pipe 2004. Further, heated area 2018 and 2020 are sufficiently large so as to heat a volume of hydrocarbon bearing strata, illustrated as area 2007, from between primary-phase segmented well pipe 1700 and primary phase segmented well pipe 1800 to secondary-phase segmented well pipes 2002 to 2004. However, even as large as heated area 2018 and heated area 2020 are, there still remains some heated areas that are not heated, namely area 2009 and 2011. In order to maximize the heated area, the coupling of the well pipe segments may be modulated, or changed, in order to change the heating area. This will be described in greater detail with reference to FIGS. 21*a-c*.

Figure 21C:
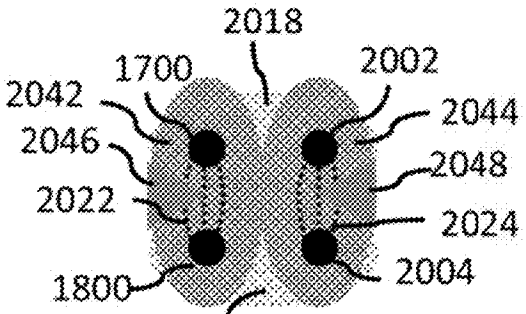
FIG. 21*c* illustrates the four-wire transmission line formed from well pipes of FIG. 20*a* at a time $t_{13}$.
Figure 21B:
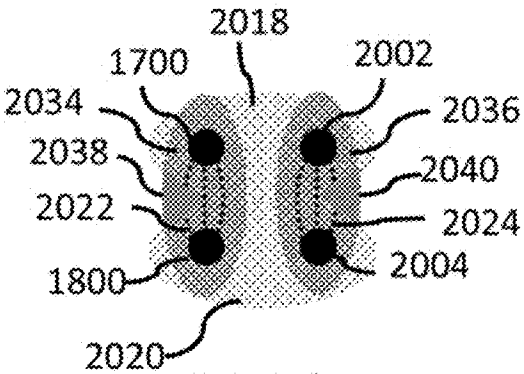
FIG. 21*b* illustrates the four-wire transmission line formed from well pipes of FIG. 20*a* at a time $t_{12}$.
Figure 21A:
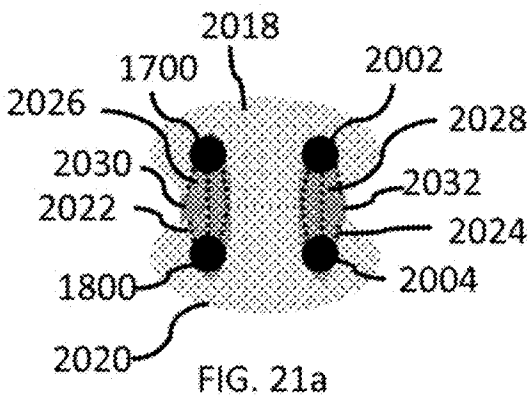
FIG. 21*a* illustrates the four-wire transmission line formed from well pipes of FIG. 20*a* at a time $t_{11}$, in accordance with aspects of the present invention.

FIG. 21*a* illustrates the four-wire transmission line formed from well pipes of FIG. 20*a* at a time $t_{11}$, in accordance with aspects of the present invention.

FIG. 21*a* includes segmented well pipe 1700, segmented well pipe 1800, segmented well pipe 2002 and segmented well pipe 2004. Also shown in the figure are RF field lines 2022, RF field lines 2024, previously heated area 2018, previously heated area 2020, heated area 2026 and heated area 2028. Similar to that noted above for FIG. 20, the RF field lines extend much farther out than shown in the figure. Only the highest field strength lines are shown for clarity. The further the fields are from the segmented well pipes, the more the field strength is reduced. Similarly, for the heated zones, only the areas of high heating are shown.

In this example, at time $t_{11}$, segmented well pipe 1700 is again a primary-phase segmented well pipe, but is now coupled to segmented well pipe 1800, which is now a secondary-phase segmented well pipe, such that RF fields couple from primary-phase segmented well pipe 1700 to secondary-phase segmented well pipe 1800 as shown by field lines 2022. Further, segmented well pipe 2002 is now a primary-phase segmented well pipe, and is now coupled to segmented well pipe 2004, which is now a secondary-phase segmented well pipe, such that RF fields couple from primary-phase segmented well pipe 2002 to secondary-phase segmented well pipe 2004 as shown by field lines 2024.

As shown in the figure, portions of volume of hydrocarbon bearing strata that is being heated by high RF fields for the first time is limited to portion 2030 of heated area 2026 disposed between coupled primary-phase segmented well pipe 1700 and secondary-phase segmented well pipe 1800, and portion 2032 of heated area 2028 disposed between coupled primary-phase segmented well pipe 2002 and secondary-phase segmented well pipe 2004. As the RF coupling is maintained the volume of heated hydrocarbon bearing strata will increase from a combination of conduction from the hottest volumes where the RF fields are strongest and continued RF heating by the less intense fields. This will be described in greater detail with reference to FIG. 21*b*.

FIG. 21*b* illustrates the four-wire transmission line formed from well pipes of FIG. 20*a* at a time $t_{12}$.

In FIG. 21*b*, heated area 2026 and heated area 2028 of FIG. 21*a* have been replaced with larger heated areas 2034 and 2036, respectively.

In this example, at time $t_{12}$, primary-phase segmented well pipe 1700 is still coupled to secondary-phase segmented well pipe 1800 such that RF fields couple from primary-phase segmented well pipe 1700 to secondary-phase segmented well pipe 1800 as shown by field lines 2022. Similarly, primary-phase segmented well pipe 2002 is still coupled to secondary-phase segmented well pipe 2004 such that RF fields couple from primary-phase segmented well pipe 2002 to secondary-phase segmented well pipe 2004 as shown by field lines 2024.

As shown in the figure, portions of volume of hydrocarbon bearing strata that is receiving significant heating for the first time has now grown as portion 2038 of heated area 2034 disposed between coupled primary-phase segmented well pipe 1700 and secondary-phase segmented well pipe 1800, and portion 2040 of heated area 2036 disposed between coupled primary-phase segmented well pipe 2002 and secondary-phase segmented well pipe 2004. As the RF coupling is maintained the volume of heated hydrocarbon bearing strata will still further increase from a combination of conduction from the hottest volumes where the RF fields are strongest and continued RF heating by the less intense fields. This will be described in greater detail with reference to FIG. 21*c*.

FIG. 21*c* illustrates the four-wire transmission line formed from well pipes of FIG. 20*a* at a time $t_{13}$.

In FIG. 21*c*, heated area 2034 and heated area 2036 of FIG. 21*b* have been replaced with larger heated areas 2042 and 2044, respectively.

In this example, at time $t_{13}$, primary-phase segmented well pipe 1700 is still coupled to secondary-phase segmented well pipe 1800 such that RF fields couple from primary-phase segmented well pipe 1700 to secondary-phase segmented well pipe 1800 as shown by field lines 2022. Similarly, primary-phase segmented well pipe 2002 is still coupled to secondary-phase segmented well pipe 2004 such that RF fields couple from primary-phase segmented well pipe 2002 to secondary-phase segmented well pipe 2004 as shown by field lines 2024.

As shown in the figure, portions of volume of hydrocarbon bearing strata that is receiving significant heating for the first time has now grown to include portion 2046 of heated area 2042 disposed between coupled primary-phase segmented well pipe 1700 and secondary-phase segmented well pipe 1800, and portion 2048 of heated area 2044 disposed between coupled primary-phase segmented well pipe 2002 and secondary-phase segmented well pipe 2004.

As shown above, switching between a horizontal well pipe coupling arrangement, as illustrated in FIGS. 20*a-c*, to a vertical well pipe coupling arrangement, as illustrated in FIGS. 21*a-c*, maximizes the area of hydrocarbon bearing strata being heated to collect gas and oil.

As should be obvious to one of skill in the art, the primary phase and secondary phase segmented well pipes need not always be 180° degrees apart in phase. Other phase differences may be used as required to control the heating.

As mentioned previously with reference to FIGS. 8*a-e*, some embodiments of the present invention may include the use of more than four well pipe segments. In accordance with another aspect of the present invention, if a matrix of more than 4 well segmented well pipes is used, e.g., more than a 2×2 matrix, then the spacing between the arranged segmented well pipes may be adjusted to account for conductive heating. This will be described in greater detail with reference to FIGS. 22*a-c*.

Figure 22A:
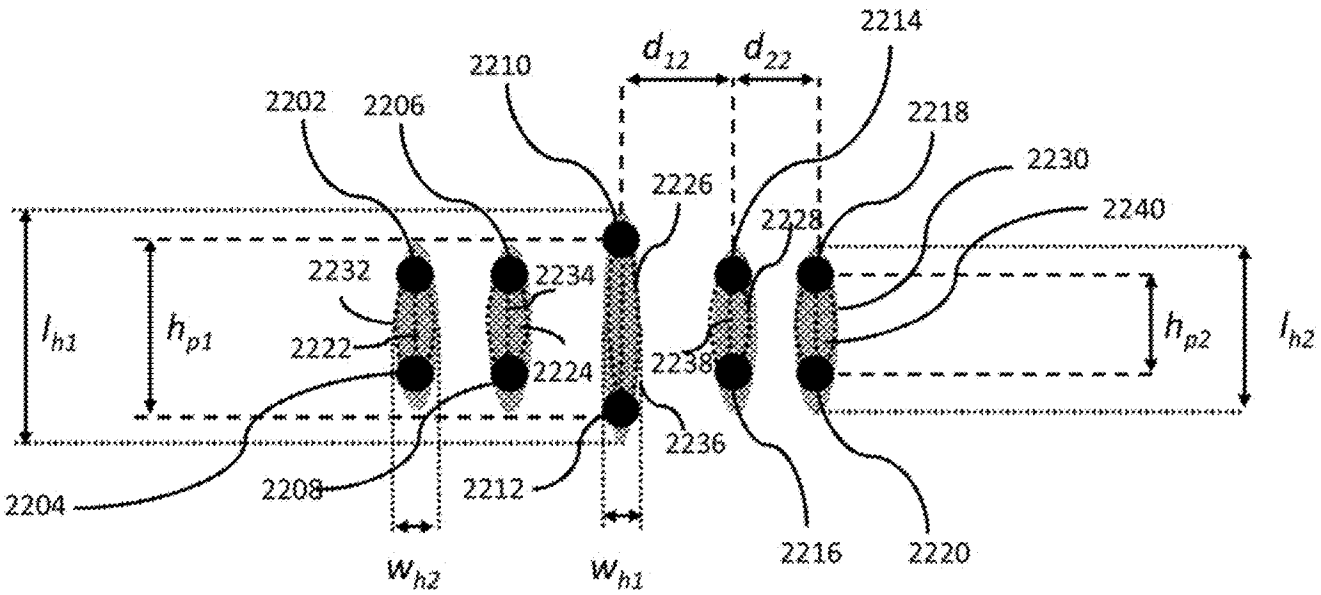
FIG. 22*a* illustrates a six-wire transmission line formed from well pipes at a time $t_{14}$, in accordance with aspects of the present invention.

FIG. 22*a* illustrates a ten-wire transmission line formed from well pipes at a time $t_{14}$, in accordance with aspects of the present invention.

FIG. 22*a* includes a primary-phase segmented well pipe 2202, a secondary-phase segmented well pipe 2204, a primase-phase segmented well pipe 2206, a secondary-phase segmented well pipe 2200, a primary-phase segmented well pipe 2210, a secondary-phase segmented well pipe 2212, a primary phase segmented well pipe 2214, a secondary-phase segmented well pipe 2216, a primary-phase segmented well pipe 2218, and a secondary-phase segmented well pipe 2020. Also shown in the figure are RF field lines 2222, RF field lines 2224, RF field lines 2226, RF field lines 2228, RF field lines 2230, a heated area 2232, a heated area 2234, a heated area 2236, a heated area 2238 and a heated area 2240. Similarly as discussed above with reference to FIGS. 20*a-c*, the RF field lines extend much farther out than shown in the figure. Only the highest field strength lines are shown for clarity. The further the fields are from the segmented well pipes, the more the field strength is reduced. Similarly, for the heated zones, only the areas of high heating are shown.

In this example, at time $t_{14}$, primary-phase segmented well pipe 2202 is coupled to secondary-phase segmented well pipe 2204 such that RF fields couple from primary-phase segmented well pipe 2202 to secondary-phase segmented well pipe 2204 as shown by field lines 2222. Similarly: primary-phase segmented well pipe 2206 is coupled to secondary-phase segmented well pipe 2208 such that RF fields couple from primary-phase segmented well pipe 2206 to secondary-phase segmented well pipe 2208 as shown by field lines 2224; primary-phase segmented well pipe 2210 is coupled to secondary-phase segmented well pipe 2212 such that RF fields couple from primary-phase segmented well pipe 2210 to secondary-phase segmented well pipe 2212 as shown by field lines 2226; primary-phase segmented well pipe 2214 is coupled to secondary-phase segmented well pipe 2216 such that RF fields couple from primary-phase segmented well pipe 2214 to secondary-phase segmented well pipe 2216 as shown by field lines 2228; and primary-phase segmented well pipe 2218 is coupled to secondary-phase segmented well pipe 2220 such that RF fields couple from primary-phase segmented well pipe 2218 to secondary-phase segmented well pipe 2220 as shown by field lines 2230.

In this example embodiment, primary phase segmented well pipe 2210 is separated from segmented well pipe 2212 by a pipe distance, $h_{p1}$. Primary-phase segmented well pipe 2202 is separated from segmented well pipe 2204 by a pipe distance, wherein $h_{p2}$, wherein $h_{p1}>h_{p2}$. Further, primary-phase segmented well pipe 2206 is separated from segmented well pipe 2208, primary-phase segmented well pipe 2214 is separated from segmented well pipe 2216 and primary-phase segmented well pipe 2218 is separated from segmented well pipe 2220, by pipe distance, $h_{p2}$.

Heated area 2236 around coupled primary-phase segmented well pipe 2210 and secondary-phase segmented well pipe 2212 has a generally oval shape with a length of its major axis as $l_{h1}$, and with a width of its minor axis as $w_{h1}$. The remaining heating areas, 2232, 2234, 2238 and 2240 additionally have a generally oval shape with a length of its major axis as $l_{h2}$ and with a width of its minor axis as $w_{h2}$. Here, $l_{p1}>l_{p2}$ because pipe distance, $h_{p1}$ between primary-phase segmented well pipe 2210 and secondary-phase segmented well pipe 2212 is greater than pipe distance, $h_{p2}$ between, for example, primary-phase segmented well pipe 2214 and secondary-phase segmented well pipe 2216. However, $w_{h1}<w_{h2}$ because the magnitude of the RF fields between primary-phase segmented well pipe 2210 and secondary-phase segmented well pipe 2212 is smaller when compared to the RF fields between, for example, primary-phase segmented well pipe 2214 and secondary-phase segmented well pipe 2216. Again, it is the RF fields that initially heat the volume around coupled segmented well pipes.

In this example embodiment, coupled primary-phase segmented well pipe 2210 and secondary-phase segmented well pipe 2212 are separated from coupled segmented primary-phase segmented well pipe 2214 and secondary-phase segmented well pipe 2216 by a coupled pipe distance, $d_{12}$. Similarly, coupled primary-phase segmented well pipe 2210 and secondary-phase segmented well pipe 2212 are separated from coupled primary-phase segmented well pipe 2206 and secondary-phase segmented well pipe 2208 by coupled pipe distance, $d_{12}$. However, coupled primary-phase segmented well pipe 2214 and secondary-phase segmented well pipe 2216 are separated from coupled primary-phase segmented well pipe 2218 and secondary-phase segmented well pipe 2220 by a coupled pipe distance, $d_{22}$, wherein $d_{12}>d_{22}$. Similarly, coupled segmented primary-phase segmented well pipe 2206 and secondary-phase segmented well pipe 2208 are separated from coupled primary-phase segmented well pipe 2202 and secondary-phase segmented well pipe 2204 by coupled pipe distance, $d_{22}$.

Figure 22B:
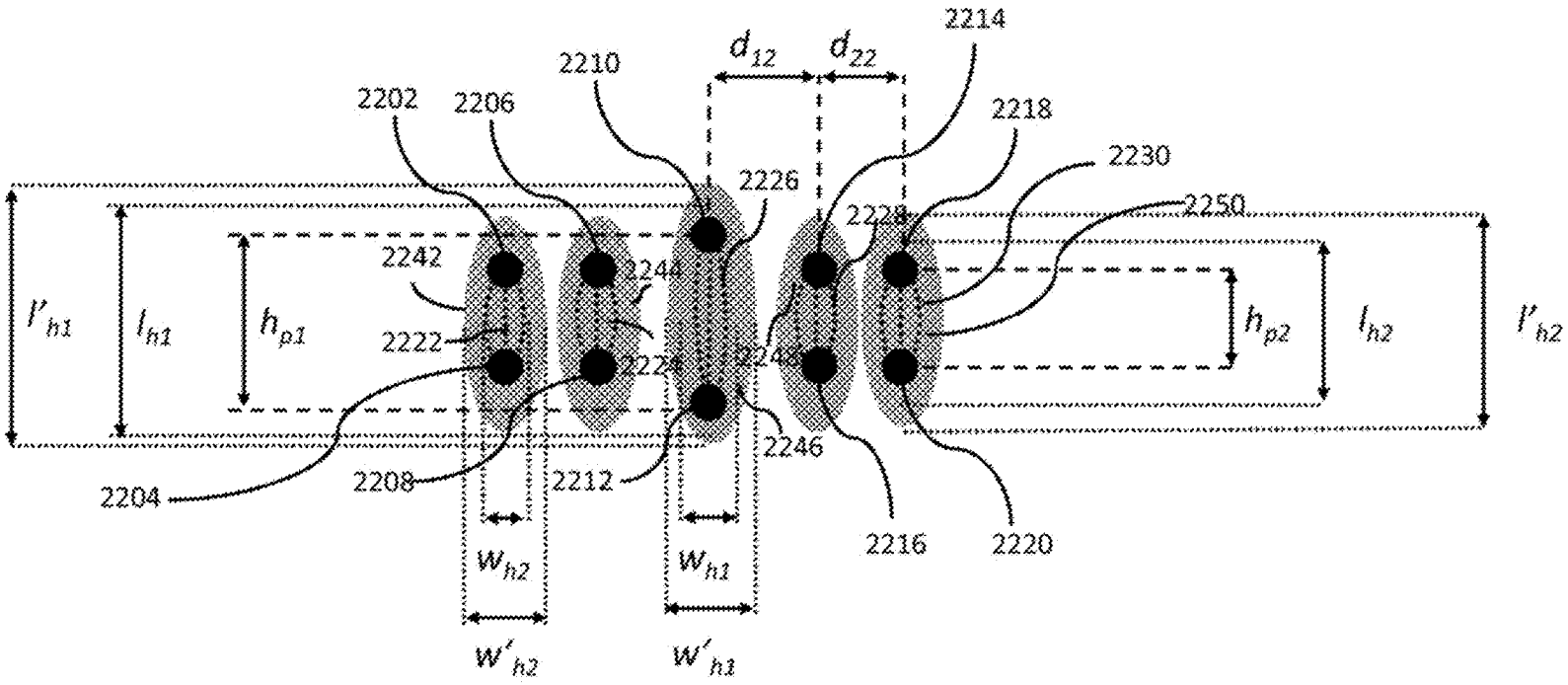
FIG. 22*b* illustrates the six-wire transmission line formed from well pipes of FIG. 22*a* at a time $t_{15}$.

FIG. 22*b* illustrates the ten-wire transmission line formed from well pipes of FIG. 22*a* at a time $t_{15}$.

In FIG. 22*b*, heated area 2232, heated area 2234, heated area 2236, heated area 2238 and heated area 2240 of FIG. 22*a* have been replaced with larger healed areas 2242, 2244, 2246, 2248 and 2250, respectively.

Heated area 2246 around coupled primary-phase segmented well pipe 2210 and secondary-phase segmented well pipe 2212 is larger, than heated area 2236 as shown in FIG. 22*a*, but still has a generally oval shape with a length of its major axis as $l'_{h1}$ and with a width of its minor axis as $w'_{h1}$. With continued RF energy coupling between primary-phase segmented well pipe 2210 and secondary-phase segmented well pipe 2212, the volume around the volume of the RF fields between primary-phase segmented well pipe 2210 and secondary-phase segmented well pipe 2212 as shown by field lines 2226 is heating from conduction. Accordingly, $l'_{h1}>l_{h1}$, and $w'_{h1}>w_{h1}$. Similarly, the remaining heating areas, 2242, 2244, 2248 and 2250 additionally are respectively larger than heating areas, 2232, 2234, 2238 and 2240 as shown in FIG. 22*a*, but still have a generally oval shape with a length of its major axis as $l'_{h2}$ and with a width of its minor axis as $w'_{h2}$. With continued RF energy coupling between primary-phase segmented well pipe 2202 and secondary-phase segmented well pipe 2204, between primary-phase segmented well pipe 2206 and secondary-phase segmented well pipe 2208, between primary-phase segmented well pipe 2214 and secondary-phase segmented well pipe 2216 and between primary-phase segmented well pipe 2218 and secondary-phase segmented well pipe 2220, the volume around the volume of the RF fields between these pairs of segmented well pipes is heating from a combination of conduction from the hottest volumes where the RF fields are strongest and continued RF heating by the less intense fields. Accordingly, $l'_{h1}>l_{h2}$, and $w'_{h2}>w_{h2}$.

Figure 22C:
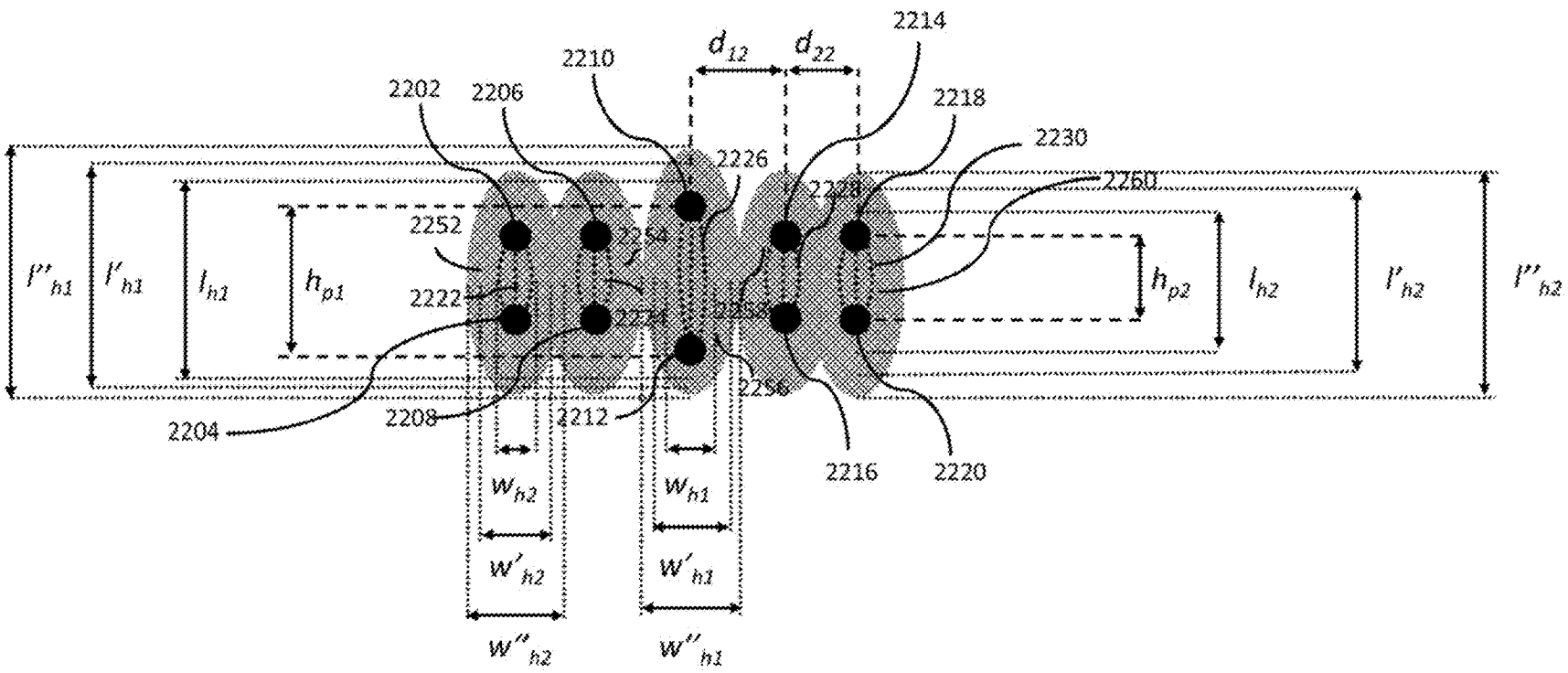
FIG. 22*c* illustrates the six-wire transmission line formed from well pipes of FIG. 22*a* at a time $t_{16}$.

FIG. 22*c* illustrates the ten-wire transmission line formed from well pipes of FIG. 22*a* at a time $t_{16}$.

In FIG. 22*c*, heated area 2242, heated area 2244, heated area 2246, heated area 2248 and heated area 2250 of FIG. 22*b* have been replaced with larger heated areas 2252, 2254, 2256, 2258 and 2260, respectively.

Heated area 2256 around coupled primary-phase segmented well pipe 2210 and secondary-phase segmented well pipe 2212 is larger than heated area 2246 as shown in FIG. 22*b*, but still has a generally oval shape with a length of its major axis as $l''_{h1}$ and with a width of its minor axis as $w''_{h1}$. With continued RF energy coupling between primary-phase segmented well pipe 2210 and secondary-phase segmented well pipe 2212, the volume around the volume of the RF fields between primary-phase segmented well pipe 2210 and secondary-phase segmented well pipe 2212 as shown by field lines 2226 is still heating from a combination of conduction from the hottest volumes where the RF fields are strongest and continued RF heating by the less intense fields. Accordingly, $l''_{h1}>l'_{h1}$, and $w''_{h1}>w'_{h1}$. Similarly, the remaining heating areas, 2252, 2254, 2258 and 2260 additionally are respectively larger than heating areas, 2242, 2244, 2248 and 2250 as shown in FIG. 22*b*, but still have a generally oval shape with a length of its major axis as $l''_{h2}$ and with a width of its minor axis as $w''_{h2}$. With continued RF energy coupling between primary-phase segmented well pipe 2202 and secondary phase segmented well pipe 2204, between primary-phase segmented well pipe 2206 and secondary-phase segmented well pipe 2208, between primary-phase segmented well pipe 2214 and secondary-phase segmented well pipe 2216 and between primary-phase segmented well pipe 2218 and secondary-phase segmented well pipe 2220, the volume around the volume of the RF fields between these pairs of segmented well pipes is heating from a combination of conduction from the hottest volumes where the RF fields are strongest and continued RF heating by the less intense fields. Accordingly, $l''_{h2}>l'_{h2}$, and $w''_{h2}>w'_{h2}$.

In the example described from FIGS. 22*a-c*, some of the spacings were common to multiple sets of well pipes. In an actual installation, the all the spacings can be varied as required to build a system appropriate for the characteristics of the particular hydrocarbon strata targeted In an aspect of the present invention discussed above with reference to FIGS. 20*a*-21*c*, the coupling between segmented well pipes is changed over time to maximize the amount of heated area. In another aspect of the present invention discussed above with reference to FIGS. 22*a-c*, the spacing between coupled segmented will pipes may be adjusted to obtain a more evenly heated overall cross-sectional area. In yet another aspect of the present invention, the coupled segmented well pipes may be arranged in a non-parallel manner to regulate heating along the well pipe segments. This will be described in greater detail with reference to FIGS. 23*a*-24*c*.

Figure 23A:
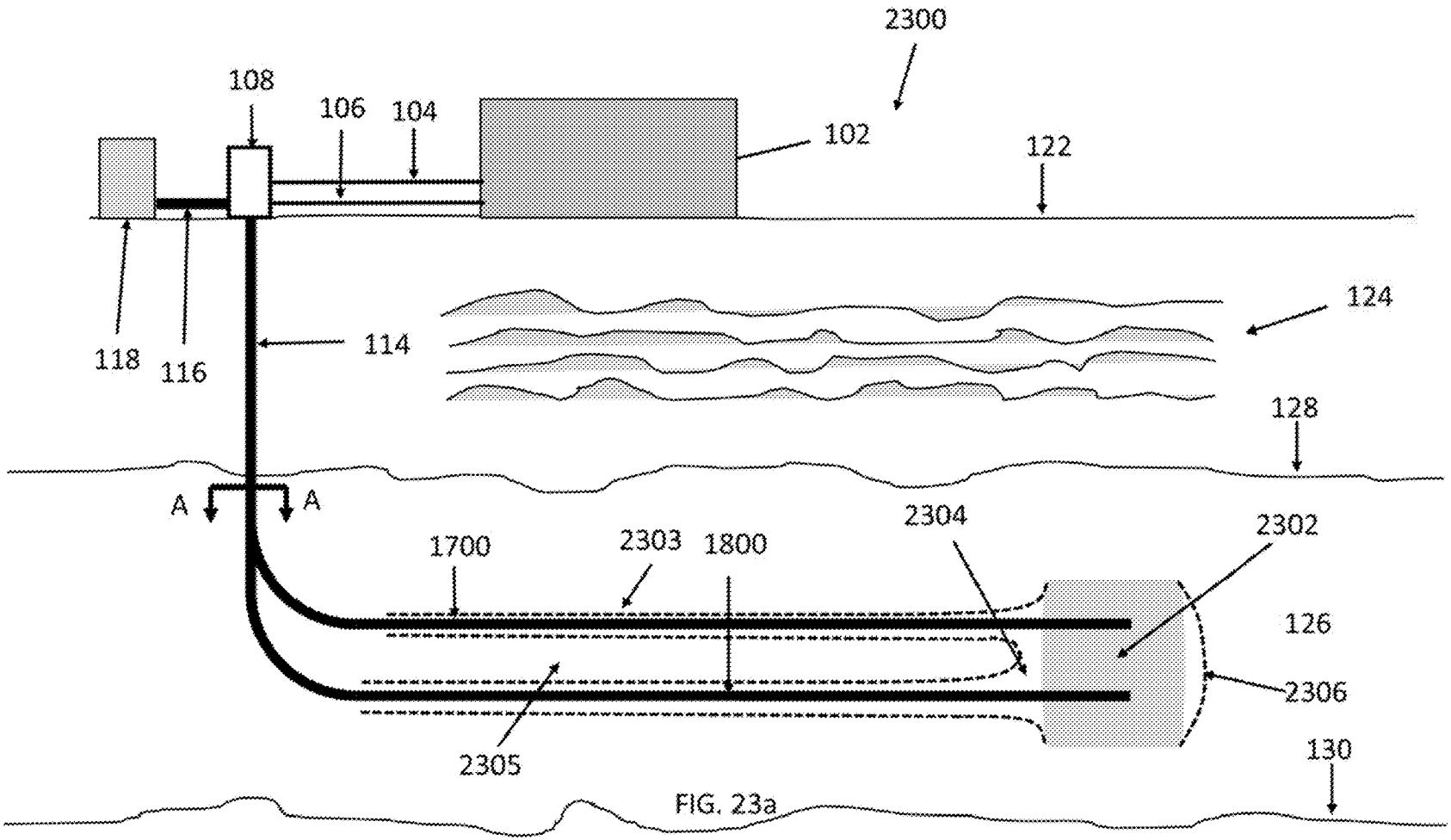
FIG. 23*a* illustrates another example dry fracture shale energy extraction system in accordance with aspects of the present invention at a time $t_{17}$.

FIG. 23*a* illustrates another example dry fracture shale energy extraction system 2300 in accordance with aspects of the present invention at a time $t_{17}$.

As shown in the figure, dry fracture shale energy extraction system 2300 is similar to dry fracture shale energy extraction system 100 discussed above with reference to FIG. 1, but differs in that dry fracture shale energy extraction system 2300 includes primary-phase segmented well pipe 1700 and secondary-phase segmented well pipe 1800 in place of first and secondary-phase well pipes 110 and 112, respectively.

FIG. 23*a* additionally includes an RF heat zone 2302, a conduction heat zone 2304 and a conduction heat zone 2306. RF heat zone 2302 is disposed between conduction heat zone 2304 and conduction heat zone 2306.

RF heat zone 2302 is similar to the heat zones discussed above with reference to FIGS. 18*a-c*, for example heat zone 1804. Conduction heat zone 2304 and conduction heat zone 2306 are zones of conducted heat, which may not be of sufficient temperature to extract oil and gas from hydrocarbon bearing strata 126.

Conduction heat zone 2304 is produced by heat conducting from RF heat zone 2302 into the surrounding hydrocarbon bearing strata 126. Further, a portion of conduction heat zone 2304 radially surrounding primary-phase segmented well pipe 1700 and secondary-phase segmented well pipe 1800 is produced by heat conducting from the hot gas and oil pumping through primary-phase segmented well pipe 1700 and secondary-phase segmented well pipe 1800 up to oil storage tank 118. The portion of conduction heat zone 2304 radially surrounding primary-phase segmented well pipe 1700 and secondary-phase segmented well pipe 1800 is illustrated in FIG. 23*a* as item 2303. As further noted in the figure, at time $t_{17}$, item 2303 is generally radially close to the surface of primary phase segmented well pipe 1700 and secondary-phase segmented well pipe 1800, leaving an unheated area 2305 between primary-phase segmented well pipe 1700 and secondary-phase segmented well pipe 1800 that is not in RF heat zone 2302.

Again, after sufficient oil and gas are removed from RF heating zone 2302, the heating zones may be shifted along primary-phase segmented well pipe 1700 and secondary-phase segmented well pipe 1800. All the while, as oil and gas are removed from RF heating zone 2302, the portion of conduction heat zone 2404 radially surrounding primary-phase segmented well pipe 1700 and secondary-phase segmented well pipe 1800 is illustrated in FIG. 23*a* as item 2303 will continue to radially increase, whereas unheated area 2305 will continue to decrease. This will be described with reference to FIG. 23*b*.

Figure 23B:
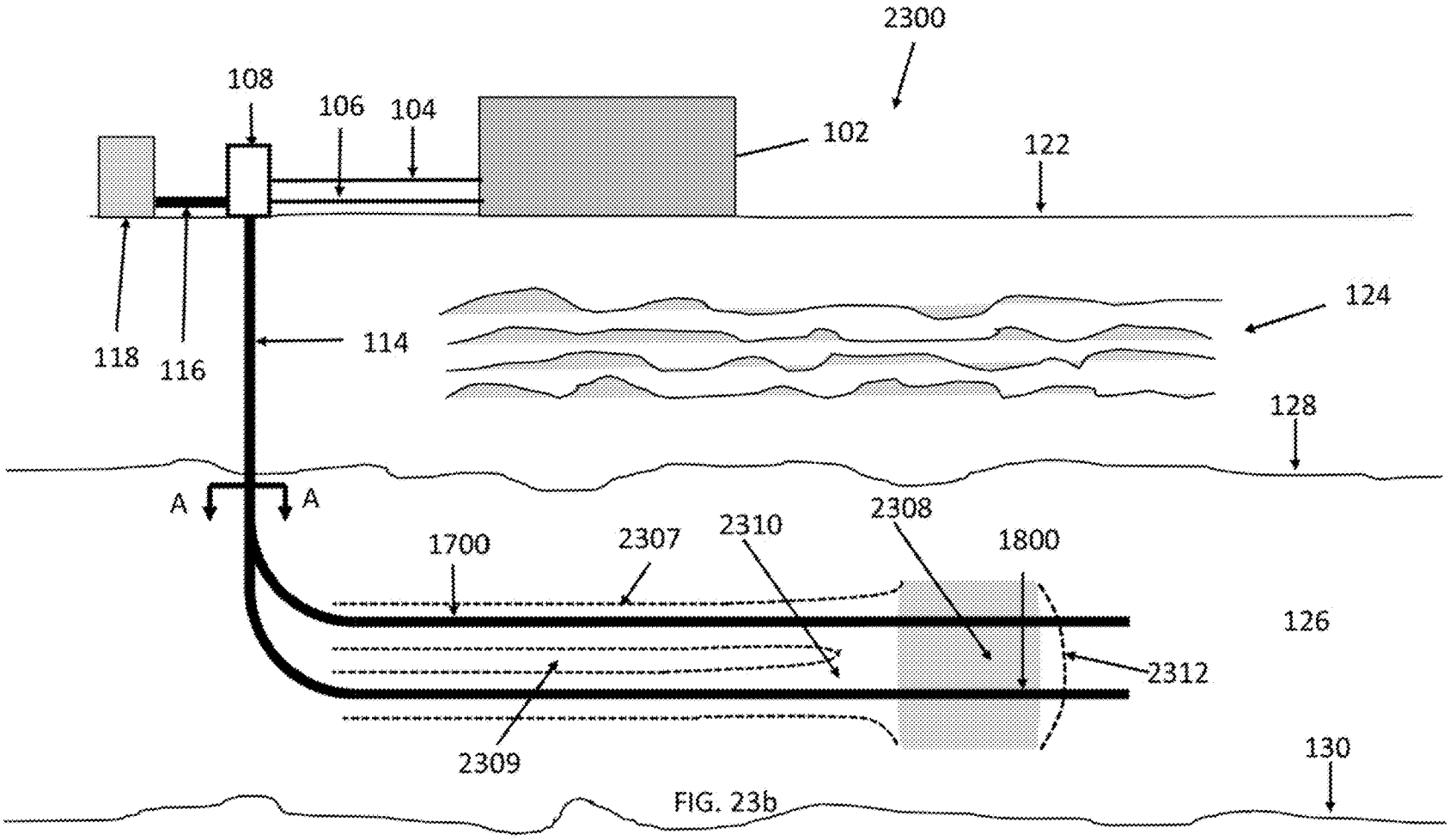
FIG. 23*b* illustrates the example dry fracture shale energy extraction system of FIG. 23*a* at a time $t_{18}$.

FIG. 23*b* illustrates the example dry fracture shale energy extraction system of FIG. 23*a* at a time $t_{18}$.

FIG. 23*b* differs from FIG. 23*a* in that FIG. 23*b* includes an RF heat zone 2308, a conduction heat zone 2310 and a conduction heat zone 2312 as opposed to RF heat zone 2302, conduction heat zone 2304 and conduction heat zone 2306. RF heat zone 2308 is disposed between conduction heat zone 2310 and conduction heat zone 2312.

RF heat zone 2308 is similar to RF heat zone 2302 of FIG. 23*a*. Conduction heat zones 2310 and 2312 are similar to conduction heat zone 2304 and conduction heat zone 2306 of FIG. 23*a*. As can be seen, conduction heat zone 2310 is much larger than conduction heat zone 2304.

Conduction heat zone 2310 is produced by heat conducting from RF heat zone 2308 into the surrounding hydrocarbon bearing strata 126. Further a portion of conduction heat zone 2310 radially surrounding primate phase segmented well pipe 1700 and secondary-phase segmented well pipe 1800 is produced by heat conducting from the hot gas and oil pumping through primary-phase segmented well pipe 1700 and secondary-phase segmented well pipe 1800 up to oil storage tank 118. The portion of conduction heat zone 2310 radially surrounding primary-phase segmented well pipe 1700 and secondary-phase segmented well pipe 1800 is illustrated in FIG. 23*b* as item 2307. As further noted in the figure, at time $t_{18}$, item 2307 is radially larger than area 2303 shown in FIG. 23*a*, whereas an unheated area 2309 between primary-phase segmented well pipe 1700 and secondary-phase segmented well pipe 1800 that is not in RF heat zone 2302 is smaller than area 2305 as shown in FIG. 23*a*.

Again, after sufficient oil and gas are removed from RF heating zone 2308, the heating zones may be shifted along primary-phase segmented well pipe 1700 and secondary-phase segmented well pipe 1800. Again, as oil and gas are removed from RF heating zone 2308, the portion of conduction heat zone 2310 radially surrounding primary-phase segmented well pipe 1700 and secondary-phase segmented well pipe 1800 is illustrated in FIG. 23*b* as item 2307 will continue to radially increase, whereas unheated area 2309 will continue to decrease. This will be described with reference to FIG. 23*c*.

Figure 23C:
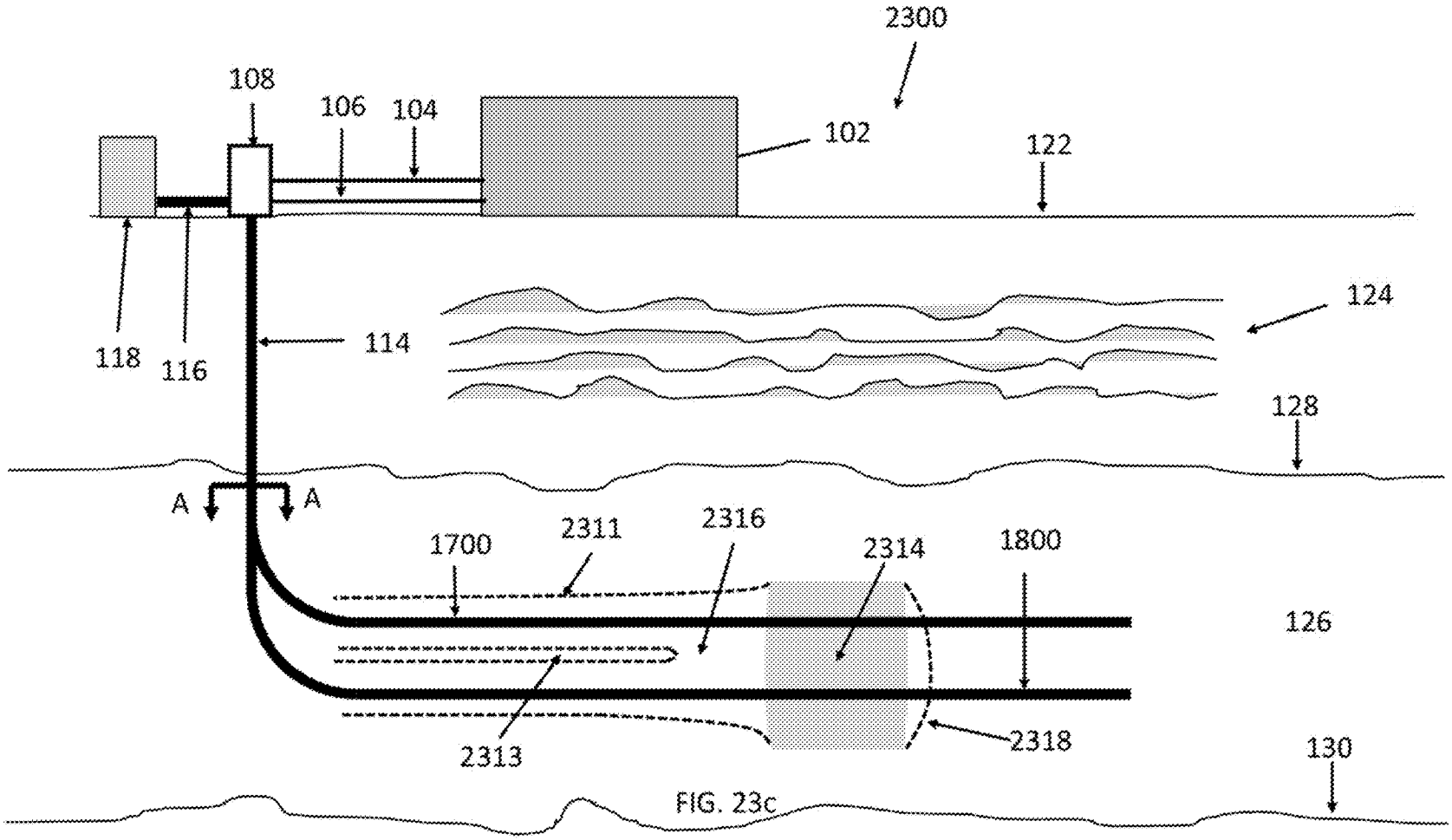
FIG. 23*c* illustrates the example dry fracture shale energy extraction system of FIG. 23*a* at a time $t_{19}$.

FIG. 23*c* illustrates the example dry fracture shale energy extraction system of FIG. 23*a* at a time $t_{19}$.

FIG. 23*c* differs from FIG. 23*b* in that FIG. 23*c* includes an RF heat zone 2314, a conduction heat zone 2316 and a conduction heat zone 2318 as opposed to RF heat zone 2308, conduction heat zone 2310 and conduction heat zone 2312. RF heat zone 2314 is disposed between conduction heat zone 2316 and conduction heat zone 2318.

RF heat zone 2314 is similar to RF heat zone 2308 of FIG. 23*b*. Conduction heat zones 2316 and 2318 are similar to conduction heat zone 2310 and conduction heat zone 2312 of FIG. 23*b*. As can be seen, conduction heat zone 2316 is much larger than conduction heat zone 2310.

Conduction heat zone 2316 is produced by heat conducting from RF heat zone 2314 into the surrounding hydrocarbon bearing strata 126. Further, a portion of conduction heat zone 2316 radially surrounding primary-phase segmented well pipe 1700 and secondary-phase segmented well pipe 1800 is produced by heat conducting from the hot gas and oil pumping through primary-phase segmented well pipe 1700 and secondary-phase segmented well pipe 1800 up to oil storage tank 118. The portion of conduction heat zone around primary-phase segmented well pipe 1700 and secondary-phase segmented well pipe 1800 is illustrated in FIG. 23*c* as item 2311. As further noted in the figure, at time $t_{19}$, item 2311 is much larger than area 2307 shown in FIG. 23*b*, whereas an unheated area 2313 between primary-phase segmented well pipe 1700 and secondary-phase segmented well pipe 1800 that is not in RF heat zone 2314 is smaller than area 2309 as shown in FIG. 23*b*.

Again, after sufficient oil and gas are removed from RF heating zone 2314, the heating zones may be shifted along primary-phase segmented well pipe 1700 and secondary-phase segmented well pipe 1800. This heating, shifting, heating process continues until the entire volume of hydrocarbon bearing strata 126 surrounding the well pipes have been liberated of oil and gas.

As can be seen in the progression of heating from FIGS. 23*a-c*, the conduction heat zone in the direction of the shifting of RF heating zones (from right to left of the figures) continues to grow. The conduction heat zones in the figures are not drawn to scale, but are provided for purposes of discussion. The point is that, this additional heating of the strata can be taken advantage of in one of two ways. Either the amount of heating applied can be reduced, or the separation between the lines can be increased to produce more oil and gas.

In accordance with another aspect of the invention, the RF heating zones may be more precisely controlled and the conduction heat zones best utilized by disposing the coupled segmented will pipes so as not to be parallel with one another. This will be described in greater detail with reference to FIGS. 24*a-c*.

Figure 24A:
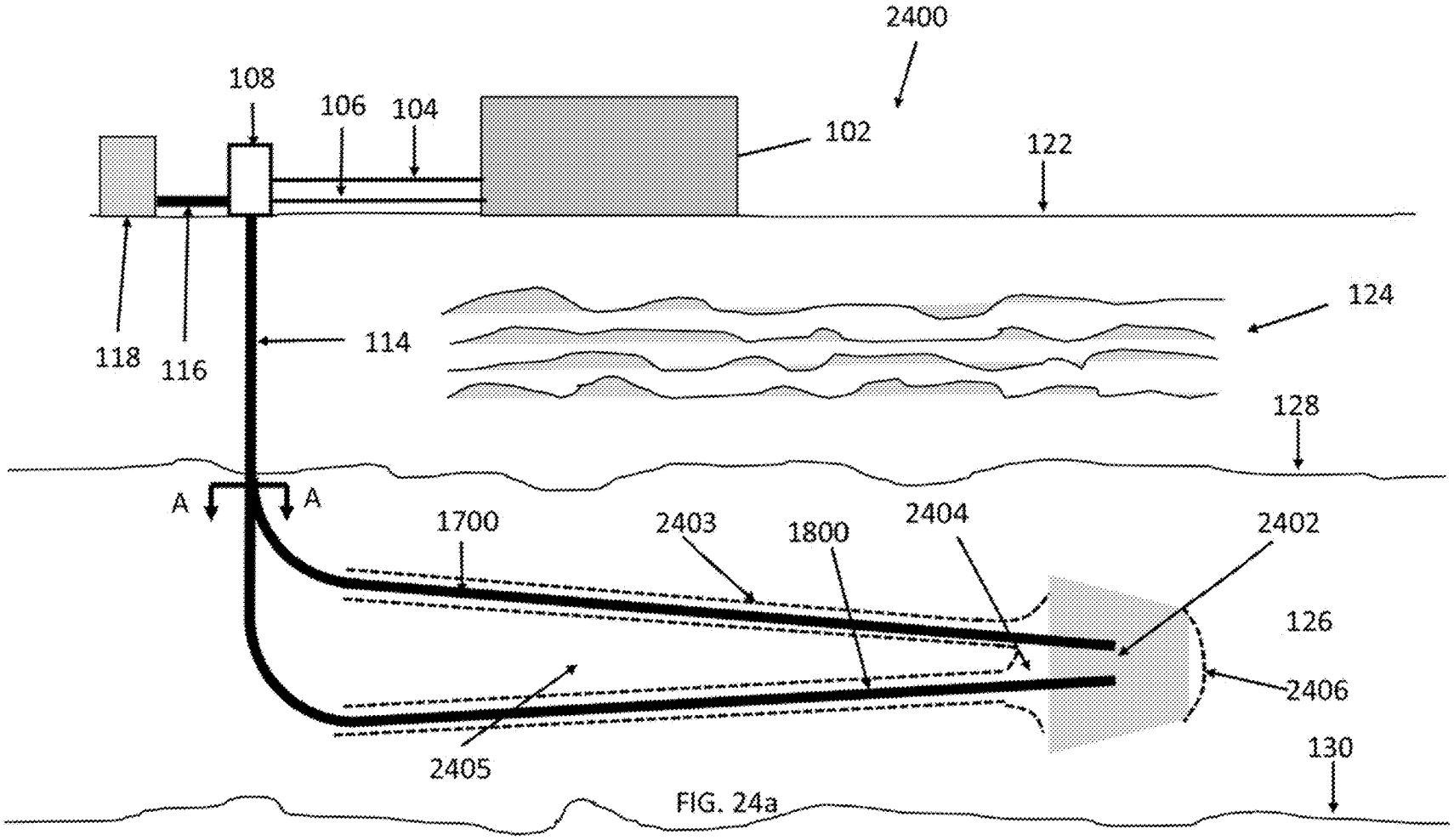
FIG. 24*a* illustrates another example dry fracture shale energy extraction system in accordance with aspects of the present invention at a time $t_{20}$.

FIG. 24*a* illustrates another example dry fracture shale energy extraction system 2400 in accordance with aspects of the present invention at a time $t_{20}$.

As shown in the figure, dry fracture shale energy extraction system 2400 is similar to dry fracture shale energy extraction system 2300 discussed above with reference to FIG. 23, but differs in that dry fracture shale energy extraction system 2400 includes primary-phase segmented well pipe 1700 and secondary-phase segmented well pipe 1800 arranged so as not to be parallel with one another.

FIG. 24*a* additionally includes an RF heat zone 2402, a conduction heat zone 2404 and conduction heat zone 2406. RF heat zone 2402 is disposed between conduction heat zone 2404 and conduction heat zone 2406.

RF heat zone 2402 has a more tapered trapezoidal shape as compared to RF heat zone 2302 of FIG. 23*a*. This is a result of the non-parallel disposition of primary-phase segmented well pipe 1700 and secondary-phase segmented well pipe 1800.

Conduction heat zones 2404 and 2406 are zones of conducted heat, which may not be of sufficient temperature to extract oil and gas from hydrocarbon bearing strata 126.

Conduction heat zones 2404 and 2406 area produced by heat conducting from RF heat zone 2402 into the surrounding hydrocarbon bearing strata 126. The relative size of conduction zones is governed by the area over which the thermal energy may be conducted out and the temperature differences between the RF heat zone and the conduction zone.

Further, a portion of conduction heat zone 2402 radially surrounding primary-phase segmented well pipe 1700 and secondary-phase segmented well pipe 1800 is produced by heat conducting from the hot gas and oil pumping through primary-phase segmented well pipe 1700 and secondary-phase segmented well pipe 1800 up to oil storage tank 118. The portion of conduction heat zone 2402 radially surrounding primary-phase segmented well pipe 1700 and secondary-phase segmented well pipe 1800 is illustrated in FIG. 24*a* as item 2403. As further noted in the figure, at time $t_{20}$, item 2403 is generally radially close to the surface of primary-phase segmented well pipe 1700 and secondary-phase segmented well pipe 1800, leaving an unheated area 2405 between primary-phase segmented well pipe 1700 and secondary-phase segmented well pipe 1800 that is not in RF heat zone 2402.

Again, after sufficient oil and gas are removed from RF heating zone 2402, the heating zones may be shifted along primary-phase segmented well pipe 1700 and secondary-phase segmented well pipe 1800. All the while, as oil and gas are removed from RF heating zone 2402, the portion of conduction heat zone around primary-phase segmented well pipe 1700 and secondary-phase segmented well pipe 1800 is illustrated in FIG. 24*a* as item 2403 will continue to radially increase, whereas unheated area 2405 will continue to decrease. This will be described with reference to FIG. 24*b*.

Figure 24B:
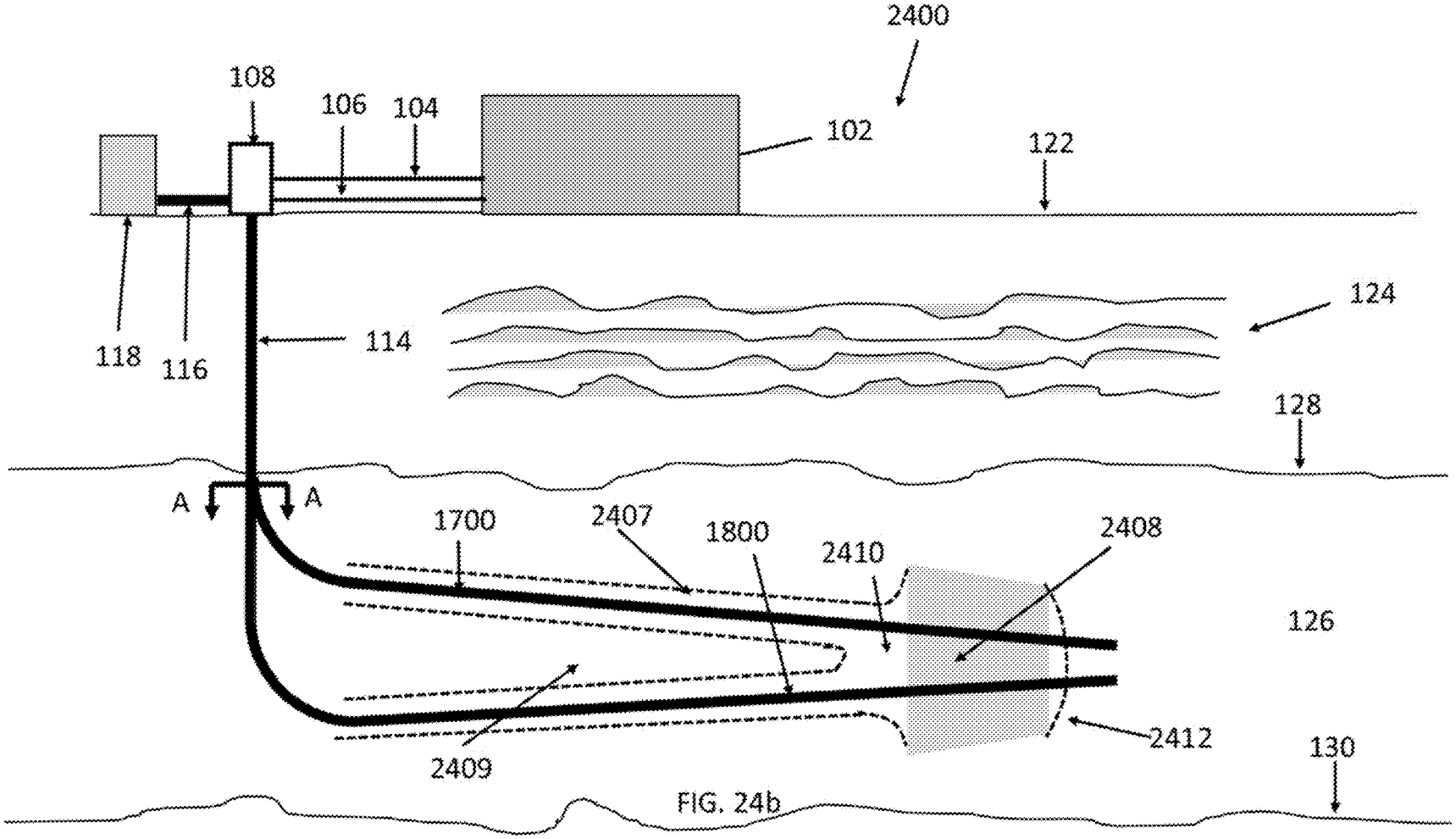
FIG. 24*b* illustrates the example dry fracture shale energy extraction system of FIG. 24*a* at a time $t_{21}$.

FIG. 24*b* illustrates the example dry fracture shale energy extraction system of FIG. 24*a* at a time $t_{21}$.

FIG. 24*b* differs from FIG. 23*b* in that FIG. 24*b* includes an RF heat zone 2408, a conduction heat zone 2410 and a conduction heat zone 2412 as opposed to RF heat zone 2308, conduction heat zone 2310 and conduction heat zone 2312. RF heat zone 2408 is disposed between conduction heat zone 2410 and conduction heat zone 2412.

RF heat zone 2408 has a more tapered trapezoidal shape as compared to RF heat zone 2308 of FIG. 23*b*. This is a result of the non-parallel disposition of primary phase well pipe 1700 and secondary-phase segmented well pipe 1800.

Conduction heat zones 2410 and 2412 are zones of conducted heat, which may not be of sufficient temperature to extract oil and gas from hydrocarbon bearing strata 126.

Conduction heat zones 2410 and 2412 area produced by heat conducting from RF heat zone 2482 into the surrounding hydrocarbon bearing strata 126.

RF heat zone 2408 is similar to, but a little larger than, RF heat zone 2402 of FIG. 24*a*. Conduction heat zones 2410 and 2412 are similar to, but a little larger than, conduction heat, zone 2404 and conduction heat zone 2406 of FIG. 23*b*. As can be seen, conduction heat zone 2310 is much larger than conduction heat zone 2304.

Conduction heat zone 2410 is produced by heat conducting from RF heat zone 2408 into the surrounding hydrocarbon bearing strata 126. Further, a portion of conduction heat zone 2410 radially surrounding primary-phase segmented well pipe 1700 and secondary-phase segmented well pipe 1800 is produced by heat conducting from the hot gas and oil pumping through primary-phase segmented well pipe 1700 and secondary-phase segmented well pipe 1800 up to oil storage tank 118. The portion of conduction heat zone 2410 radially surrounding primary-phase segmented well pipe 1700 and secondary-phase segmented well pipe 1800 is illustrated in FIG. 24*b* as item 2407. As further noted in the figure, at time $t_{21}$, item 2407 is radially larger than area 2403 shown in FIG. 24*a*, whereas an unheated area 2409 between primary-phase segmented well pipe 1700 and secondary-phase segmented well pipe 1800 that is not in RF heat zone 2302 is smaller than area 2405 as shown in FIG. 24*a*.

Again, after sufficient oil and gas are removed from RF heating zone 2408, the heating zones may be shifted along primary-phase segmented well pipe 1700 and secondary-phase segmented well pipe 1800. Again, as oil and gas are removed from RF heating zone 2408, the portion of conduction heat zone 2410 radially surrounding primary-phase segmented well pipe 1700 and secondary-phase segmented well pipe 1800 is illustrated in FIG. 24*b* as item 2407 will continue to radially increase, whereas unheated area illustrated as item 2409 will continue to decrease. This will be described with reference to FIG. 23*c*.

FIG. 24*e* illustrates the example dry fracture shale energy extraction system of FIG. 24*a* at a time $t_{22}$.

Figure 24C:
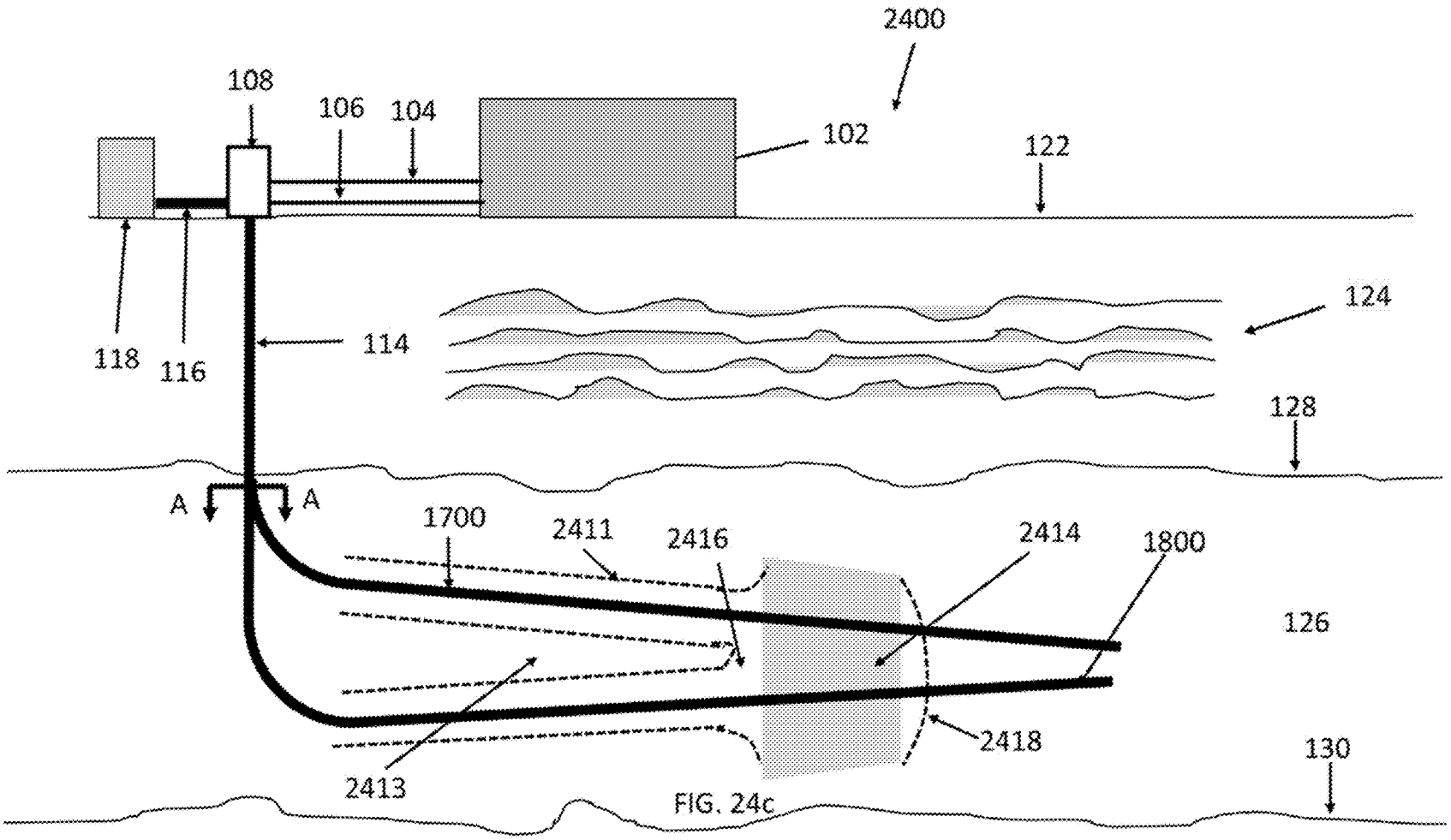
FIG. 24*c* illustrates the example dry fracture shale energy extraction system of FIG. 24*a* at a time $t_{22}$.

FIG. 24*c* differs from FIG. 23*c* in that FIG. 24*c* includes an RF heat zone 2414, a conduction heat zone 2416 and a conduction heat zone 2418 as opposed to RF heat zone 2314, conduction heat zone 2316 and conduction heat zone 2318. RF heat zone 2414 is disposed between conduction heat zone 2416 and conduction heat zone 2418.

RF heat zone 2414 has a more tapered trapezoidal shape as compared to RF heat zone 2314 of FIG. 23*c*. This is a result of the non-parallel disposition of primary-phase segmented well pipe 1700 and secondary-phase segmented well pipe 1800.

Conduction heat zones 2416 and 2418 are zones of conducted heat, which may not be of sufficient temperature to extract oil and gas from hydrocarbon bearing strata 126.

Conduction heat zones 2416 and 2418 area produced by heat conducting from RF heat zone 2482 into the surrounding hydrocarbon bearing strata 126.

RF heat zone 2414 is similar to, but a little larger than, RF heat zone 2408 of FIG. 24*b*. Conduction heat zones 2416 and 2418 are similar to, but a little larger than, conduction heat zone 2410 and conduction heat zone 2412 of FIG. 24*b*.

As can be seen, conduction heat zone 2418 is much larger than conduction heat zone 2312.

Conduction heat zone 2416 is produced by heat conducting from RF heat zone 2408 into the surrounding hydrocarbon bearing strata 126. Further, a portion of conduction heat zone 2416 radially surrounding primary-phase segmented well pipe 1700 and secondary-phase segmented well pipe 1800 is produced by heat conducting from the hot gas and oil pumping through primary-phase segmented well pipe 1700 and secondary-phase segmented well pipe 1800 up to oil storage tank 118. The portion of conduction heat zone 2416 radially surrounding primary-phase segmented well pipe 1700 and secondary-phase segmented well pipe 1800 is illustrated in FIG. 24*c* as item 2411. As further noted in the figure, at time $t_{22}$, item 2411 is radially larger than area 2407 shown in FIG. 24*b*, whereas an unheated area. 2413 between primary-phase segmented well pipe 1700 and secondary-phase segmented well pipe 1800 that is not in RF heat zone 2314 is smaller than area 2409 as shown in FIG. 24*b*.

Again, after sufficient oil and gas are removed from RF heating zone 2414, the heating zones may be shifted along primary-phase segmented well pipe 1700 and secondary-phase segmented well pipe 1800. Again, as oil and gas are removed from RF heating zone 2414, the portion of conduction heat zone 2416 radially surrounding primary-phase segmented well pipe 1700 and secondary-phase segmented well pipe 1800 is illustrated in FIG. 24*c* as item 2411 will continue to radially increase, whereas unheated area illustrated as item 2413 will continue to decrease.

This heating, shifting, heating process continues until the entire volume of hydrocarbon bearing strata 126 surrounding the well pipes have been liberated of oil and gas.

As can be seen in the progression of heating from FIGS. 24*a-c*, the conduction heat zone in the direction of the shifting of RF heating zones (from right to left of the figures) continues to grow. However, as compared to the example embodiment of FIGS. 23*a-c*, the unheated area in the example embodiment of FIGS. 24*a-c* is larger. This can been seen by comparing unheated area 2305 of FIG. 23*a* with unheated area 2405 of FIG. 24*a*, by comparing unheated area 2309 of FIG. 23*b* with unheated area 2409 of FIG. 24*b* or comparing unheated area 2313 of FIG. 23*c* with unheated area 2413 of FIG. 24*c*.

In the above-discussed non-limiting example embodiments, the segmented well pipes include axially aligned segmented well pipe sections that generally linearly arranged. It should be noted that other embodiments may include non-linear or curved segmented well pipe sections that are arranged to form a non-linear or curved segmented well pipe.

In the above-discussed non-limiting example embodiments, RF fields are used to heat portions of volume of hydrocarbon bearing strata around segmented well pipes. It should be noted that other embodiments may use the RF fields to affect other parameters in the portions of volume of hydrocarbon bearing strata around segmented well pipes. Examples of such effects include altering the wettability of hydrocarbons within portions of volume of hydrocarbon bearing strata around segmented well pipes and altering the relative permeability of hydrocarbons within portions of volume of hydrocarbon bearing strata around segmented well pipes.

The conduction heat zones in the figures are not drawn to scale, but are provided for purposes of discussion. The point is that making the well pipes non-parallel with one another will decrease the conduction heat zones in the direction of the shifting of RF heating. This will increase the amount of oil and gas retrieved while decreasing exposure to heating in the direction of the shilling of RF heating. This will in turn, decreases the chances of decreasing structural integrity of hydrocarbon bearing strata 126 surrounding the well pipes.

There are many methods in use or that have beep proposed for the enhanced extraction of oil and gas from low permeability strata. The most widely used is hydraulic fracturing, which was discussed above and has the drawback of requiring large amounts of water. Problems exist both with obtaining the water and with disposing of the water. Obtaining the water can lead to severe reduction in local aquifer levels or require the use of 400 to 500 tanker trucks that can damage rural roads since most of these roads have not been designed to accommodate the heavy loading from the water trucks. Disposing of waste water is also a problem since 10% to 50% of the millions of gallons of water pumped into the ground returns to the surface. This returned water is contaminated both by heavy metals and by hydraulic fracturing fluids and must be either cleaned up or disposed of in an environmentally friendly way.

Strip mining followed by surface pyrolysis has been used for many years as a method for extracting oil and gas from immature hydrocarbon bearing strata. The main problem with strip mining are the massive amounts of overburden that must be removed to get to the hydrocarbon bearing strata. Unless the hydrocarbon bearing strata is near the surface it is frequently uneconomical to strip all the way down to the strata. Also there is much environmental resistance to the large amount of surface disruption associated with strip mining.

Other methods of enhanced extraction that have been proposed use heat, which emanates from the well pipe into the hydrocarbon bearing strata. This includes such techniques as steam heating or heaters inserted into the well bores. The heat from these sources dissipates slowly into the hydrocarbon strata due to the low thermal conductivity of the strata. Thermal conductivity values range from approximately 0.5 W/(m*K). to 3 W/(m*K). Great care must be taken to prevent overheating and melting of the heater and the rock near the well pipe. To make such systems work it takes a slow enough heating rate to prevent overheating, which means it can take years to heat even small volumes of shale.

RF based systems have been proposed using antennas. These systems have similar problems to well bore heating methods since the near fields of the antenna cause heating immediately adjacent to the well bore. Antennas, therefore, act like local heaters and have the same problems with overheating as discussed above.

The system and method described herein is directed toward the use of RF energy to enhance the extraction of oil and gas from hydrocarbon bearing strata. It uses a three-dimensional underground electromagnetic array to guide RF energy to where the energy is deposited as heat into the hydrocarbon bearing strata. The three-dimensional underground electromagnetic array is a guided wave structure, not an antenna structure, to minimize the unwanted effects of near fields associated with antennas. In one realization the legs of the three-dimensional underground electromagnetic array are comprised of production well pipe.

The system and method are designed to work along the entire extent of a horizontally drilled well bore such as are used to efficiently extract oil and gas from hydrocarbon bearing strata with large horizontal extend and smaller vertical extent. There are multiple three-dimensional underground electromagnetic arrays along the length of the well bore so individual volumes of rock (e.g. 100,000 tons, 50,000 cubic yards) may be heated at one time.

The heat deposited in the hydrocarbon bearing strata has two effects. First it causes stresses in the hydrocarbon strata that will cause cracking and will increase the permeability of the strata. These stresses are caused by thermal gradients and by differential thermal expansion. The stress required to cause cracking may also be reduced by chemical changes in the hydrocarbon strata, which reduce the strength of the rock. Second it will cause in situ pyrolysis of the kerogen in the strata releasing additional oil and gas to be recovered.

The release of the additional oil and gas combined with additional well pipes required to form the arrays means that more oil and gas per volume will be recovered than through any other method of enhanced oil and gas production. Further the system and method herein will not require the large amount of water that is currently used in hydraulic fracturing.

The system and method described herein has several benefits over previous methods for extracting oil and gas from low permeability shale and for performing in situ pyrolysis.

Firstly, the system does not use water to increase the permeability of the hydrocarbon bearing strata. There is no need for large volumes of water to be transported to the site or for the environmental cleanup or disposal of large volumes of water coming back up the well pipe.

Secondly, the system uses electromagnetic guiding structures, not RF antennas. As noted above RF antennas have near fields, which cause unwanted preferential heating immediately adjacent to the wellbore. Electromagnetic guiding arrays do not have the same near field structure as antennas. In the case of electromagnetic guiding arrays the only preferential heating near the well bore is caused by geometry.

Thirdly, the RF energy is dispersed throughout the volume of the three dimensional underground electromagnetic array so the hydrocarbon strata is heated much more uniformly than simple well bore heaters. The heat is deposited out in the hydrocarbon bearing strata and does not have to be conducted by low thermal conductivity rock to where it is needed to cause cracking and pyrolysis.

Fourthly, the system is designed to work in situ, the problems associated with strip mining are removed. There is minimal surface disruption and no cost associated with removing large amounts of overburden.

In the drawings and specification, there have been disclosed embodiments of the invention and, although specific terms are employed, they are used in a generic and descriptive sense only and not for purposes of limitation, the scope of the invention being set forth in the following claims.

What is claimed as new and desired to be protected by Letters Patent of the United States is:

1. A system comprising:

a first primary-phase well pipe segment;

a primary-phase dielectric spacer connected to said first primary-phase well pipe segment;

a second primary-phase well pipe segment connected to said primary-phase dielectric spacer such that said primary-phase dielectric spacer is disposed between said first primary-phase well pipe segment and said second primary-phase well pipe segment;

a primary-phase radio frequency (RF) transmission line segment operable to transmit a first RE signal;

a primary-phase well pipe segment switch having a first input port, a first output port, a second output port and a third output port, said primary-phase well pipe segment switch being operable to be in a first primary-phase well pipe segment state so as to electrically connect said first input port with said first output port and said second output port and operable to be in a second primary-phase well pipe segment state so as to electrically connect said first input port with said third output port;

a first secondary-phase well pipe segment;

a secondary-phase dielectric spacer connected to said first secondary-phase well pipe segment;

a second secondary-phase well pipe segment connected to said secondary-phase dielectric spacer such that said secondary-phase dielectric spacer is disposed between said first secondary-phase well pipe segment and said second secondary-phase well pipe segment;

a secondary-phase RE transmission line segment operable to transmit a second RE signal; and a secondary-phase well pipe segment switch having a second input port, a fourth output port, a fifth output port and a sixth output port, said secondary-phase well pipe segment switch being operable to be in a first secondary-phase well pipe segment state so as to electrically connect said second input port with said fourth output port and said fifth output port and operable to be in a second secondary-phase well pipe segment state so as to electrically connect said second input port with said sixth output port, wherein said first primary-phase well pipe segment and said first secondary-phase well pipe segment form a first two-wire transmission line when said primary-phase well pipe segment switch is in the first primary-phase well pipe segment state and when said secondary-phase well pipe segment switch is in the first secondary-phase well pipe segment state, and wherein said second primary-phase well pipe segment and said second secondary-phase well pipe segment form a second two-wire transmission line when said primary-phase well pipe segment switch is in the second primary-phase well pipe segment state and when said secondary-phase well pipe segment switch is in the second secondary-phase well pipe segment state.

2. The system of claim 1, wherein said primary-phase RF transmission line segment is operable to transmit the first RF signal having a primary-phase as a function of time, wherein said secondary-phase RF transmission line segment is operable to transmit the second RF signal having a secondary-phase as a function of time, and wherein the primary-phase is 180° out of phase with respect to the secondary-phase.

3. The system of claim 2, wherein said first primary-phase well pipe segment, said primary-phase dielectric spacer and said second primary-phase well pipe segment are disposed along a first axis, wherein said first secondary-phase well pipe segment, said secondary-phase dielectric spacer and said second secondary-phase well pipe segment are disposed along a second axis, and wherein the first axis and the second axis are parallel with one another.

4. The system of claim 3, wherein said first primary-phase well pipe segment is separated from said first secondary-phase well pile segment by a separation volume, and wherein when said primary-phase well pipe segment switch is in the first primary-phase well pipe segment state and when said secondary-phase well pipe segment switch is in the first secondary-phase well pipe segment state, said first primary-phase well pipe segment and said first secondary-phase well pipe segment are operable to heat the separation volume.

5. The system of claim 4, further comprising an RF signal generator operable to provide the first RF signal to said primary-phase RF transmission line segment and to provide the second RF signal to said secondary-phase RF transmission line segment.

6. The system of claim 1, wherein said first primary-phase well pipe segment said primary-phase dielectric spacer and said second primary-phase well pipe segment are disposed along a first axis, wherein said first secondary-phase well pipe se meant, said secondary-phase dielectric spacer and said second secondary-phase well pipe segment are disposed along a second axis, and wherein the first axis and the second axis are parallel with one another.

7. The system of claim 1, wherein said first primary-phase well pipe segment is separated from said first secondary-phase well pile segment by a separation volume, and wherein when said primary-phase well pipe segment switch is in the first primary-phase well pipe segment state and when said secondary-phase well pipe segment switch is in the first secondary-phase well pipe segment state, said first primary-phase well pipe segment and said first secondary-phase well pipe segment are operable to heat the separation volume.

8. The system of claim 1, further comprising an RF signal generator operable to provide the first RF signal to said primary-phase RF transmission line segment and to provide the second RF signal to said secondary-phase RF transmission line segment.

9. The system of claim 1, further comprising:

a second primary-phase dielectric spacer connected to said second primary-phase well pipe segment;

a third primary-phase well pipe segment connected to said second primary-phase dielectric spacer such that said second primary-phase dielectric spacer is disposed between said second primary-phase well pipe segment and said third primary-phase well pipe segment;

a second primary-phase RF transmission line segment operable to transmit the first RF signal;

a second primary-phase well pipe segment switch having a third input port, a seventh output port, an eighth output port and a ninth output port, said second primary-phase well pipe segment switch being operable to be in a third primary-phase well pipe segment state so as to electrically connect said third input port with said seventh output port and said eighth output port and operable to be in a fourth primary-phase well pipe segment state so as to electrically connect said third input port with said ninth output port;

a second secondary-phase dielectric spacer connected to said second secondary-phase well pipe segment;

a third secondary-phase well pipe segment connected to said second secondary-phase dielectric spacer such that said second secondary-phase dielectric spacer is disposed between said second secondary-phase well pipe segment and said third secondary-phase well pipe segment;

a second secondary-phase RF transmission line segment operable to transmit the second RF signal; and a second secondary-phase well pipe segment switch having a fourth input port, a tenth output port, an eleventh output port and a twelfth output port, said second secondary-phase well pipe segment switch being operable to be in a third secondary-phase well pipe segment state so as to electrically connect said fourth input port with said tenth output port and said eleventh output port and operable to be in a fourth secondary-phase well pipe segment state so as to electrically connect said fourth input port with said twelfth output port, wherein said third primary-phase well pipe segment and said third secondary-phase well pipe segment form a third two-wire transmission line when said second primary-phase well pipe segment switch is in the third primary-phase well pipe segment state and when said second secondary-phase well pipe segment switch is in the third secondary-phase well pipe segment state.

10. A method comprising:

providing a first well pipe including a first: primary-phase well pipe segment, a primary-phase dielectric spacer, a second primary-phase well pipe segment, a primary-phase radio frequency (RF) transmission line segment, a primary-phase well pipe segment switch, the primary-phase dielectric spacer being connected to the first primary-phase well pipe segment, the second primary-phase well pipe segment being connected to the primary-phase dielectric spacer such that the primary-phase dielectric spacer is disposed between the first primary-phase well pipe segment and the second primary-phase well pipe segment, the primary-phase RF transmission line segment being operable to transmit a first RF signal, the primary-phase well pipe segment switch having a first input port, a first output port, a second output port and a third output port, the primary-phase well pipe segment switch being operable to be in a first primary-phase well pipe segment state so as to electrically connect: the first input port with the first output port and the second output port and operable to be in a second primary-phase well pipe segment state, so as to electrically connect the first input port with the third output port;

providing a second well pipe including a first secondary-phase well pipe segment, a secondary-phase dielectric spacer, a second secondary-phase well pipe segment, a secondary-phase RF transmission line segment, a secondary-phase well pipe segment switch, the secondary-phase dielectric spacer being connected to the first secondary-phase well pipe segment, the second secondary-phase well pipe segment being connected to the secondary-phase dielectric spacer such that the secondary-phase dielectric spacer is disposed between the first secondary-phase well pipe segment and the second secondary-phase well pipe segment, the secondary-phase RF transmission line segment being operable to transmit a second RF signal, the secondary-phase well pipe segment switch having a second input port, a fourth output port, a fifth output port and a sixth output port, the secondary-phase well pipe segment switch being operable to be in a first secondary-phase well pipe segment state so as to electrically connect the second input port with the fourth output port and the fifth output port and operable to be in a second secondary-phase well pipe segment state so as to electrically connect the second input port with the sixth output port;

providing the first RF signal to the primary-phase RF transmission line segment; and providing the second RF signal to the secondary-phase RF transmission line segment, wherein the primary-phase well pipe segment and the secondary-phase well pipe segment form a first two-wire transmission line when the primary-phase well pipe segment switch is in the first primary-phase well pipe segment state and when the secondary-phase well pipe segment switch is in the first secondary-phase well pipe segment state, and wherein the second primary-phase well pipe segment and the second secondary-phase well pipe segment form a second two-wire transmission line when the primary-phase well pipe segment switch is in the second primary-phase well pipe segment state and when the secondary-phase well pipe segment switch is in the second secondary-phase well pipe segment state.

11. The method of claim 10, wherein said providing the first RF signal to the primary-phase RF transmission line segment comprises providing the first RF signal as a first RF signal having a primary-phase as a function of time, wherein providing the second RF signal to the secondary-phase RF transmission line segment comprises providing the second RF signal as a second RF signal having a secondary-phase as a function of time, and wherein the primary-phase is 180° out of phase with respect to the secondary-phase.

12. The method of claim 11, wherein said providing a first well pipe comprises providing the first primary-phase well pipe segment, the primary-phase dielectric spacer and, the second primary-phase well pipe segment disposed along a first axis, wherein said providing the second well pipe comprises providing the first secondary-phase well pipe segment, the secondary-phase dielectric spacer and the second secondary-phase well pipe segment disposed along a second axis, and wherein the first axis and the second axis are parallel with one another.

13. The method of claim 12, wherein said providing a second well pipe comprises providing the second well pipe such that the first primary-phase well pipe segment is separated from the first secondary-phase well pile segment by a separation volume, and wherein when the primary-phase well pipe segment switch is in the first primary-phase well pipe segment state and when the secondary-phase well pipe segment switch is in the first secondary-phase well pipe segment state, the first primary-phase well pipe segment and said first secondary-phase well pipe segment are operable to heat the separation volume.

14. The method of claim 13, wherein said providing the first RF signal to the primary-phase RF transmission line segment comprises providing the first RF signal via an RF signal generator.

15. The method of claim 10, wherein said providing a first well pipe comprises providing the first primary-phase well pipe segment, the primary-phase dielectric spacer and the second primary-phase well pipe segment disposed along a first axis, wherein said providing the second well pipe comprises providing the first secondary-phase well pipe segment, the secondary-phase dielectric spacer and the second, secondary-phase well pipe segment disposed along a second axis, and wherein the first axis and the second axis are parallel with one another.

16. The method of claim 10, wherein said providing a second well pipe comprises providing the second well pipe such that the first primary-phase well pipe segment is separated from the first secondary-phase well pile segment by a separation volume, and wherein when the primary-phase well pipe segment switch is in the first primary-phase well pipe segment state and when the secondary-phase well pipe segment switch is in the first secondary-phase well pipe segment state, the first primary-phase well pipe segment and said first secondary-phase well pipe segment are operable to heat the separation volume.

17. The method of claim 10, wherein said providing the first RF signal to the primary-phase RF transmission line segment comprises providing the first RF signal via an RF signal generator.

18. The method of claim 10, wherein said providing a first well pipe further comprises providing the first well pipe further including a second primary-phase dielectric spacer, a third primary-phase well pipe segment, a second primary-phase RF transmission line segment and a second primary-phase well pipe segment switch, the second primary-phase dielectric spacer being connected to the second primary-phase well pipe segment, the third primary-phase well pipe segment being connected to the second primary-phase dielectric spacer such that the second primary-phase dielectric spacer is disposed between the second primary-phase well pipe segment and the third primary-phase well pipe segment, the second primary-phase RF transmission line segment being operable to transmit the first RF signal, the second primary-phase well pipe segment switch having a third input port, a seventh output port, an eighth output port and a ninth output port, the second primary-phase well pipe segment switch being operable to be in a third primary-phase well pipe segment state so as to electrically connect the third input port with the seventh output port and the eighth output port and operable to be in a fourth primary-phase well pipe segment state so as to electrically connect the third input port with the ninth output port, wherein said providing a second well pipe further comprises providing the second well pipe further including a second secondary-phase dielectric spacer, a third secondary-phase well pipe segment, a second secondary-phase RF transmission line segment and a second secondary-phase well pipe segment switch, the second secondary-phase dielectric spacer being connected to the second secondary-phase well pipe segment, the third secondary-phase well pipe segment being connected to the second secondary-phase dielectric spacer such that the second secondary-phase dielectric spacer is disposed between the second secondary-phase well pipe segment and the third secondary-phase well pipe segment, the second secondary-phase RF transmission line segment being operable to transmit the second RF signal, the second secondary-phase well pipe segment switch having a fourth input port, a tenth output port, an eleventh output port and a twelfth output port, the second secondary-phase well pipe segment switch being operable to be in a third secondary-phase well pipe segment state so as to electrically connect the fourth input port with the tenth output port and the eleventh output port and operable to be in a fourth secondary-phase well pipe segment state so as to electrically connect said the input port with the twelfth output port, and wherein the third primary-phase well pipe segment and the third secondary-phase well pipe segment form a third two-wire transmission line when the second primary-phase well pipe segment switch is in the third primary-phase well pipe segment state and when the second secondary-phase well pipe segment switch is in the third secondary-phase well pipe segment state.

* * * * *